US009546525B2

(12) United States Patent
Mosing et al.

(10) Patent No.: US 9,546,525 B2
(45) Date of Patent: Jan. 17, 2017

(54) APPARATUS AND METHODS FOR SETTING SLIPS ON A TUBULAR MEMBER

(71) Applicant: Frank's International, LLC, Houston, TX (US)

(72) Inventors: Donald E. Mosing, Lafayette, LA (US); Vernon J. Bouligny, Lafayette, LA (US); John E. Stelly, Breaux Bridge, LA (US); Timothy Bernard, Youngsville, LA (US); Jacob Chu, Lafayette, LA (US); Adrian Paval, Lafayette, LA (US)

(73) Assignee: Frank's International, LLC, Houston, TX (US)

( * ) Notice: Subject to any disclaimer, the term of this patent is extended or adjusted under 35 U.S.C. 154(b) by 75 days.

(21) Appl. No.: 14/518,960

(22) Filed: Oct. 20, 2014

(65) Prior Publication Data

US 2015/0107857 A1 Apr. 23, 2015

Related U.S. Application Data

(60) Provisional application No. 61/961,558, filed on Oct. 18, 2013, provisional application No. 61/942,971, filed on Feb. 21, 2014, provisional application No. 62/001,500, filed on May 21, 2014.

(51) Int. Cl.

| | |
|---|---|
| ***E21B 19/10*** | (2006.01) |
| ***E21B 19/07*** | (2006.01) |
| ***E21B 19/16*** | (2006.01) |

(52) U.S. Cl.
CPC ..... *E21B 19/07* (2013.01); *E21B 19/10* (2013.01); *E21B 19/16* (2013.01)

(58) Field of Classification Search
USPC ..... 166/382, 77.53, 77.52
See application file for complete search history.

(56) References Cited

U.S. PATENT DOCUMENTS

| | | | | |
|---|---|---|---|---|
| 2,351,887 A | | 6/1944 | Steadman | |
| 2,383,275 A | | 8/1945 | Scane | |
| 2,545,177 A | * | 3/1951 | True | E21B 19/10 188/67 |
| 3,149,391 A | * | 9/1964 | Boster | E21B 19/07 188/67 |
| 3,882,377 A | | 5/1975 | Kelly | |
| 4,203,182 A | | 5/1980 | Boyadjieff et al. | |
| 4,306,339 A | | 12/1981 | Ward | |

(Continued)

*Primary Examiner* — Taras P Bemko

(57) ABSTRACT

Systems, apparatus and methods are usable for automatically engaging and setting slips of an automatic slip setting apparatus about a tubular, when the automatic slip setting apparatus is properly positioned relative to a desired section of the tubular for gripping, lifting and/or holding, and installing and/or removing the tubular, in or out from a wellbore, while preventing slippage and/or dropping of the tubular. The automatic slip setting apparatus is usable with an elevator or spider assembly, each comprising a main body having a central opening extending therethrough, a plurality of slips, and a yoke. An arm assembly, connected to the elevator or spider assembly, moves when contacted by a tubular moving through the central opening, and a latching member, which is connected to the yoke, can be moved by the arm assembly, thereby causing the plurality of slips to move to a closed position for gripping the tubular.

19 Claims, 29 Drawing Sheets

(56) References Cited

U.S. PATENT DOCUMENTS

| | | | |
|---|---|---|---|
| 4,389,760 | A | 6/1983 | Krasnov |
| 4,450,606 | A | 5/1984 | Broussard |
| 4,511,168 | A | 4/1985 | Haynes |
| 4,579,379 | A | 4/1986 | Berg |
| 4,591,007 | A | 5/1986 | Shaginian |
| 5,347,859 | A | 9/1994 | Henneuse et al. |
| 5,791,410 | A | 8/1998 | Castille et al. |
| 5,848,647 | A | 12/1998 | Webre et al. |
| 5,909,768 | A | 6/1999 | Castille et al. |
| 6,142,040 | A | 11/2000 | Bouligny |
| 6,386,283 | B1 | 5/2002 | Mosing et al. |
| 6,626,238 | B2 | 9/2003 | Hooper |
| 6,814,149 | B2 | 11/2004 | Liess et al. |
| 6,892,835 | B2 | 5/2005 | Shahin et al. |
| 7,086,461 | B2 | 8/2006 | Schulze-Beckinghausen et al. |
| 7,182,133 | B2 | 2/2007 | Webre et al. |
| 7,281,587 | B2 | 10/2007 | Haugen |
| 7,448,456 | B2 | 11/2008 | Shahin et al. |
| 7,775,270 | B1 | 8/2010 | Sipos |
| 8,136,603 | B2 | 3/2012 | Schneider |
| 8,485,067 | B2 | 7/2013 | Pietras et al. |
| 2003/0145984 | A1 | 8/2003 | Webre et al. |
| 2004/0159425 | A1 | 8/2004 | Webre et al. |
| 2004/0188098 | A1 | 9/2004 | Schulze-Beckinghausen et al. |
| 2008/0307930 | A1 | 12/2008 | Veverica et al. |
| 2009/0056930 | A1* | 3/2009 | Angelle ..... E21B 19/07 166/77.51 |
| 2014/0041854 | A1 | 2/2014 | Robichaux et al. |

* cited by examiner

APPARATUS AND METHODS FOR SETTING SLIPS ON A TUBULAR MEMBER

CROSS REFERENCE TO RELATED APPLICATIONS

The present application is a non-provisional patent application that claims priority to U.S. provisional application having the U.S. Patent Application Ser. No. 61/961,558, filed Oct. 18, 2013, U.S. provisional application having U.S. Patent Application Ser. No. 61/942,971, filed Feb. 21, 2014, and U.S. provisional application having U.S. patent application Ser. No. 62/001,500, filed May 21, 2014, all of which are incorporated herein in their entireties by reference.

FIELD

Embodiments usable within the scope of the present disclosure relate, generally, to systems, apparatus and methods usable for setting slips about a tubular or joint of tubulars (e.g., casing, drill pipe). More particularly, the systems, apparatus and methods are usable for automatically engaging the slips of an elevator and/or a spider about a section of a tubular to be installed in, or removed from, a wellbore, when the elevator and/or spider is properly positioned relative to a desired section of the tubular. Furthermore, the present disclosure relates to safety clamp apparatus usable to force a plurality of slips of a spider against a tubular, and to an apparatus that can used with an elevator to provide a signal to indicate when the elevator slips are positioned and locked at a desired section located along a length a tubular, for gripping, lifting and installing or removing the tubular(s) into or from a wellbore.

BACKGROUND

Standard rotary drilling rigs typically comprise a supportive rig floor, a derrick extending vertically above the rig floor, and a traveling block that can be raised and lowered within the derrick. During drilling operations, such rig equipment is often used to insert, and/or remove, pipe from a well that is situated under the derrick. For example, drill bits and/or other equipment are often lowered into a well and manipulated within such a well via a drill string. Furthermore, once a well has been drilled to a desired depth, large diameter tubulars or pipe (e.g., casing) can be installed in the wellbore and cemented in place in order to provide structural integrity to the well, isolate downhole formations from one another and prevent contamination of the well.

When installing a pipe string (e.g., casing, drill pipe, or other tubulars) into a well, the length of a pipe or tubular is typically installed individually, for example, in a section of pipe. Each pipe section can be threadably joined to another pipe section, by the use of couplings or other connectors, to form a continuous pipe string. In order to start the process of inserting joints of pipe into a well for forming a pipe string, a first joint of pipe is lowered into the wellbore and suspended in place using a set of lower slips. The slips can comprise wedge-shaped members for grasping and positioning the pipe. The lower slips can be positioned adjacent to the rig floor, for example, within a spider or a bowl-shaped housing of a rotary table. The lower slips can be operated through automation or can be inserted and removed manually by an operator. It should be understood that the individual joint of pipe can include a drill pipe, a casing section, or other tubular member usable in downhole operations. As the individual joints of pipe are connected to form a string of pipe, the lower slips can be used to hold the weight of the entire pipe string and can be used to suspend the entire pipe string in the wellbore.

During the process of installing joints of pipe into a wellbore, an individual joint of pipe can be inserted into the wellbore and positioned so that the top of the joint of pipe is located above the rig floor. A pipe handling machine can be used to grab another joint of pipe, lift that joint of pipe vertically, and position and align that joint of pipe above the joint of pipe that was previously run into the wellbore, for forming the pipe string.

The two joints of pipe can be joined together by threadably engaging the lower end of the upper joint of pipe with a coupling or connector, which is threadably attached to the upper end of the lower joint of pipe (i.e., stabbing process). Thereafter, the upper joint of pipe can be rotated, for mating the threaded connection between the upper joint of pipe and the coupling or connector that is attached to the lower joint of pipe, to form the pipe string.

Thereafter, an elevator, comprising a central cavity and a set of upper slips, can be positioned and lowered over the upper joint of pipe. The central cavity can be aligned with the top section of the upper joint of pipe, and the upper slips can be used to grip the outer surface of the upper joint of pipe. Depending on the length of the joint of pipe, the elevator can grip the joint of pipe at a position of approximately forty feet or more above the rig floor.

Once the elevator slips are engaged around the outer surface of the joint of pipe, the elevator can be raised, using, for example, a traveling block on a rig, for lifting the pipe string and eliminating the weight that was on the lower slips. Then, the elevator can be used to lower the pipe string to a desired distance within the wellbore, and the lower slips can be positioned, again, for gripping the lowered pipe string. The process can be repeated until the desired length of pipe is inserted into the wellbore.

At certain points during this process, the entire weight of the pipe string is being held or suspended by the elevator and, more specifically, by the elevator slips. The pipe string can be extremely heavy, especially when a large number of joints of pipe (tubular members), having a large diameter and/or thick-walls, are being run into the wellbore. Accordingly, it is important that the elevator slips are properly positioned along the length of each joint of pipe, and are set properly around the outer surface of each joint of pipe, to ensure that the joint of pipe is secured within, and gripped by, the elevator to avoid damage to the rig and/or injury to the operators. For example, if the joint of pipe is not properly secured within the elevator, the joint of pipe, or the entire pipe string, could be dropped by the elevator, thereby causing severe damage to the rig or wellbore and/or causing injury to the rig personnel.

In many cases, an end of a joint of pipe can comprise a drill collar, which can include a female or box-end threaded connector or coupling for joining to another joint of pipe. The coupling or connector can have a larger outer diameter than the remainder of the joint of pipe. In order to properly engage the upper or second joint of pipe with the lower or first joint of pipe, the elevator slips should be engaged against the outer surface of the upper joint of pipe, below the thickened portion where the coupling or connector is positioned. If the elevator slips, or any portion(s) thereof, are closed against the coupling or connector, or any other protrusion or thicker portion (i.e., drill collar) of the joint of pipe, the elevator slips may not fully contact and/or properly engage the outer surface of the joint of pipe. As a result, the elevator slips may not properly engage against the joint of pipe, and may not grip the pipe securely, such that the weight of the joint of pipe, or the entire pipe string, is not supported and is subsequently dropped. Accordingly, it is imperative that the elevator slips are properly positioned for securing each joint of pipe and/or pipe string to avoid any of the risks associated with dropped pipe and/or pipe strings, including damage to the rig and/or wellbore and/or injury to the rig personnel.

One method of installing pipe into a wellbore involves a "derrick man" or operator, who is stationed on a platform within the derrick, at approximately the height where the elevator slips are closed about the outer surface of a joint of pipe, which can often be approximately forty feet or more above the rig floor. The derrick man visually observes when the elevator has been properly positioned over the top of the joint of pipe and lowered, relative to the outer surface of the joint of pipe, for gripping a section of the joint of pipe. The "driller," who is located on the drill floor, controls the vertical positioning of the traveling block, and the elevator attached thereto. Once the derrick man observes that the elevator has been properly positioned, relative to the section of the joint of pipe for proper gripping, the derrick man then communicates this information to the driller. With the elevator is positioned and lowered over the top of the joint of pipe, the elevator slips are closed around a section of the joint of pipe for gripping the individual pipe. Thereafter, the driller can pick up the elevator, thereby lifting the entire pipe string. In other cases, the positioning of the elevator, relative to the joint of pipe, can be determined by using video cameras mounted in the derrick, wherein the video cameras can provide a video image of the elevators to the driller or other rig personnel.

As described above, it can be difficult for the driller or other rig personnel to determine whether an elevator is properly positioned relative to the top of a joint of pipe suspended within the derrick, which can lead to risks associated with damage to the rig or wellbore and/or injury to rig personnel. Further, it is often difficult for a derrick man to judge when an elevator is properly positioned relative to a joint of pipe, suspended within the derrick, even though the derrick man may be positioned on an elevated platform in the derrick, which can also lead to risks associated with damage to the rig or wellbore and/or injury to rig personnel. Furthermore, there can be additional risks associated with human error and/or miscommunication between the derrick man and the driller, especially when shouts or hand signals are required for communicating.

Accordingly, there is a need for apparatus and methods usable for accurately determining when elevators and/or spiders, and more particularly the slips of elevators and/or spiders, are positioned in a desired location, along a joint of pipe. These apparatus and methods are needed for properly gripping and lifting and/or holding the joint of pipe to avoid damage to the rig and/or wellbore and/or injury to rig personnel.

In addition, there is a need for apparatus and methods usable for automatically setting and closing the slips about a desired section of a joint of pipe for proper positioning and full engagement of the slips along the desired section of the joint of pipe.

Further, there is a need for an apparatus that is usable to forceably secure a plurality of slips of a spider against a tubular, for proper positioning and full engagement of the slips along the desired section of the joint of pipe.

Furthermore, there is a need for apparatus and methods, which can be usable for signaling a driller and/or other rig personnel when such elevator slips are securely positioned along, and relative to, the desired section of the joint of pipe for properly engaging, gripping and lifting the joint of pipe. Such apparatus and methods can include indicating when the elevator slips have passed over an external coupling or other thicker/irregular portion of a joint of pipe (e.g., drill collar), such that the elevator slips are now located at the desired section of the joint of pipe joint for proper engagement, gripping and lifting of the joint of pipe.

SUMMARY

The embodiments of the present disclosure generally relate to systems, apparatus and methods usable for setting slips on or about a joint of pipe (e.g., casing, drill pipe) or a section of a tubular. More particularly, embodiments usable within the scope of the present disclosure include systems, apparatus and methods for automatically engaging the slips of a movable elevator and/or a spider about a section of a tubular to be installed in, or removed from, a wellbore, and determining when the movable elevator or spider is properly positioned relative to a desired section of the tubular. In addition, the embodiments of the present disclosure relate to safety clamp apparatus, including safety screw clamp apparatus, hydraulic safety clamp apparatus, and other safety clamp apparatus, which are usable to force a plurality of slips of a spider against a tubular. Further, the embodiments of the present disclosure relate to an apparatus that can used with an elevator to provide a signal to indicate when the elevator slips are positioned and locked at a desired section, along a length a tubular, for gripping, lifting and installing or removing the tubular(s) into or from a wellbore.

In an embodiment of the present disclosure, a system usable for setting a plurality of slips on or about a tubular (e.g., casing, drill pipe) can comprise a spider assembly comprising a first plurality of slips for gripping the tubular member, an elevator assembly comprising a second plurality of slips for raising or lowering the tubular member out of or into the spider assembly, and a lever arm assembly pivotally connected to the spider assembly. The spider assembly can further comprise a spider body, having an opening extending therethrough, and a yoke that can include an inner portion connected with the first plurality of slips and an outer portion extending out of the spider body. The yoke can be movable between an open slip position and a closed slip position. Extending above the spider assembly can be the lever arm assembly, which can be movable from a raised position to a lowered position when contacted from above by the elevator assembly. The lever arm assembly can be used to actuate the yoke into the closed slip position, thereby causing the first plurality of slips to close about the tubular member.

In an embodiment, the elevator assembly can comprise an elevator body that includes an opening extending therethrough and a locking mechanism for maintaining the second set of slips in an open or closed position.

In an embodiment, the spider assembly can comprise a vertical guide plate that can be attached to the spider body and can include at least one sloped surface. The vertical guide plate can be used to align the opening of the spider body with the opening of the elevator body. In an embodiment, the elevator assembly can further comprise a bell guide apparatus that can be connected to the elevator body and can engage the vertical guide plate during the lowering of the tubular member.

In an embodiment, the spider assembly can include a horizontal guide plate, which can be positioned over the opening of the spider body, and the horizontal guide plate can comprise a bore for receiving a tubular therethrough.

In an embodiment of the present invention, the slip setting system for closing a plurality of slips of an elevator assembly about a tubular member can include the elevator assembly for gripping and lifting tubular members, wherein the elevator assembly can comprise an elevator body having an opening extending therethrough, a plurality of slips, and a locking mechanism for maintaining the plurality of slips in an open position or a closed position. The slip setting system can further comprise an arm assembly, which can be pivotally connected to the elevator assembly and can include an upper portion and a lower portion. The upper portion can be movable between a raised position and a lowered position, and the upper portion can pivot and move from the lowered position to the raised position when contacted by a tubular member moving through the opening of the spider assembly. In the lowered position, the upper portion can extend over (i.e., above) at least a portion of the opening of the spider assembly. The lower portion can be usable for actuating the locking mechanism, thereby causing the plurality of slips to close about the tubular member, when the upper portion moves from the lowered position to the raised position.

In an embodiment, the upper portion can comprise an upper arm that can be pivotally connected to the elevator assembly, and the lower portion can comprise a lower arm that can be pivotally connected to the upper arm, for example, at an intermediate point along the upper arm. The upper arm can move the lower arm in an upward direction as the upper arm moves from the lowered position to the raised position.

In an embodiment, the lower portion of the arm assembly can lift a lever arm of the locking mechanism, causing the plurality of slips to close about the tubular member when the upper portion moves from the lowered position to the raised position. A bracket assembly can be connected to the elevator body, adjacent to the opening, for maintaining the arm assembly pivotally connected to the elevator body. After the plurality of slips of the elevator assembly close about the tubular member, the lower portion can disengage from the locking mechanism.

Embodiments of the present invention can include methods for setting a plurality of slips in an elevator assembly, wherein the steps of the methods can comprise lowering the elevator assembly over a joint of pipe, wherein the elevator assembly can comprise a slip locking mechanism, for maintaining the plurality of slips in an open position or a closed position, and an arm assembly that can be connected to the elevator assembly. The arm assembly can include an upper arm and a lower arm and can extend over at least a portion of a central opening of the elevator assembly. The steps of the method can continue by moving the arm assembly with the joint of pipe, and then actuating the slip locking mechanism to unlock the plurality of slips, thereby causing the plurality of slips to move to a closed position about the joint of pipe.

In another embodiment of the present invention, a method for setting a plurality of slips in a spider assembly can comprise the steps of: lowering an object toward a spider assembly, wherein the object can comprise an elevator assembly, a pipe handling device, a bell guide, any other object connected with the pipe handling device, or combinations thereof. The spider assembly can include a locking mechanism for maintaining the plurality of slips in an open position or a closed position, and an arm assembly can be connected to the spider assembly. The arm assembly can include an upper portion and a lower portion, with the upper portion extending above the spider assembly. The steps of the method can continue by contacting the upper portion of the arm assembly with the object to move the upper portion of the arm assembly downward. The method can further include actuating the locking mechanism with a lower portion of the arm assembly to unlock the plurality of slips, thereby causing the plurality of slips to move to a closed position about a joint of pipe.

In an embodiment of the method, the step of contacting the upper portion of the arm assembly with the object to move the upper portion of the arm assembly downward can further cause the lower portion of the arm assembly to move upward. In another embodiment of the method, the step of actuating the locking mechanism with the lower portion of the arm assembly to unlock the plurality of slips can include lifting a lever arm of the locking mechanism with the lower portion of the arm assembly to unlock the plurality of slips, thereby causing the plurality of slips to move to the closed position about the joint of pipe. After the slips close about the joint of pipe, the lower portion of the arm assembly can be disengaged form the locking mechanism.

Another embodiment of the present invention includes a system for forcing a plurality of slips of a spider assembly against a tubular member, which includes a spider assembly comprising a spider body and a plurality of slips for gripping the tubular member and a lifting apparatus connected to the spider body. The spider assembly can further include a yoke that can comprise an inner portion connected with the plurality of slips and an outer portion extending from the spider body. The yoke can be pivotally connected with the spider body, and the yoke can be movable between an open slip position and a closed slip position. The lifting apparatus can connect to the spider body, adjacent to the outer portion of the yoke, and the lifting apparatus can include a housing, a jack screw positioned within the housing, a threaded nut movable along the jack screw, and a lever arm movable with the threaded nut. The lever can be usable to force the outer portion of the yoke in an upward direction, for forcing the plurality of slips against the tubular member extending through the opening of the spider body.

In an embodiment of the system, the jack screw can include a first pivot pin for connecting the jack screw to the housing. The system can further comprise a lever arm that can be pivotally connected with the housing at a pivot point, wherein the lever arm can include a first portion extending on a first side of the pivot point, and a second portion extending on a second side of the pivot point opposite of the first side. In an embodiment, the threaded nut can move the first portion of the lever arm in a downward direction, and the second portion of the lever arm can be positioned under the yoke, wherein the second portion of the lever arm can force the outer portion of the yoke in an upward direction. In another embodiment of the system, the jack screw can be rotatable and can be connected to the first portion of the lever arm. In this embodiment, rotation of the jack screw can move the first portion of the lever arm in a downward direction and the second portion of the lever arm in an upward direction.

Another embodiment of the present invention includes a slip setting system for closing the slips of a spider assembly about a tubular member, which includes a spider assembly comprising a spider body having an opening extending therethrough and a plurality of slips for gripping and/or holding the tubular member. The spider assembly can further include a locking mechanism for maintaining the plurality of slips in an open position or a closed position. The slip setting apparatus can further include an arm assembly that can pivotally connect to the spider assembly. The arm assembly can include an upper portion and a lower portion. The upper portion can be movable between a raised position and a lowered position, such that the upper portion moves from the raised position to the lowered position when contacted by an object moving toward the spider assembly. The lower portion can actuate the locking mechanism, thereby causing the plurality of slips to close about the tubular member, when the upper portion moves from the raised position to the lowered position.

In an embodiment of the slip setting system, the spider assembly can further comprise a guard disposed above the plurality of slips, and a hydraulic safety clamp (i.e., hydraulic clamp, hydraulic cylinder safety clamp) positionable between the guard and at least one of the plurality of slips. The hydraulic safety clamp can extend against the guard and the at least one of the plurality of slips, while the plurality of slips are in the closed position. In an embodiment, the slip setting system can further comprise a foot pump in communication with the hydraulic safety clamp, wherein the foot pump can convert pneumatic energy to hydraulic energy to control the extension of the hydraulic safety clamp. In an embodiment, an interlock valve can connect the foot pump and the hydraulic safety clamp, and the interlock valve can prevent communication from the foot pump to the hydraulic clamp unless the hydraulic clamp is positioned between the guard and the at least one of the plurality of slips.

BRIEF DESCRIPTION OF THE DRAWINGS

In the detailed description of the various embodiments usable within the scope of the present disclosure, as presented below, reference is made to the accompanying drawings, in which.

DETAILED DESCRIPTION OF THE EMBODIMENTS

Figure 1:
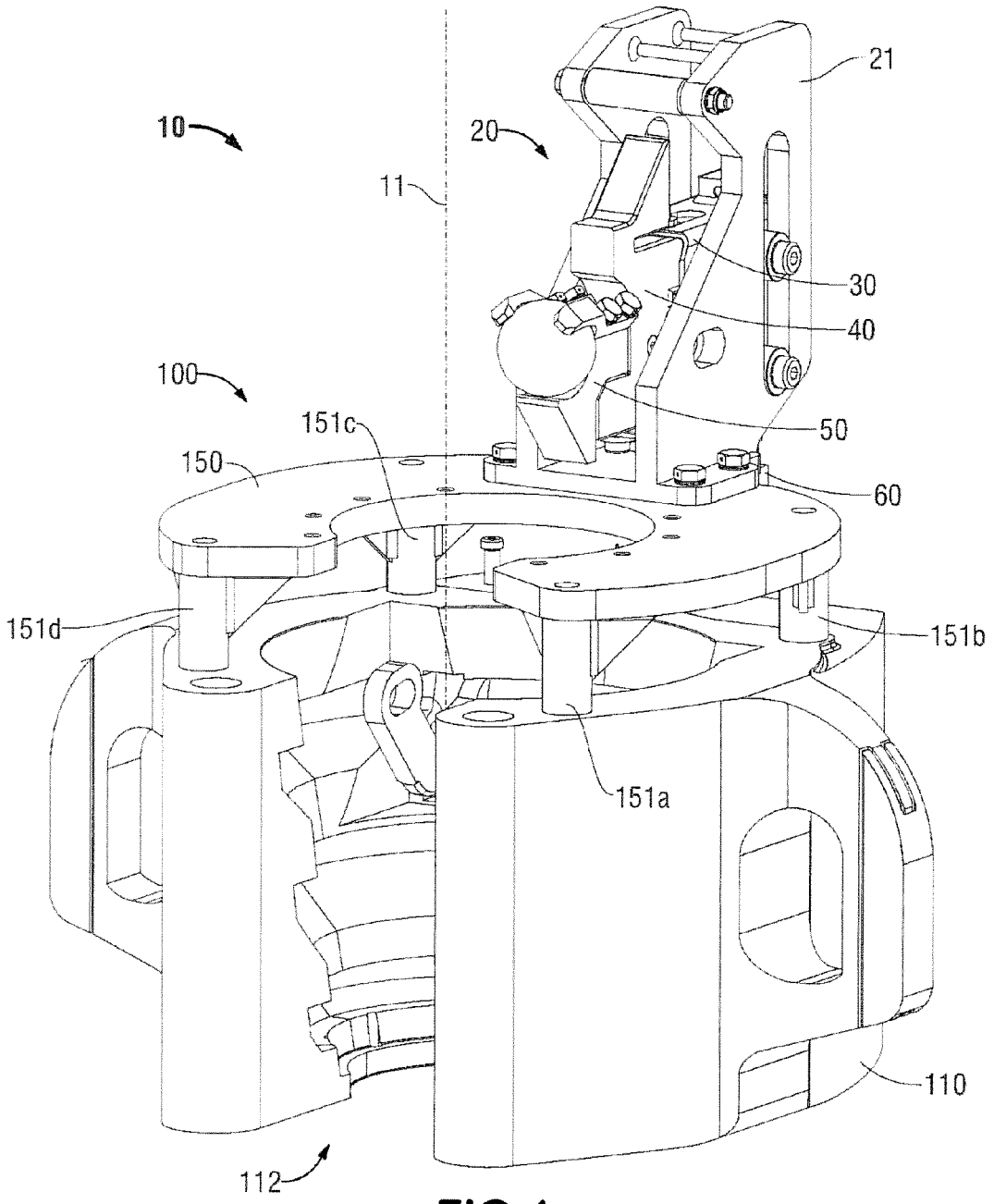
FIG. 1 depicts an isometric front view of an embodiment of a slip setting apparatus usable within the scope of the present disclosure, which includes an embodiment of the slip setting apparatus without the slips, for clarity purposes.

Before describing selected embodiments of the present invention in detail, it is to be understood that the present invention is not limited to the particular embodiments described herein. The disclosure and description of the invention is illustrative and explanatory of one or more presently preferred embodiments of the invention and variations thereof, and it will be appreciated by those skilled in the art that various changes in the design, organization, order of operation, means of operation, equipment structures and location, methodology, and use of mechanical equivalents, as well as in the details of the illustrated construction or combinations of features of the various elements, may be made without departing from the spirit of the invention.

As well, the drawings are intended to describe the concepts of the invention so that the presently preferred embodiments of the invention will be plainly disclosed to one of skill in the art, but are not intended to be manufacturing level drawings or renditions of final products and may include simplified conceptual views as desired for easier and quicker understanding or explanation of the invention. As well, the relative size and arrangement of the components may differ from that shown and still operate within the spirit of the invention as described throughout the present application.

Moreover, it will be understood that various directions such as "upper", "lower", "bottom", "top", "left", "right", "inward", "outward" and so forth are made only with respect to explanation in conjunction with the drawings, and that the components may be oriented differently, for instance, during transportation and manufacturing as well as operation. The terms "inward" or "inwardly" indicate direction towards or a relative position located closer to the central axis (11) of the central cavity (111) extending through the main body (110), while the term "outward" or "outwardly" indicate a direction away from or a relative position located farther away from the central axis (11) of the central cavity (111) extending through the main body (110). Because many varying and different embodiments may be made within the scope of the inventive concept(s) herein taught, and because many modifications may be made in the embodiments described herein, it is to be understood that the details herein are to be interpreted as illustrative and non-limiting.

Generally, the present disclosure relates to systems, apparatus and methods usable for setting slips on or about a joint of pipe (e.g., casing, drill pipe), or a section of another tubular. More particularly, embodiments usable within the scope of the present disclosure include systems, apparatus and methods for automatically engaging the slips, of a movable elevator and/or a spider, about a section of a tubular to be installed in, or removed from, a wellbore, when the movable elevator or spider is properly positioned relative to a desired section of the tubular. Furthermore, the embodiments of the present disclosure relate to a screw clamp apparatus usable to force a plurality of slips of a spider against a tubular, and to an apparatus that can be used with an elevator assembly to provide a signal to indicate when the slips of the elevator are positioned and locked at a desired section located along a length of a tubular, for gripping, lifting and installing or removing the tubular(s) into or from a wellbore.

In an embodiment, the apparatus and methods of use enable an elevator with an automatic slip setting apparatus, and more particularly the slips of the elevator, to be positioned in a desired location along a joint of pipe, for properly engaging, gripping and lifting the joint of pipe. These apparatus and methods can prevent damage to the rig and/or wellbore and/or injury to rig personnel. In this embodiment, the slip setting apparatus can automatically engage and close the elevator slips about a desired section of an outer surface of a joint of pipe, when the elevator has been positioned and lowered over the joint of pipe, and the upper end of the joint of pipe has reached a predetermined height relative to the elevator. In addition, the slip setting apparatus can lock the elevator slips in the engaged position to prevent slippage or dropping of the joint of pipe. Further, the slip setting apparatus can enable the elevator slips to be manually reset to an open slip position, as needed.

The automatic slip setting apparatus and methods of use can include signaling a driller and/or other rig personnel when the slips (e.g., movable elevator slips, spider slips) are securely positioned along, and relative to, the desired section of the joint of pipe for properly engaging, gripping, lifting and/or holding the joint of pipe. Furthermore, embodiments of the slip setting apparatus and methods of use can include an automatic setting and closing of the slips (e.g., elevator slips or spider slips), about the desired section of a joint of pipe, for proper positioning and full engagement of the slips. This can prevent the dangerous risks associated with improper engagement of, and gripping by, the slips (e.g., the slippage or dropping of a joint of pipe, or the entire pipe string, thereby causing damage to the rig and/or wellbore and/or injury to rig personnel).

Figure 2:
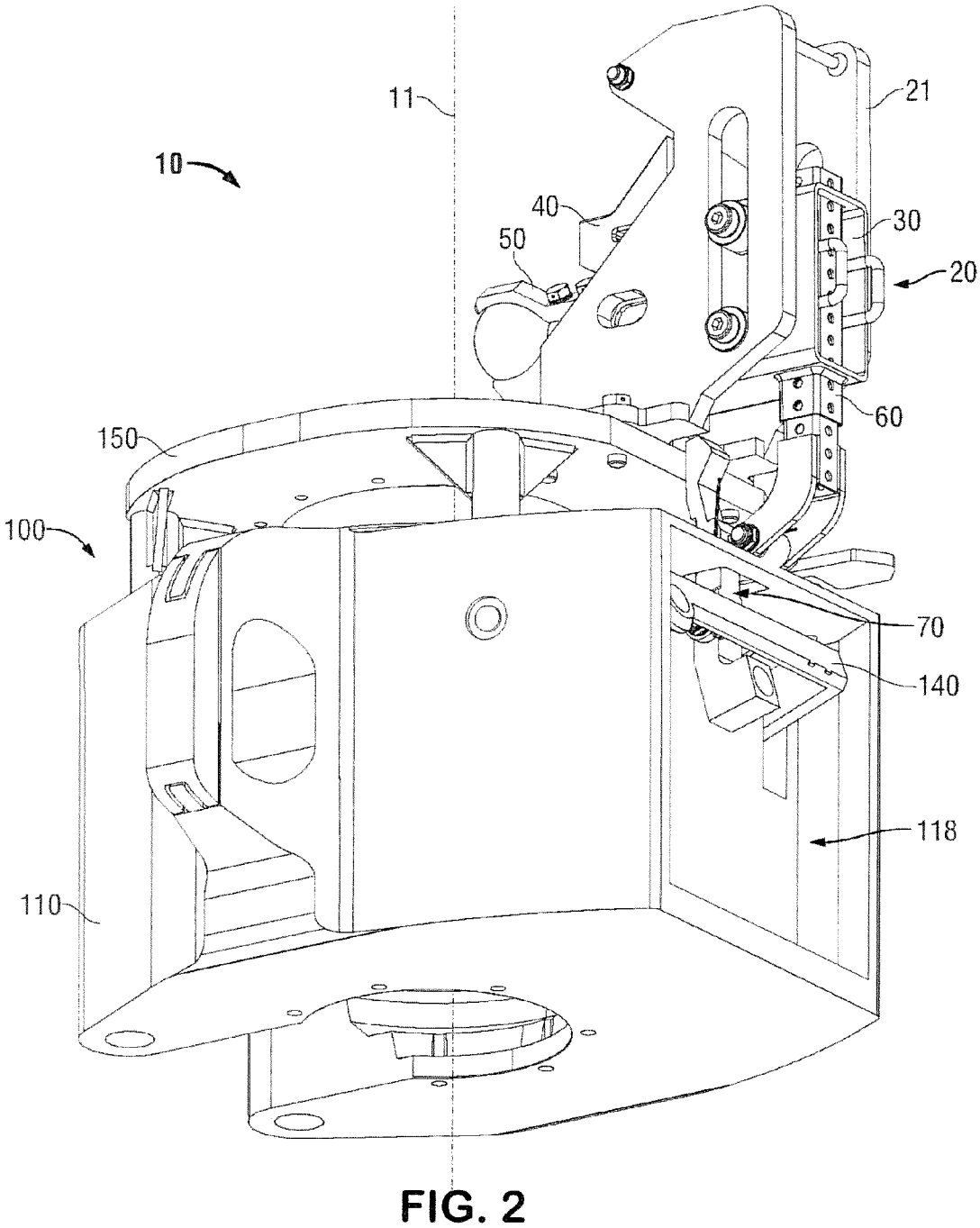
FIG. 2 depicts an isometric back view of an embodiment of the slip setting apparatus usable within the scope of the present disclosure, which includes an embodiment of the slip setting apparatus without the slips, for clarity purposes.

Referring now to FIGS. 1 and 2, the Figures depict an isometric front view and an isometric back view, respectively, of an embodiment of an automatic slip setting apparatus (10) that can be usable within the scope of the present disclosure. Specifically, the Figures show an embodiment of the automatic slip setting apparatus (10), which comprises an arm assembly (20) that is shown positioned on top of an elevator assembly (100), and the back view of FIG. 2 shows a latching assembly (70) that can be positioned substantially within the rear cavity (118) of the main body (110). The elevator assembly (100) of the automatic slip setting apparatus (10) is further depicted comprising a yoke (140) that can be pivotally attached to the main body (110), and an upper guard (150) that can be threadably engaged to the top of the main body (110) by a plurality of bolts extending through the upper guard posts (151*a*), (151*b*), (151*c*) and (151*d*).

FIGS. 1 and 2 include isometric views of an embodiment of the arm assembly (20) of the automatic slip setting apparatus (10), which comprises a carriage frame (21) that can be bolted to the upper guard (150) of the elevator assembly (100). The carriage frame (21) is shown encompassing a carriage (30), which slides vertically within the carriage frame (21). The carriage (30) can encompass a portion of an extension arm (40), which slides horizontally in and out of the carriage (30) at the first end thereof. The arm assembly (20) is further shown comprising a contact arm (50) extending horizontally from the inward end of the extension arm (40). A trip arm (60) is shown extending from the carriage (30) in a downward direction, adjacent to the second end of the carriage (30).

Figure 3A:
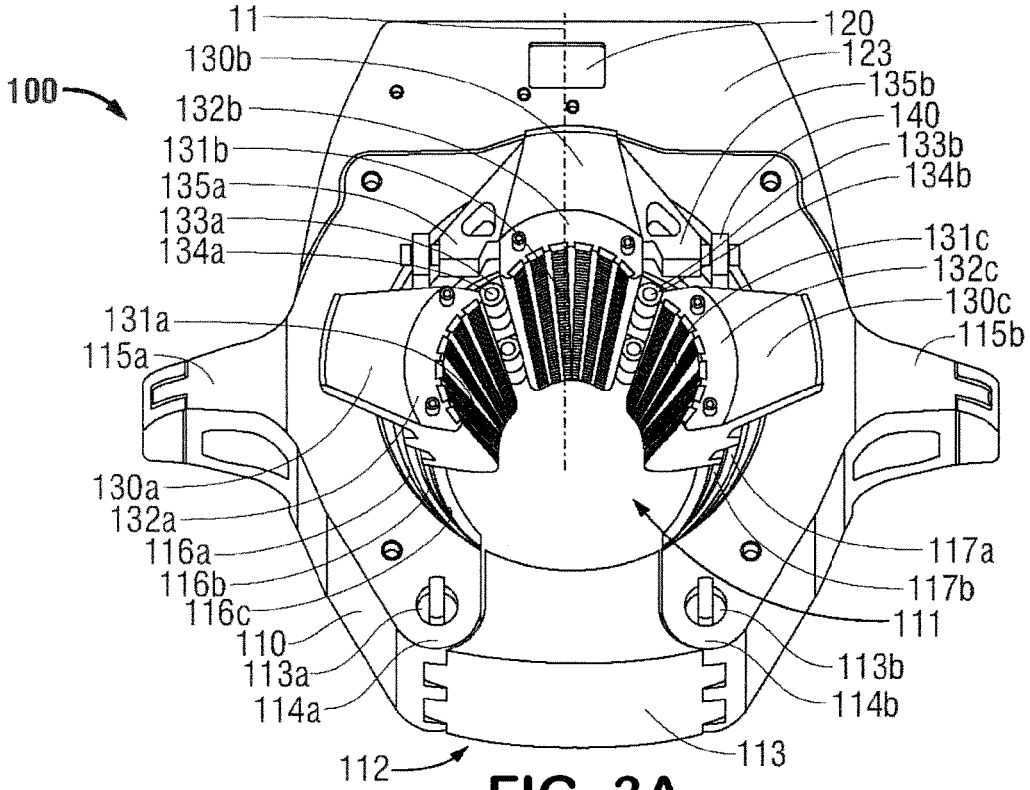
FIG. 3A depicts a top view of a portion of an embodiment of the slip setting apparatus usable within the scope of the present disclosure, which includes an embodiment of the slips in an open position.
Figure 3B:
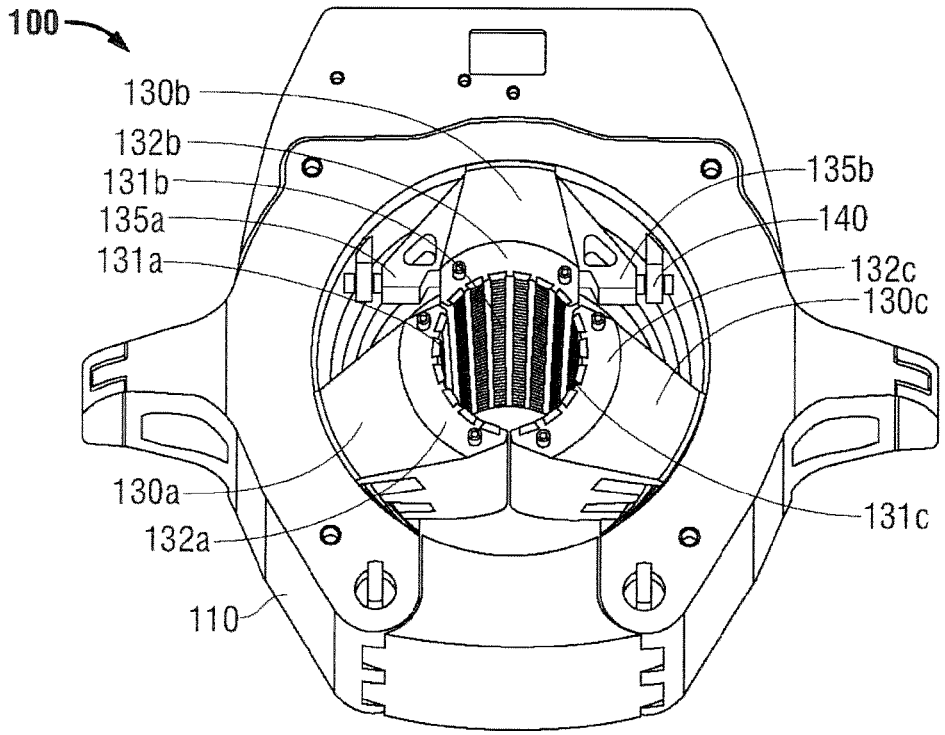
FIG. 3B depicts a top view of a portion of an embodiment of a slip setting apparatus usable within the scope of the present disclosure, which includes an embodiment of the slips in a closed position.
Figure 4:
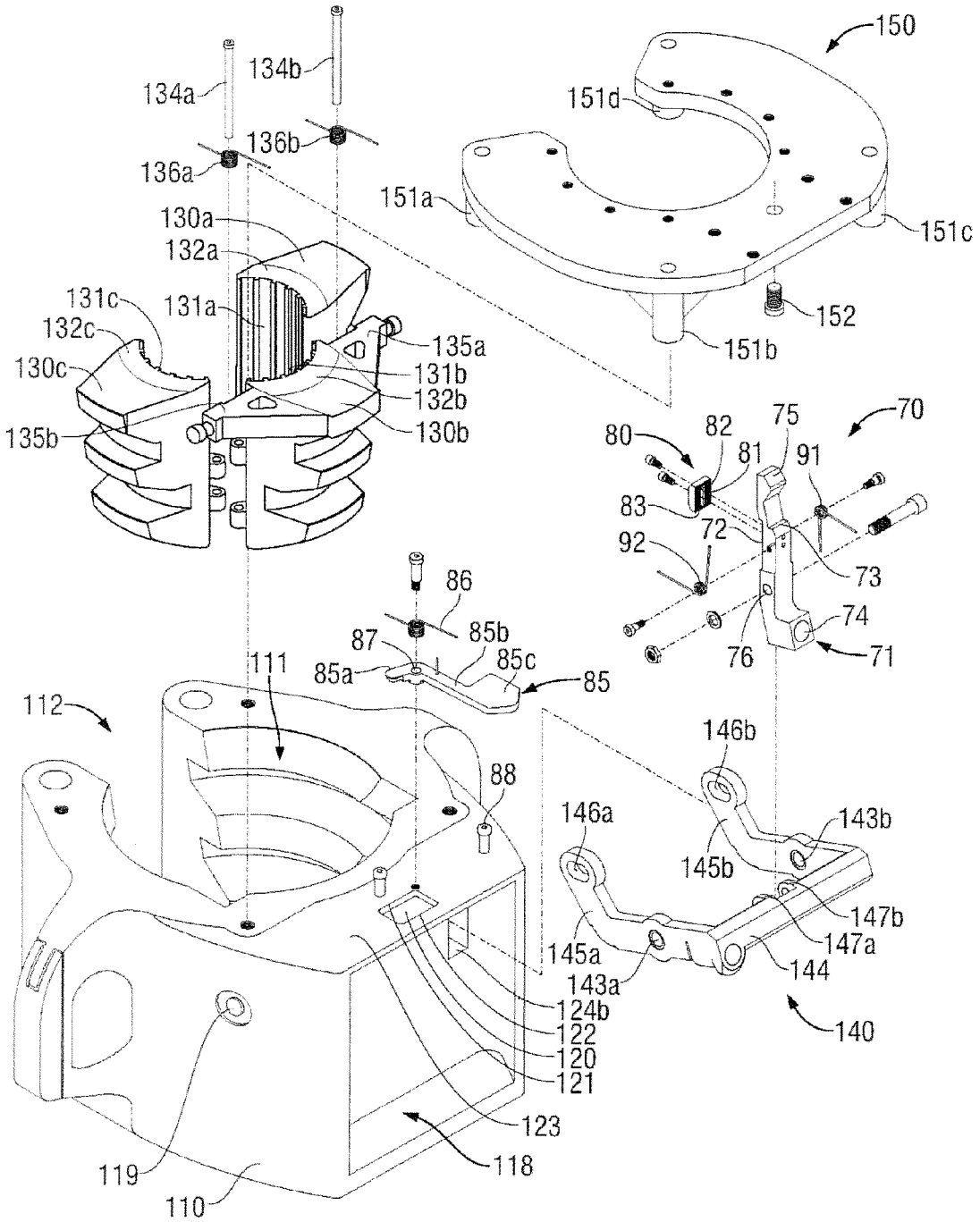
FIG. 4 depicts an exploded view of a portion of an embodiment of the slip setting apparatus usable within the scope of the present disclosure.

Referring now to FIGS. 3A and 3B, the Figures depict a top view of the elevator assembly (100), wherein, for clarity, the Figures omit the upper guard (150), as depicted in FIGS. 1 and 2; however, FIGS. 3A and 3B include elevator slips (130*a-c*), which were omitted for clarity in FIGS. 1 and 2. Specifically, as depicted in FIG. 3A, the elevator assembly can further comprise the main body (110) having a central cavity (111) extending therethrough, along a central axis (11, also shown in FIGS. 1 and 2) thereof, and a split section (112) (e.g., open space also shown in FIG. 1) extending from the central cavity (111), radially, through the body (110). The central cavity (111) can be tapered inwardly from top to bottom, and can include three contact surfaces (116*a-c*) and two indentures (117*a*, 117*b*) (e.g., circular cavities), which can extend into the body (110), between the contact surfaces (116*a-c*). A door (113) can be compatibly sized and configured to fit within the split section (112). The door (113), as shown in FIG. 3A, is pivotally connected to the main body (110) by hinge pins (113*a*, 113*b*), which can pass through each end of the door (113) and through ears (114*a*, 114*b*) of the main body (110) that can be located on each side of the split section (112). The main body (110) is further shown comprising lifting eyes (115*a*, 115*b*) that can be usable for suspension from a traveling block (not shown), and a latch arm hole (120) that can extend through the upper surface (123) thereof. As described in detail below, the latch arm hole (120), shown in FIG. 3A, can be adapted to receive a latch arm (71), as shown in FIG. 4. The elevator assembly (100) can further comprise a guide skirt (not shown), which can be positioned at the bottom side of the main body (110) for guiding the elevator assembly (100) about a joint of pipe (5) (e.g., tubular member), as shown in FIGS. 6A-7B.

FIGS. 3A and 4 show the elevator assembly comprising three elevator slips (130*a-c*) and a yoke (140). In FIG. 3A, the elevator assembly includes the elevator slips (130*a-c*) in an open position. The three elevator slips (130*a-c*), shown disposed at least partially within the central cavity (111), include two side elevator slips (130*a*, 130*c*) and a rear elevator slip (130*b*). Each elevator slip (130*a-c*) can include camming surfaces (137*a-c*), as shown in FIG. 6A, which slide downwardly and inwardly along the contact surfaces (116*a-c*) of the main body (110), as the slips (130*a-c*) move toward the closed position, as depicted in FIG. 3B.

The camming surfaces (137*a-c*) partially nest in the indentures (117*a*, 117*b*) upon an upwardly and radially outward movement of the slips (130*a-c*) toward the open position, which is depicted in FIG. 3A. Each slip (130*a-c*) includes gripping teeth elements (131*a-c*), which can be replaceable and partially supported along the face of each slip (130*a-c*) by a support ring (132*a-c*), which is an end plate that the secures the inserts in the grooves and does not allow them to come out vertically. The support ring can be connected to each slip (130*a-c*) by a plurality of bolts. The teeth elements (131*a-c*) and the slips (130*a-c*) can interconnect through dovetail joints (not shown). The depicted gripping teeth elements (131*a-c*) can have the same configuration, with each gripping teeth element defining an arc of approximately one hundred twenty (120) degrees, as best shown in FIG. 3B.

Referring again to FIG. 3A, the slips (130*a-c*) can include integrally formed slip brackets (133*a*, 133*b*) for pivotally connecting the slips (130*a-c*) to each other. As shown in FIG. 3A, the rear slip (130*b*) can contain two or more slip brackets (133*a*, 133*b*) on each side, while the side slips (130*a*, 130*c*) can contain a number of slip brackets on one side only. The slip brackets (133*a*, 133*b*) are shown pivotally connected to each other by pivot pins (134*a*, 134*b*). As shown in FIGS. 3A and 3B, the rear slip (130*b*) can comprise trunnions (135*a*, 135*b*), extending from the sides thereof, for providing pivotal connection with the lifting yoke (140). As the rear slip (130*b*) is lifted by the yoke (140), the outer slips (130*a*, 130*c*), which are pivotally attached to the rear slip (130*b*), can be lifted in the upward and radially outward direction. The outer slips (130*a*, 130*c*) can be rotatably biased in the outward direction by biasing members, shown in FIG. 4 as torsion springs (136*a*, 136*b*), which can be positioned about pivot pins (134*a*, 134*b*).

Figure 6B:
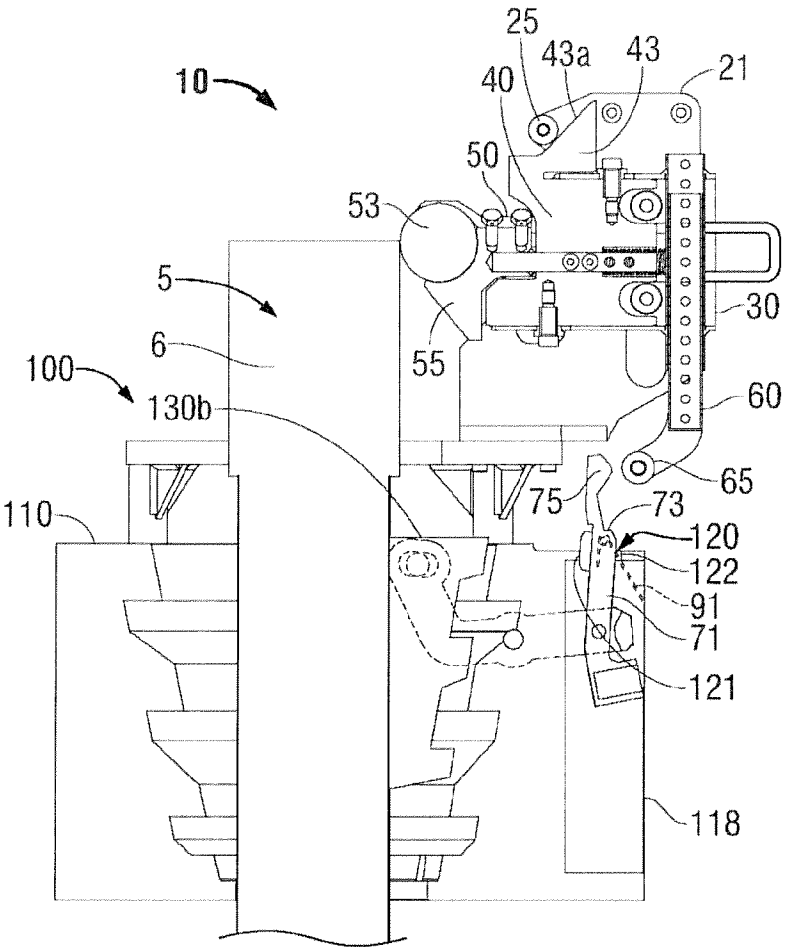
FIG. 6B depicts a cross-sectional side view of an embodiment of the slip setting apparatus usable within the scope of the present disclosure.
Figure 6A:
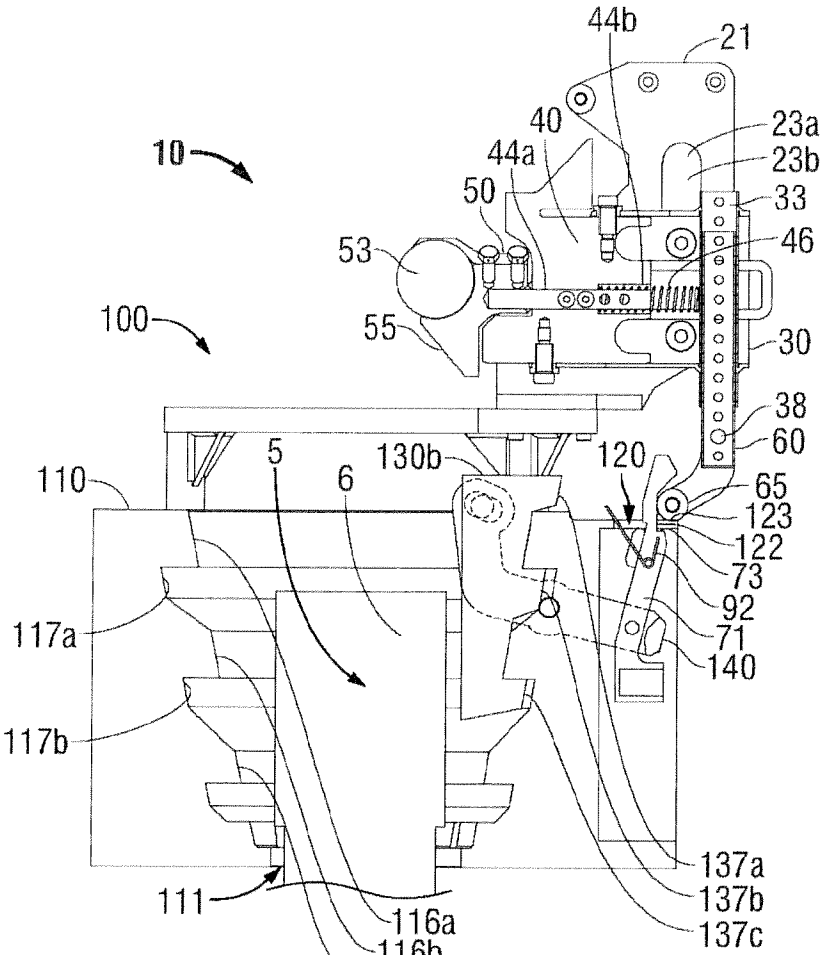
FIG. 6A depicts a cross-sectional side view of an embodiment of the slip setting apparatus usable within the scope of the present disclosure.
Figure 7B:
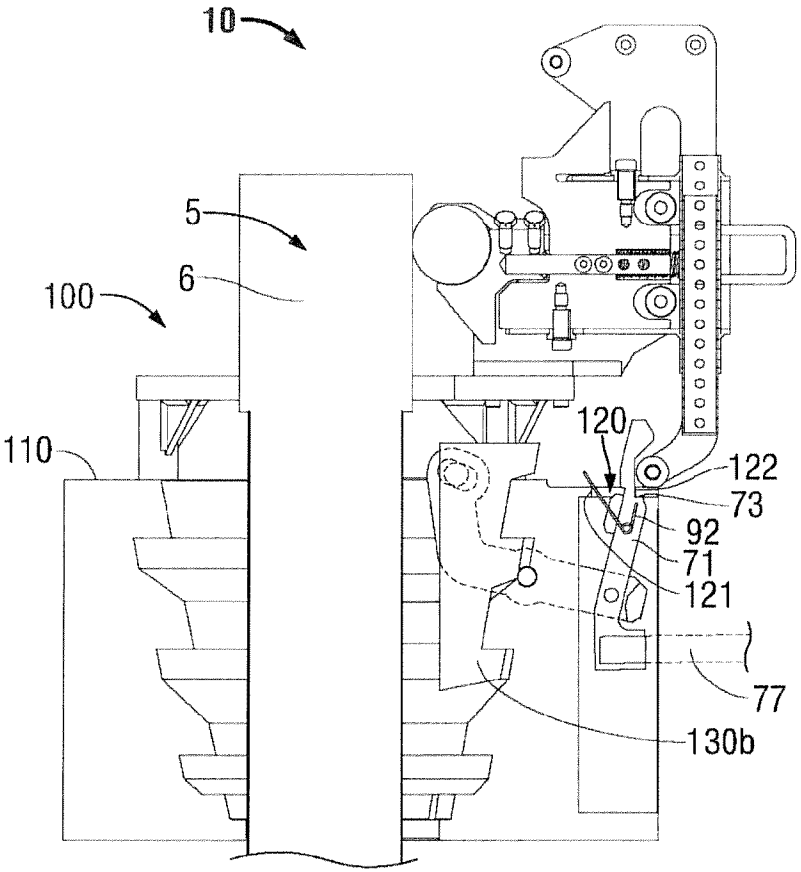
FIG. 7B depicts a cross-sectional side view of an embodiment of the slip setting apparatus usable within the scope of the present disclosure.
Figure 7A:
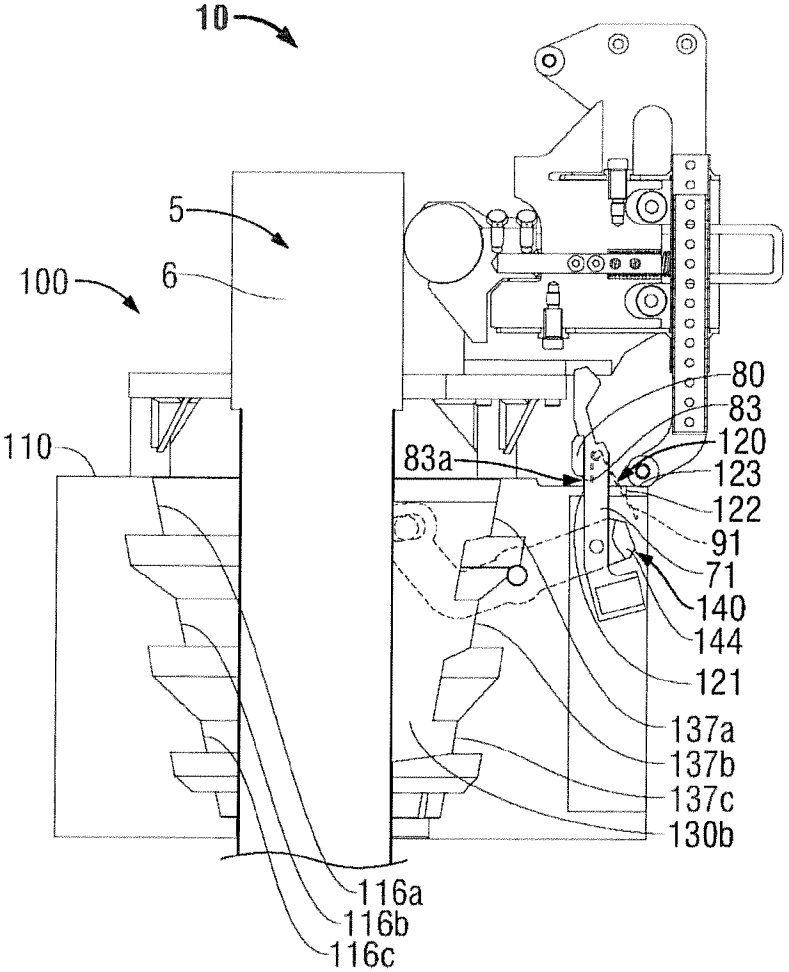
FIG. 7A depicts a cross-sectional side view of an embodiment of the slip setting apparatus usable within the scope of the present disclosure.

FIGS. 6A and 7A provide another view of the main body (110) and the slips (130*a-c*), as the Figures depict a cross-sectional side view of an embodiment of the automatic slip setting apparatus (10). For clarity, the side slips (130*a*, 130*c*) are not shown. FIG. 7A shows the central arm (144) of the yoke (140) in an upward position, and the rear slip (130*b*) in a downward (i.e., closed) position. Camming surfaces (137*a-c*) are positioned against the contact surfaces (116*a-c*), thereby retaining the rear slip (130*b*) against the body of the joint of pipe (5). Upon downward movement of the central arm (144), the rear slip (130*b*), as shown in FIG. 6A, can be moved in an upward and outward (i.e., open) position, whereby the camming surfaces (137*a-c*) can partially nest within the indentures (117*a*, 117*b*), resulting in the rear slip (130*b*) (along with the side slips, which are not shown) being positioned at a distance from the joint of pipe (5).

Figure 5:
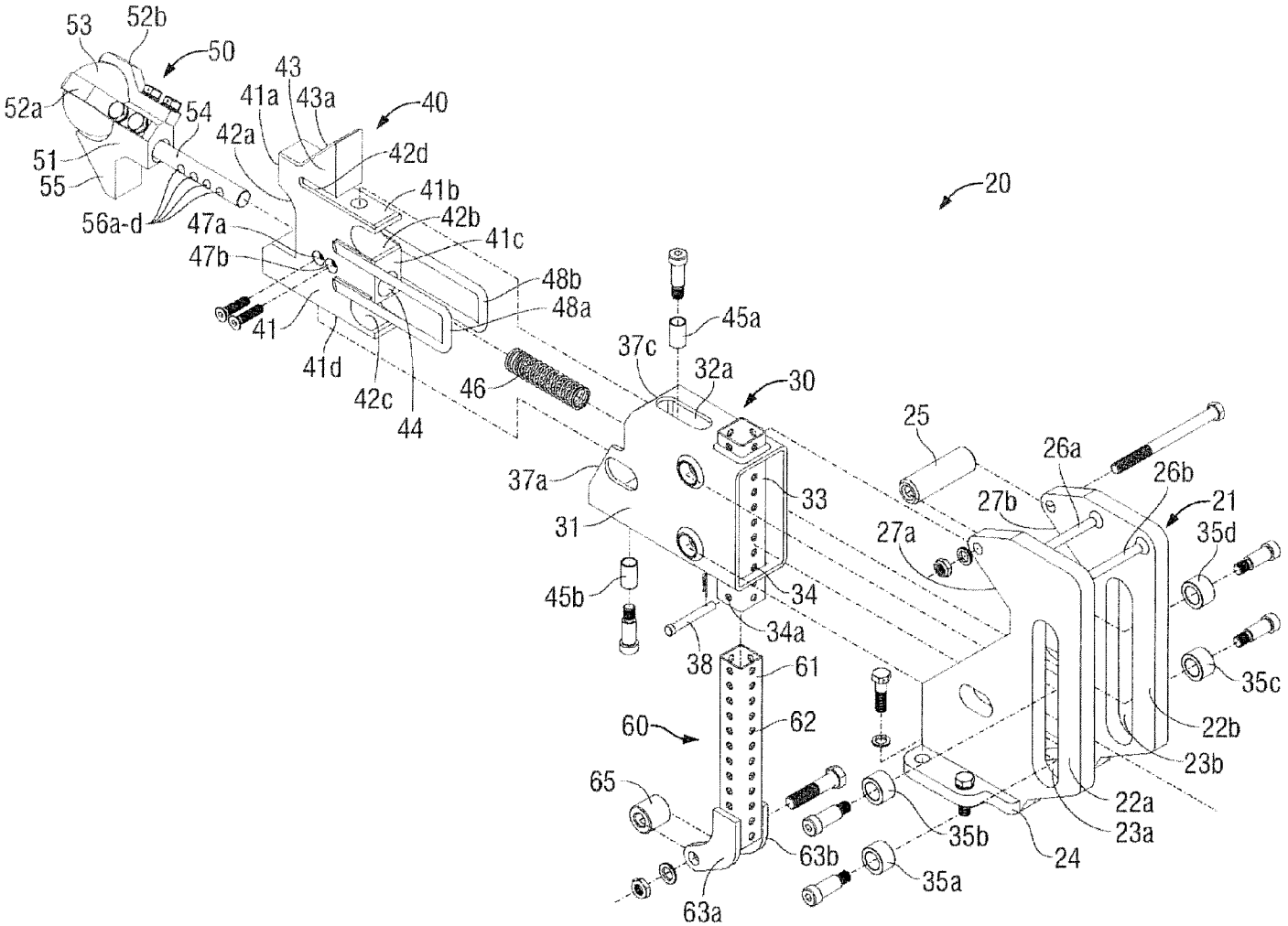
FIG. 5 depicts an exploded view of another portion of the embodiment of a slip setting apparatus usable within the scope of the present disclosure.

Referring now to FIGS. 4 and 5, the Figures collectively show an exploded view of an embodiment of the automatic slip setting apparatus (10), which is usable within the scope of the present disclosure, and provide a clearer view of the structure of each component of the automatic slip setting apparatus (10). Specifically, FIG. 4 shows an embodiment of the elevator assembly (100) and the latching assembly (70), while FIG. 5 shows an embodiment of the arm assembly (20).

Referring to FIG. 4, the elevator assembly (100) is shown comprising a yoke (140), which is depicted as a beam having a generally U-shaped configuration. The yoke (140), as shown in FIG. 4, comprises two swing arms (145*a*, 145*b*) and a central arm (144) that extends between the swing arms (145*a*, 145*b*), connecting a first end of one swing arm (145*a*) to a first end of the other swing arm (145*b*), wherein the two swing aims (145*a*, 145*b*) are shown being upwardly curved near their second or opposite ends from the central arm (144). The yoke (140) is further depicted comprising two pad eyes (147*a*, 147*b*), which are centrally positioned on the inward surface of the central arm (144). The yoke (140) can extend inwardly through two rectangular passageways (124*a*, 124*b*, 124*a* not shown), and the two rectangular passageways can extend through the main body (110), between the central cavity (111) and the rear cavity (118).

The yoke (140) can be pivotally connected to the main body (110) by a pivot pin (119), which can extend through at least two apertures (143*a*, 143*b*) in the swing arms (145*a*, 145*b*) and through the rear wall of the main body (110), between the central cavity (111) and the rear cavity (118). The yoke (140) can be pivotable about the pivot pin (119), such that an upward or downward motion of a central arm (144) can rotate the swing aims (145*a*, 145*b*). The second or inward ends of the swing arms (145*a*, 145*b*) are shown containing oval-shaped camming apertures (146*a*, 146*b*), which receive the trunnions (135*a*, 135*b*, shown in FIGS. 3A and 3B) extending from the rear slip (130*b*, also shown in FIGS. 3A and 3B). The camming apertures (146*a*, 146*b*) enable lifting of the slips (130*a-c*) upon downward movement of the central arm (144) of the yoke (140).

The elevator assembly (100) can comprise an upper guard (150) that can be positioned on top of the main body (110). FIGS. 1 and 4 depict an upper guard (150) that comprises a flat plate extending in an arc above the main body (110), which can terminate generally in the area of the split section (112) of the main body (110). The upper guard (150) can be mounted to the main body (110) by a plurality of bolts, which can extend through the upper guard posts (151*a-d*) and threadably engage the main body (110).

FIG. 4 additionally shows an exploded view of a latching assembly (70) in accordance with the present disclosure. As depicted in FIG. 4, the latching assembly (70) can comprise a latch arm (71), an adjustment block (80), and three biasing members (e.g., torsion springs) (86, 91, 92). In an embodiment, the latch aim (71) can comprise a flag (85). As shown in FIG. 4, the latch arm (71) comprises a generally L-shaped beam, with the long portion having a generally vertical orientation. The upper end of the latch arm (71) can comprise a ramp (75), protruding laterally in the outwardly direction, which can be contacted by the roller (65, shown in FIG. 5), as the trip arm (60, shown in FIG. 5) moves upwardly during pipe installation operations. The latch arm (71) is further depicted in FIG. 4 comprising an upper shoulder (73), having an upward-facing surface extending laterally in the outward direction, which can be adapted to latch the latch arm (71) against the outward edge (122) of a latch arm opening (120). A portion of the inward surface of the latch arm (71) is depicted comprising a plurality of ridges or teeth (72), which can extend the width of the latch arm (71). Although FIG. 4 depicts the upper shoulder (73) as a surface extending laterally in the outward direction, other embodiments of the automatic slip setting apparatus (10) can comprise a latch arm (71) having a protrusion, a hook, a bracket, or another member, which can extend in a generally lateral direction and/or can be adapted to latch or lock the latch arm (71) into position, thereby locking the slips in an open position.

Latching assembly (70) further comprises an adjustment block (80) that can be adapted for connection with the latch arm (71). The latch arm (71) is shown comprising a generally rectangular plate and having a plurality of ridges or teeth (81), which define the outward surface thereof. The teeth (81) of the adjustment block can be adapted to mate with a plurality of teeth (72) of the latch arm (71). In FIG. 4, the adjustment block (80) is depicted having an elongated hole (82) extending between the outward and inward surfaces of the adjustment block (80), wherein the elongated hole (82) can contain a counter-bore section that can be adapted to receive at least two bolts for threadably connecting the adjustment block (80) to the latch arm (71). The position of the adjustment block (80), along the latch arm (71), can be adjusted by unscrewing the bolts, sliding the block (80) to a desired position, and tightening the bolts to mesh and lock the adjustment block teeth (81) with the latch arm teeth (72). When the adjustment block is locked in position along the latch arm (71), the bottom of the adjustment block (80) defines a lower shoulder (83), having a downward-facing surface that can extend laterally in the inward direction. During pipe installation operations, the lower shoulder (83) can be adapted to latch the latch arm (71) against the inward edge (121) of latch arm opening (120). Although FIG. 4 depicts the lower shoulder (83) as a surface extending laterally in the inward direction along an adjustment block (80), other embodiments of the automatic slip setting apparatus (10) can comprise a latch arm (71) having a protrusion, a hook, a bracket, or another member, which can extend in a generally lateral direction and/or can be adapted to latch or lock the latch arm (71) into position, thereby locking the slips in the closed position.

The lower end of the latch arm (71), as shown in FIG. 4, comprises a lateral protrusion extending in the outward direction, wherein the protrusion comprises a circular cavity or a socket (74) extending therein. The socket (74) can be adapted to receive a handle (not shown), which can be used to move (e.g., reset) the latch arm (71) and to lock the latch arm in a lower position, thereby locking the slips (130*a-c*) in the open position. As depicted in FIG. 6A, when the latch arm (71) is locked in the lower position (i.e., reset), the upper shoulder (73) is latched (e.g., locked) against the outward edge (122) of the latch arm opening (120).

FIG. 4 further depicts the latch arm (71) having a bore (76) extending laterally therethrough, adjacent to the lower end thereof. The bore (76) can be used to establish a connection between the latch arm (71) and the yoke (140), wherein a bolt can extend through the bore (76) and the yoke pad eyes (147*a*, 147*b*) to establish a pivotal connection therebetween.

As further depicted in FIG. 4, the latch assembly (70) can comprise an upper biasing member (e.g., torsion spring (91)) positioned along one side surface of the latch arm (71) and a lower biasing member (e.g., torsion spring (92)) positioned along the opposite side surface of the latch arm (71), below the upper torsion spring (91). The torsion springs (91, 92) can be positioned adjacent to the latch arm teeth (72), wherein each torsion spring (91, 92) can be retained in connection with the latch arm (71) by a bolt threadably engaged with the latch arm (71). During pipe installation operations, one prong of the upper torsion spring (91) can be flexed against (e.g., twisted by) the outward edge (122) of the latch arm hole (120), as the latch arm (71) is moved in the upward direction. When the latch arm (71) approaches its uppermost position or reaches its uppermost position, as depicted in FIG. 7A, the upper torsion spring (91), which is shown as dashed lines, can push against the outward edge (122) of the latch arm hole (120), forcing the latch arm (71) in the inward direction, thereby maintaining the latch arm (71) in contact (e.g., latched) with and/or against the inward edge (121) of the latch arm hole (120). Furthermore, during pipe installation operations, as the latch arm (71) is moved in the downward direction, the lower torsion spring (92) can be flexed against (e.g., twisted by) the inward edge (121) of the latch arm hole (120). When the latch arm (71) approaches its lowermost position or reaches its lowermost position, as depicted in FIG. 7B, the lower torsion spring (92) can push against the inward edge (121) of the latch arm hole (120) and force the latch arm (71) in the outward direction, thereby maintaining the latch arm (71) in contact (e.g., latched) with and/or against the outward edge (122) of the latch arm hole (120).

Although FIGS. 4, 6A-6B, and 7A-7B depict the biasing members as torsion springs (91, 92), it should be understood that in other embodiments, of the automatic slip setting apparatus (10), other biasing members, biasing components or components capable of exerting a force can be used to force the latch arm (71) against the edges (121, 122) of the latch arm hole (120) during stages of the pipe installation process. In yet another embodiment of the automatic slip setting apparatus (10), the use of biasing members can be omitted, wherein the latch arm (71) can move or can be moved to functional positions by other means.

As depicted in FIG. 4, the latching assembly (70) can include a flag (85) or visual indicator that can be usable to indicate to the operator that the slips (130*a-c*) are properly set and locked in the engaged position. The flag (85), as shown in FIG. 4, includes an actuation arm (85*a*), a longer signaling arm (85*b*) that is angularly disposed from the actuation arm (85*a*), and a signaling plate (85*c*) that is connected at the end of the signaling arm (85*b*). The flag (85) can be retained in a pivotal connection with the main body (110) by a bolt extending through a hole (87) in the flag (85), wherein the hole (87) can be located between the actuating arm (85*a*) and the signaling arm (85*b*). The bolt is further shown, in FIG. 4, retaining a torsion spring (86), which can be adapted to bias (e.g., rotate) the flag in the retracted position against a limiting post (88) extending from the upper surface (123) of the main body (110). In the retracted position, the flag actuating arm (85*a*) can partially extend over the latch arm hole (120). During pipe installation operations, the latch arm (71) can move against the inward edge (121) of the latch arm hole (120) and against the actuating arm (85*a*), thereby rotating the flag (85) and extending the signaling plate (85*c*) over the outward edge of the main body (110), as depicted in FIG. 2. This movement of the flag (85) is used to signal the operator that the latch arm (71) and the slips (130*a-c*) are properly set and locked. Alternative indicator systems can be used to signal the operator, as set forth above, and are further described within this detailed description.

FIG. 5 shows an exploded view of an embodiment of the arm assembly (20), as previously shown in FIGS. 1 and 2, which is usable within the scope of the present disclosure. The arm assembly (20) is shown comprising a carriage frame (21), a carriage (30), and an extension arm (40), which are depicted separately for clarity. Specifically, FIG. 5 shows the carriage frame (21) retaining the arm assembly (20) in connection with the elevator assembly (100).

As shown in FIG. 5, the carriage frame (21) can comprise two vertical plates (22*a*, 22*b*), which can be spaced apart in a parallel configuration. In an embodiment, the plates (22*a*, 22*b*) are spaced to allow for the positioning and free movement of the carriage (30) therebetween. Each plate (22*a*, 22*b*), as shown, can have an elongated aperture (23*a*, 23*b*) extending horizontally therethrough, along the outward edge thereof. The elongated apertures (23*a*, 23*b*) can be adapted to receive rollers (35*a-d*), which can extend from the sides of the carriage (30). The inward sides of the plates (22*a*, 22*b*) can have a recessed area (27*a*, 27*b*), defined by diagonally oriented edges, which can allow the extension arm (40) and the contact arm (50) to retract into the carriage (30) (e.g., move in the outward direction) without making contact with the carriage frame (21). The plates (22*a*, 22*b*) are shown connected to a generally rectangular plate or a base (24), thereby rigidly connecting the plates (22*a*, 22*b*) together in a parallel configuration. The connection between the plates (22*a*, 22*b*) can be reinforced by round bars (26*a*, 26*b*) extending between the upper portion of the plates (22*a*, 22*b*). The carriage frame, as depicted in FIG. 5, can comprise a roller (25) extending between the plates (22*a*, 22*b*), above the recessed areas (27*a*, 27*b*). The roller (25) can comprise a sleeve or another tubular member, which can be retained between the plates (22*a*, 22*b*) by a bolt extending therethrough. Lastly, the carriage frame (21) can be connected to the upper guard (150, see FIGS. 1, 2 and 4) by a set of bolts extending through the base (24) and threadably engaging tapped holes formed in the upper guard (150).

In an embodiment, the arm assembly (20) can comprise a carriage (30) that can be adapted to move vertically within the carriage frame (21) and can partially house the extension arm (40). FIG. 5 shows the carriage (30) comprising a tubular body (31) having a generally rectangular cross section. The tubular body (31) can be adapted to allow positioning and free movement of the extension arm (40) therein. The upper and lower sides of the tubular body (31) can have an elongated aperture (32*a*, 32*b*, 32*b* not shown) extending vertically therethrough, adjacent to the inward end of the tubular body (31). The elongated apertures (32*a*, 32*b*) can be adapted to receive the cylindrical protrusions (45*a*, 45*b*) (e.g. tubular sleeves), which extend from the upper and the lower surfaces (41*b*, 41*d*) of the extension arm (40). The carriage (30), as shown in FIG. 5, comprises a support tube (33) that can be adapted for maintaining a trip arm (60) in secure connection with the carriage (30). The support tube (33), which is shown having a generally square cross section, can extend vertically through the tubular body (31), adjacent to the outward end thereof, and can partially extend above and below the tubular body (31). The support tube (33) can be fixedly attached to the tubular body (31) and can comprise a plurality of holes (34) extending through each wall along the length thereof. The bottom side holes (34*a*) can be adapted to accept a retaining pin (38), which can also extend through a predetermined set of holes (62) in the trip arm (60), thereby locking it into position within the support tube (33). The vertical edges (37*a*, 37*b*, 37*b* not shown) of the tubular body (31), along the inward side thereof, can be sloped in the upward direction, which allows the extension arm (40) and the contact arm (50) to retract therein (e.g. move in the outward direction), without making contact with the carriage (30).

As further depicted in FIG. 5, the carriage (30) can be slidably retained within the carriage frame (21) by four cylindrical protrusions (35*a-d*) (e.g. sleeves, rollers) extending laterally (e.g. horizontally) from the side surfaces of the tubular body (31). The carriage can comprise two cylindrical protrusions on each side of the tubular body (31). The cylindrical protrusions (35*a-d*) can be positioned within the elongated vertical apertures (23*a*, 23*b*) of the carriage frame, and spaced vertically apart to prevent the carriage (30) from rotating within the carriage frame (21) during pipe installation operations. The cylindrical protrusions (35*a-d*) can comprise a sleeve that is retained in connection with the tubular body (30) by a bolt, which can extend the sleeve and can threadably engage the tapped holes formed in the tubular body (31).

In an embodiment, the arm assembly (20) can comprise an extension arm (40), which can be adapted to move horizontally in and out of the inward side of the carriage (30) and can connect the contact arm (50) to the carriage (30). FIG. 5 shows the extension arm (40) comprising a single plate body (41) that is contoured and adapted for insertion and horizontal movement within the carriage (30). The middle portion of the inward surface (41*a*) of the single plate body (41) can comprise a recessed area, which can extend into the plate to form a first cavity (42*a*), and which allows portions of the contact arm (50) to be positioned therein to reduce the overall length of the contact arm (50) and extension arm (40) assembly. The upper and lower portions of the outward edge (41*c*) of the single plate body (41) can comprise additional recessed areas that can extend into the plate to form second and third cavities (42*b*, 42*c*). The second and third cavities (42*b*, 42*c*) can be adapted to receive, therein, the internal portions of the cylindrical protrusions (35*a-d*), as the extension arm (40) is retracted into the carriage (30) during pipe installation operations. The internal portions of the cylindrical protrusions (35*a-d*) can include the ends of the bolts that retain the protrusions in connection with the carriage (30).

As further depicted in FIG. 5, the extension arm (40) can be slidably retained within the carriage (30) by an upper cylindrical protrusion (45*a*) (e.g. sleeve, roller) extending vertically (e.g., upwardly) from the upper surface (41*b*) of the extension arm (40), and a lower cylindrical protrusion (45*b*) (e.g. sleeve, roller) extending vertically (e.g. downwardly) from the lower surface (41*d*) of the extension arm (40). The upper and lower cylindrical protrusions (45*a*, 45*b*) can be positioned within the upper and lower elongated apertures (32*a*, 32*b*) of the carriage (30), respectively. The upper and lower cylindrical protrusions (45*a*, 45*b*) can be axially offset, wherein the upper cylindrical protrusion (45*a*) is positioned closer to the outward surface (41*c*) of the extension arm (40), while the lower cylindrical protrusion (45*b*) is positioned closer to the inward surface (41*a*) of the extension arm (40). Each cylindrical protrusion (45*a*, 45*b*) can comprise a sleeve that is retained in connection with the extension arm (40), by a bolt extending therethrough, and threadably engaging tapped holes formed in the upper and lower surfaces (41*b*, 41*d*) of the extension arm (40).

As depicted in FIG. 5, the extension arm (40) can comprise an upper ramp (43) extending above the upper surface (41*b*) thereof. The depicted upper ramp (43) can comprise a wedge-shaped configuration, having an upwardly sloped surface (43*a*) extending along the inward side thereof. The upper ramp (43) can be adapted to move between the first and second plates (22*a*, 22*b*) of the carriage frame (21) and to engage the roller (25), while the extension arm is in the extended position. During pipe installation operations, as the carriage (30) and the extension arm (40) move upwardly, the top edge of the upper ramp (43) can catch the roller (25), which can force the extension arm (40) to retract into the carriage (30), as the carriage (30) and the extension arm (40) continue moving upwardly. As the extension arm (40) retracts into the inner portion of the carriage (30), the upper edge (37*c*) can enter a fourth cavity (42*d*) (e.g. a slit), which extends between the upper ramp (43) and a portion of the upper surface (41*b*).

Figure 8A:
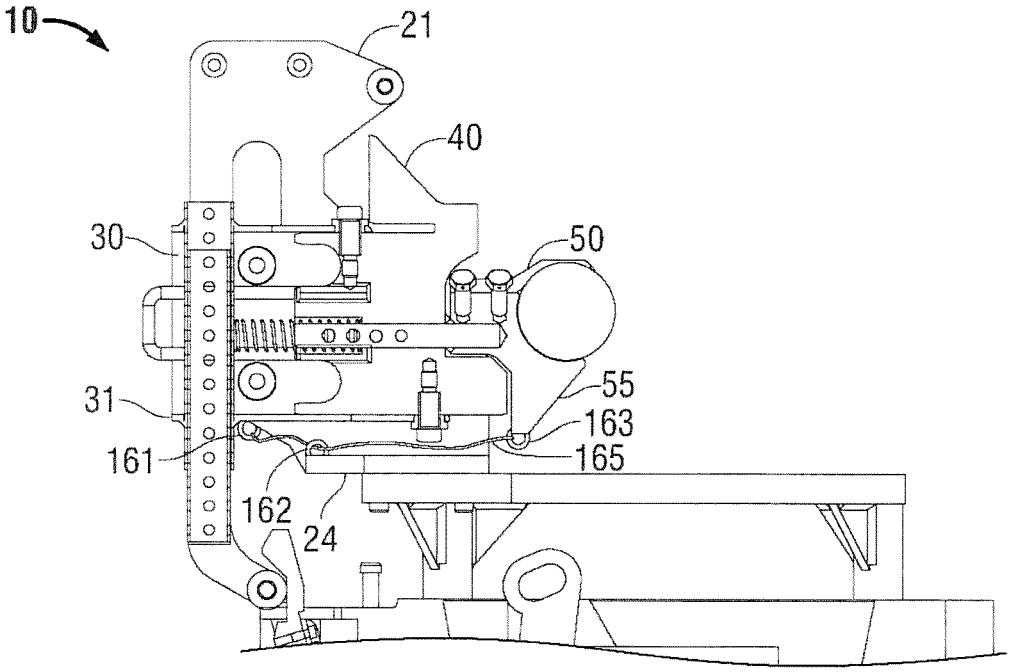
FIG. 8A depicts a cross-sectional side view of another embodiment of the slip setting apparatus usable within the scope of the present disclosure.
Figure 8B:
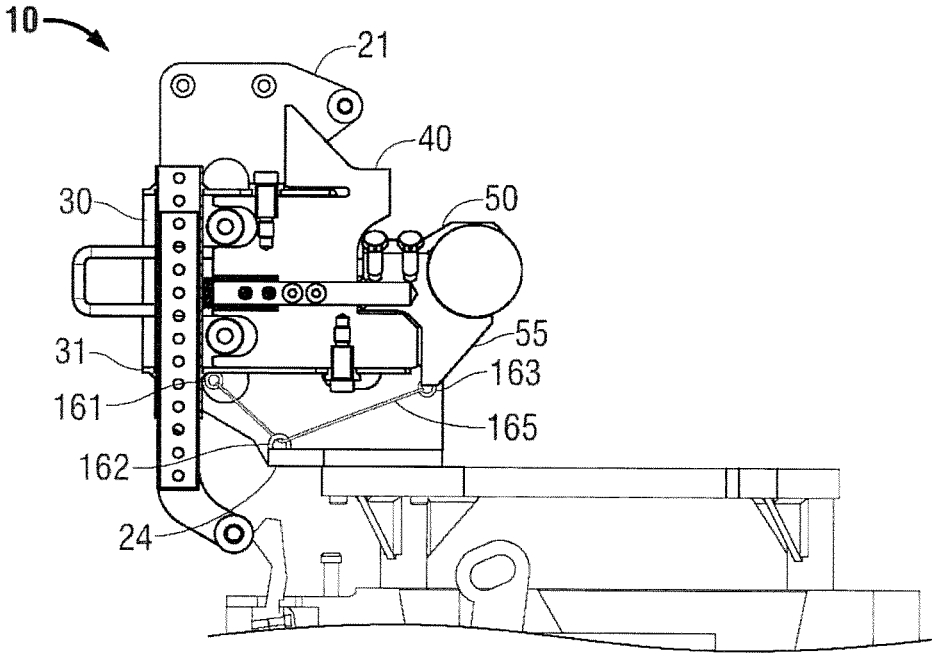
FIG. 8B depicts a cross-sectional side view of an embodiment of the slip setting apparatus usable within the scope of the present disclosure.

In another embodiment of the automatic slip setting apparatus (10), other structure can be used to retract the extension arm (40) into the carriage (30) during operations. As depicted in FIGS. 8A and 8B, three pad eyes (161, 162, 163), or similar eyes, and a segment of cable (165) can be used to retract the extension arm (40). As shown, the first pad eye (161) can be connected to the bottom surface of the carriage body (31), and the second pad eye (162) can be depicted connected to the upper surface of the base (24) of the carriage frame (21). The third pad eye (163), as depicted, can be connected to the bottom portion of the lower ramp (55) of the contact arm (50). One end of a cable (165) can be fixedly attached to the first pad eye (161) while the second end of the cable (165) can be fixedly attached to the third pad eye (163). The middle portion of the cable (165) can extend through the second pad eye (162). During operations, a joint of pipe can contact the contact arm (50) thereby lifting the contact arm (50). As the contact arm (50), the extension arm (40) and the carriage (30) move upward, the cable is pulled, introducing tension therein. As the contact arm (50) continues to be lifted upwards, the contact arm (50) and the extension arm (40) can retract into the carriage (30) due to the tension generated. The cable (165) thereby pulls on the third pad eye (163) connected to the contact arm (50), causing outwardly directed forces on the contact arm (50), which retract the extension arm into the carriage.

FIG. 5 also depicts the extension arm (40) having a bore (44) extending horizontally therethrough. The bore (44) can extend through the entire length of the single plate body (41), between the first cavity (42*a*) and the outward surface (41*c*) between the second and third cavities (42*b*, 42*c*). The inward portion of the bore (44) can be adapted to receive a contact arm (50) extension rod (54) therein. The outward portion ((44*a*), as shown in FIG. 6A) of the bore (44) can comprise a larger diameter than the inward portion ((44*b*), as shown in FIG. 6A) of the bore (44), wherein the outward portion (44*b*) can be adapted to receive a biasing member, for example, a spring ((46), as shown in FIG. 6A). The depicted spring (46) can be adapted to bias the extension arm (40) towards an extended position (e.g., in the inward direction) relative to the carriage (30). Specifically, the spring can be compressed between an internal shoulder, located between the inward and outward sections (44*a*, 44*b*) of the bore (44), and the vertical support tube (33) of the carriage (30). The range of motion of the extension arm (40) within the carriage (30) can be limited by the length of the elongated apertures (32*a*, 32*b*), which guide the movement of the cylindrical projections (45*a*, 45*b*) of the extension arm.

In FIG. 5, the extension arm (40) is shown having two tapped holes (47*a*, 47*b*) extending horizontally, through the side of the single plate body (41), and laterally through the inward portion (44*a*) of the bore (44). The tapped holes (47*a*, 47*b*) can be adapted to receive bolts, which can extend through the inward portion (44*a*) of the bore (44) and can lock the contact arm (50) within the bore (44). FIG. 5 shows two U-shaped rods that form gripping handles (48*a*, 48*b*), which can be welded to each side of the single plate body (41) and can extend horizontally in the outward direction. The handles (48*a*, 48*b*) can be adapted to fit within the carriage body (31) and can extend from the outward side of the carriage body (31), on each side of the support tube (33). The handles (48*a*, 48*b*) allow an operator to manually extend or retract the extension arm out of or into the carriage (30), particularly in instances where the spring (46) fails, the extension arm (40) becomes stuck, or during any other time when a manual override or manual operation is needed.

Referring again to FIG. 5, the Figure shows a contact arm (50) adapted for connection with the extension arm (40), wherein the contact arm (50) can comprise a support base (51), two support brackets (52*a*, 52*b*), a ball (53), and an extension rod (54). The inward portion of the support base (51) can have a curved surface, which can be adapted to conform to the surface of the ball (53) and partially wrap around the ball (53). The lower portion of the support base (51) can comprise a lower ramp (55) that can extend downwardly, in the outward direction. As shown, the depicted lower ramp (55) comprises a wedge-shaped configuration having a downward sloping surface.

Referring to FIGS. 6A and 6B, the lower ramp (55) can be adapted to engage a top edge of a joint of pipe (5), during pipe installation operations and while the extension arm (40) is in the extended position. Specifically, when the elevator assembly (100) is lowered over a joint of pipe (5), the top edge of the joint of pipe (5) can contact the sloping surface of the lower ramp (55) and can lift the contact arm (50), the extension arm (40) and the carriage (30). As the elevator assembly (100) continues being lowered, the joint of pipe (5) can slide along or about the sloping surface of the lower ramp (55), as the extension arm (40) retracts into the carriage (30). Once the lower wedge (55) and the ball (53) of the contact arm (50) pass over the upper edge of the joint of pipe (5), the contact arm (50), along with the extension arm (40) and the carriage (30), can descend to their normal lower position under their own weight.

Returning to FIG. 5, the Figure depicts the contact arm (50) comprising two support brackets (52*a*, 52*b*) that are connected to the upper portion of the support base (51) by bolts. The inward portion of each support bracket (52*a*, 52*b*) can comprise a curved surface that conforms to the surface of the ball (53) and partially wraps the ball (53). The support brackets (52*a*, 52*b*) and the support base (51), as shown, can wrap the ball (53) on three sides, thereby retaining the ball (53) in a position therebetween. The brackets (52*a*, 52*b*) and the support base (51) may compress the ball (53), preventing it from rotating during pipe installation operations. In another embodiment of the contact arm (50), the support brackets (52*a*, 52*b*) and the support base (51) may encompass the ball (50) loosely positioned therebetween, thereby allowing the ball (53) to rotate during pipe installation operations as the ball (50) contacts the joint of pipe (5). The material composition of the ball (53) can include polyurethane or any other material having properties suitable to resist wear from repeated contact with the joint of pipe (5). Further depicted in FIG. 5 is an extension rod (54), which can extend horizontally from the support base (51) in the outward direction and can be usable for insertion into the bore (44) of the extension arm (40). The extension rod (54) is shown comprising four bores (56*a-d*) extending laterally therethrough. The lateral bores (56*a-d*) can be adapted to align with the threaded holes (47*a*, 47*b*) in the extension arm (40) and to receive bolts therethrough, thereby fixedly retaining the extension rod (54) in a predetermined position. The ability to lock the extension rod (54) within the bore (44), at different positions, allows the contact arm (50) to be adjusted for joints of pipe (not shown) having different sizes. A joint of pipe having a smaller diameter may require that the contact arm (50) extend further inwardly to make proper contact with the joint of pipe during pipe installation operations. Alternatively, a joint of pipe having a larger diameter may require the contact arm (50) to be positioned further outwardly to make proper contact with the joint of pipe during pipe installation operations.

In an embodiment of the arm assembly (20), as shown in FIG. 5, the arm assembly (20) includes a carriage (30) having a trip arm (60) that can extend downward from the lower end of the support tube (33). As shown, the trip arm (60) can extend along a generally parallel direction, with respect to the central axis (11) (see FIG. 2) of the elevator central cavity (111). Specifically, the trip arm (60), as shown, can comprise an extension tube (61) that can have a generally square cross-section and can be adapted for entry into the support tube (33). The extension tube (61) can comprise a plurality of holes (62) extending along the center of each side wall. The holes (62) of the extension tube (61) can be adapted to align with the holes (34) in the support tube (33) for receiving therethrough at least one retaining pin (38), which can fixedly retain the extension tube (61) within the support tube (33). Furthermore, the lower end of the extension tube (61), as shown in FIG. 5, can have pad eyes (63*a*, 63*b*) connected thereto, on opposite sides of the extension tube (61), wherein each pad eye (63*a*, 63*b*) is shown projecting in an inward direction, thus enabling a roller (65), which can extend between the pad eyes (63*a*, 63*b*), to contact the upper surface (123) of the main body (110). The roller (65) can comprise a sleeve or a tubular member that can be retained between the pad eyes (63*a*, 63*b*) by a bolt extending therethrough.

The ability to lock the extension tube (61) within the support tube (33), at desired positions, can enable control over the vertical positioning of the carriage (30) in the retracted position. Specifically, as the trip arm (60) (e.g. the roller (65)) contacts the main body (110), the trip arm (60) can prevent the carriage (30) from descending further along the elongated apertures (23*a*, 23*b*) of the carriage frame (21). Accordingly, the trip arm (60) can support the carriage (30), along with the extension arm (40) and the contact arm (50), at a desired height above the elevator assembly (100). The ability to control the distance between the contact arm (50) and the slips (130*a-c*) can enable the automatic slip setting apparatus (10) to be adjusted for various joints of pipe (5) having couplings and/or drill collars of different lengths and diameters.

Referring again to FIG. 6A, a joint of pipe (5), having a shorter coupling or drill collar (6), may require the contact arm (50) to be positioned a shorter distance from the top of the main body (110) for proper engagement of the joint of pipe (5) during pipe installation operations. Alternatively, a joint of pipe (5), having a longer coupling or drill collar (6), may require the contact arm (50) to be positioned a longer distance from the top of the main body (110) for proper engagement of the joint of pipe (5) during pipe installation operations.

The automatic slip setting apparatus of the present disclosure can be used to set a plurality of slips about a joint of pipe, thereby, for example, reducing the chances of a dropped tubular string, which can cause damage to the rig or wellbore and/or injury to the rig personnel. Several stages of an embodiment of the process for setting a plurality of slips about a joint of pipe, using the automatic slip setting apparatus (10), are shown in FIGS. 6A-7B. For clarity, FIGS. 6A-7B depict only the rear slip (130*b*) and omit the side slips (130*a*, 130*c*).

During the initial stages of the pipe installation operations, as depicted in FIG. 6A, the elevator assembly (100) is lowered around the joint of pipe (5), wherein the joint of pipe (5) is received within a central cavity (111) of the elevator assembly (100) until the top of the joint of pipe (5) protrudes above the elevator assembly (100). As the elevator assembly (100) is lowered further down about the outer surface of the joint of pipe (5), the top of the joint of pipe (5) can contact the lower ramp (55) of the contact arm (50). The vertical distance between the contact arm (50) and elevator slips (130*a-c*, 130(*a*) and 130(*c*) are not shown), should be greater than the length of the external coupling or drill collar (6) of the joint of pipe (5), ensuring that the elevator slips (130*a-c*, 130(*a*) and 130(*c*) are not shown), are positioned below the external coupling or drill collar (6), along the body of the joint of pipe (5).

To adjust the vertical position of the contact arm (50), the carriage (30) can be lifted vertically along the elongated apertures (23*a*, 23*b*) of the carriage frame (21), until a desired contact arm (50) height is attained. Thereafter, the retainer pin (38) can be removed from the support tube (33), and the trip arm (60) can be extended downward until the roller (65) contacts the upper surface (123) of the main body (110). Next, the retainer pin (38) can be re-inserted to lock the trip arm (60) with the carriage (30). As the trip arm (60) abuts the upper surface (123) of the main body (110), the carriage (30) is preventing from descending any further, thereby setting the vertical position of the contact arm (50).

After the joint of pipe (5) makes contact with the lower ramp (55), a lifting of the contact arm (50) commences. In addition, the extension arm (40), the carriage (30), and the trip arm (60) can be lifted, as each arm and the carriage are connected to the contact arm (50). As depicted in FIG. 6B, the resulting upward movement of the trip arm (60) causes the roller (65) to engage the latch arm (71) ramp (75) and move the latch arm (71) ramp (75) in the inward direction for unlatching the upper shoulder (73) from the outward edge (122) of the latch arm hole (120). Thereafter, the slips (130*a-c*) can descend downwardly, which will cause an upward lifting of the latch arm (71) and the simultaneous closing of the slips about the joint of pipe (5). As the latch arm (71) continues to move upwardly, the upper torsion spring (91) can bias (e.g., forces) the latch arm (71) into contact with the inward edge (121). FIG. 6B depicts the latching assembly (70) positioned substantially within the rear cavity (118) of the main body (110) of the elevator assembly (100).

As the joint of pipe (5) continues to lift the contact arm (50), the extension arm (40) can retract into the carriage (30), as the sloping surface (43*a*) of the ramp (43) is forced against the carriage frame (21) roller (25), thereby forcing the extension arm (40) to move in the outward direction. Once the ball (53) clears the upper edge of the joint of pipe (5), the contact arm (50), the extension arm (40), and the carriage (30) can descend to their initial position under their own weight or with an optional force and/or assistance from a biasing member (e.g., spring).

As depicted in FIG. 7A, once the lower shoulder (83) of the adjustment block (80) moves above the inward edge (121), the latch arm (71) and the yoke (140) are locked into position, thereby locking the slips (130*a-c*, 130(*a*) and 130(*c*) are not shown) in the closed position. The flag (85), as shown in FIG. 4, can be extended as the adjustment block (80) fully depresses the actuation arm (85*a*).

When the elevator slips (130*a-c*, 130(*a*) and 130(*c*) are not shown) are closed and locked about the outer surface of the joint of pipe (5), the entire weight of the pipe string (not shown) in the wellbore (not shown) can be suspended from the elevator slips (130*a-c*, 130(*a*) and 130(*c*) are not shown). The elevator assembly (100) can be raised within a derrick (not shown), thereby taking weight off of the lower slips (e.g., spider slips, not shown). Thereafter, such lower slips can be removed. Once the lower slips are removed, the pipe string can be lowered into the wellbore, and after the joint of pipe (5) is lowered a sufficient distance, the lower slips can be reapplied.

In order to prevent damage to the joint of pipe (5), the pipe string (not shown) and/or the automatic slip setting apparatus (10), the position of the adjustment block (80), along the latch arm (71), may need to be adjusted. An adjustment of the position of the adjustment block (80) can be made to allow the slips (130*a-c*) to partially open, in the event that the joint of pipe (5) is forced in the upward direction relative to the elevator assembly (100). Such relative motion between the joint of pipe (5) and the elevator assembly (100) may be generated when, for example, the joint of pipe (5) hits an impediment while it is being moved or lowered. A gap or clearance (83*a*, shown in FIG. 7A) between the upper surface (123), adjacent to the inward edge (121), and the lower shoulder (83) can allow the latch arm (71) to descend, which in turn, can allow the slips (130*a-c*) to partially open (e.g., partially lift from the position of rest). As the slips (130*a-c*) partially open, the joint of pipe (5) is thereby allowed to move upwardly, within and relative to the elevator assembly (100), without disengaging therefrom. The clearance (83*a*) distance can vary; and in an embodiment of the automatic slip setting apparatus (10), the clearance (83*a*) can comprise a distance of 0.125 inches.

Once the pipe string is lowered, the automatic slip setting apparatus (10) can be reset to the disengaged slip position, as depicted in FIG. 7B. The automatic slip setting apparatus (10) can be reset by manually shifting a lever (77), which forces the latch arm (71) in a downward direction and latches the first shoulder (73) against the outward edge (122) of the latch arm hole (120). As the latch arm (71) is moved downwardly, the lower torsion spring (92) can bias (e.g., force) the latch arm (71) into contact with the outward edge (122). Once the upper shoulder (73) moves below the outward edge (122), the latch arm (71) and the yoke (140) are locked into position, thereby locking the slips (130*a-c*) in the open position. Then, the above process can be repeated until the desired length of pipe (e.g., number of joint of pipes) is run into the wellbore.

Figure 9:
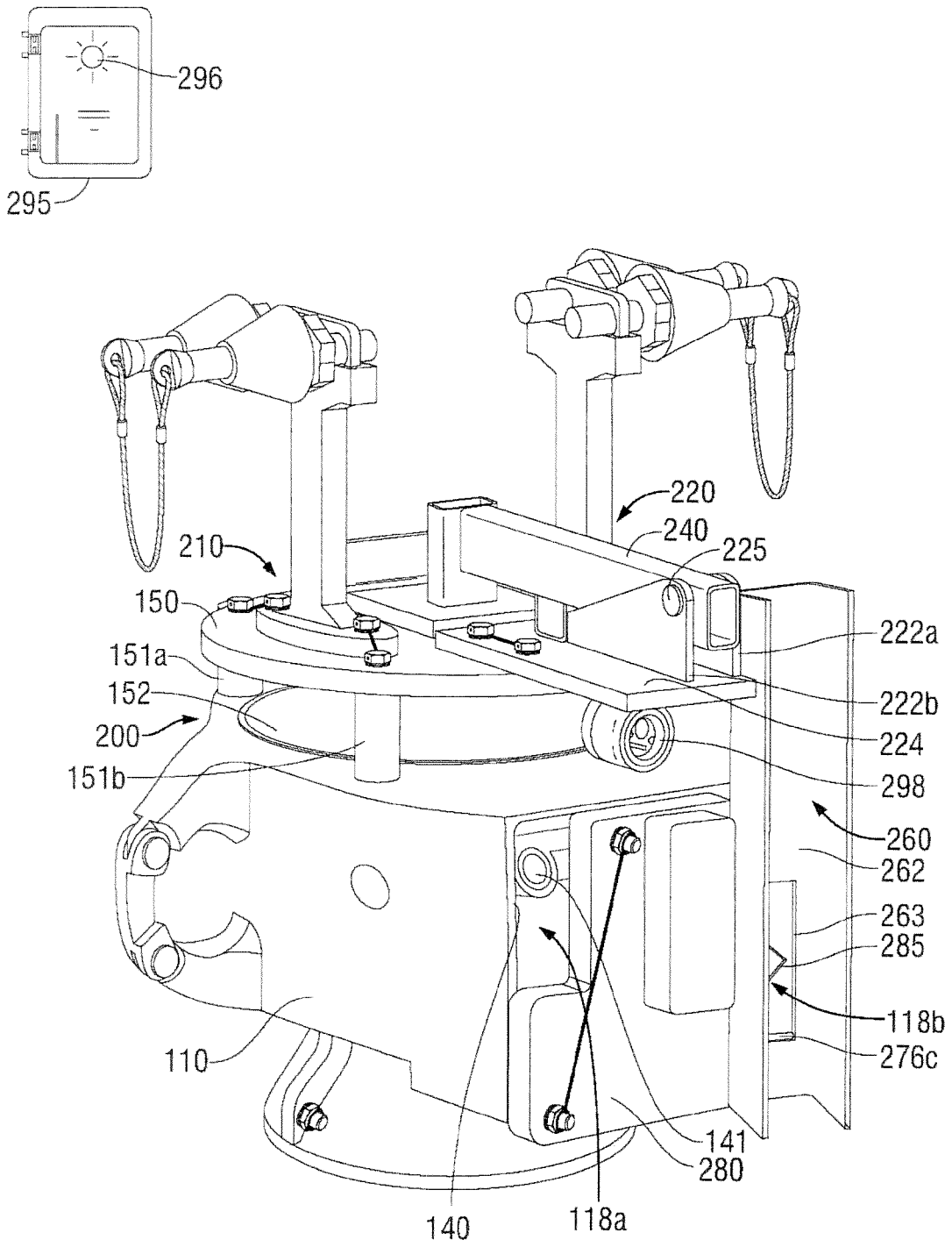
FIG. 9 depicts an isometric back view of an embodiment of a slip setting apparatus usable within the scope of the present disclosure.
Figure 10:
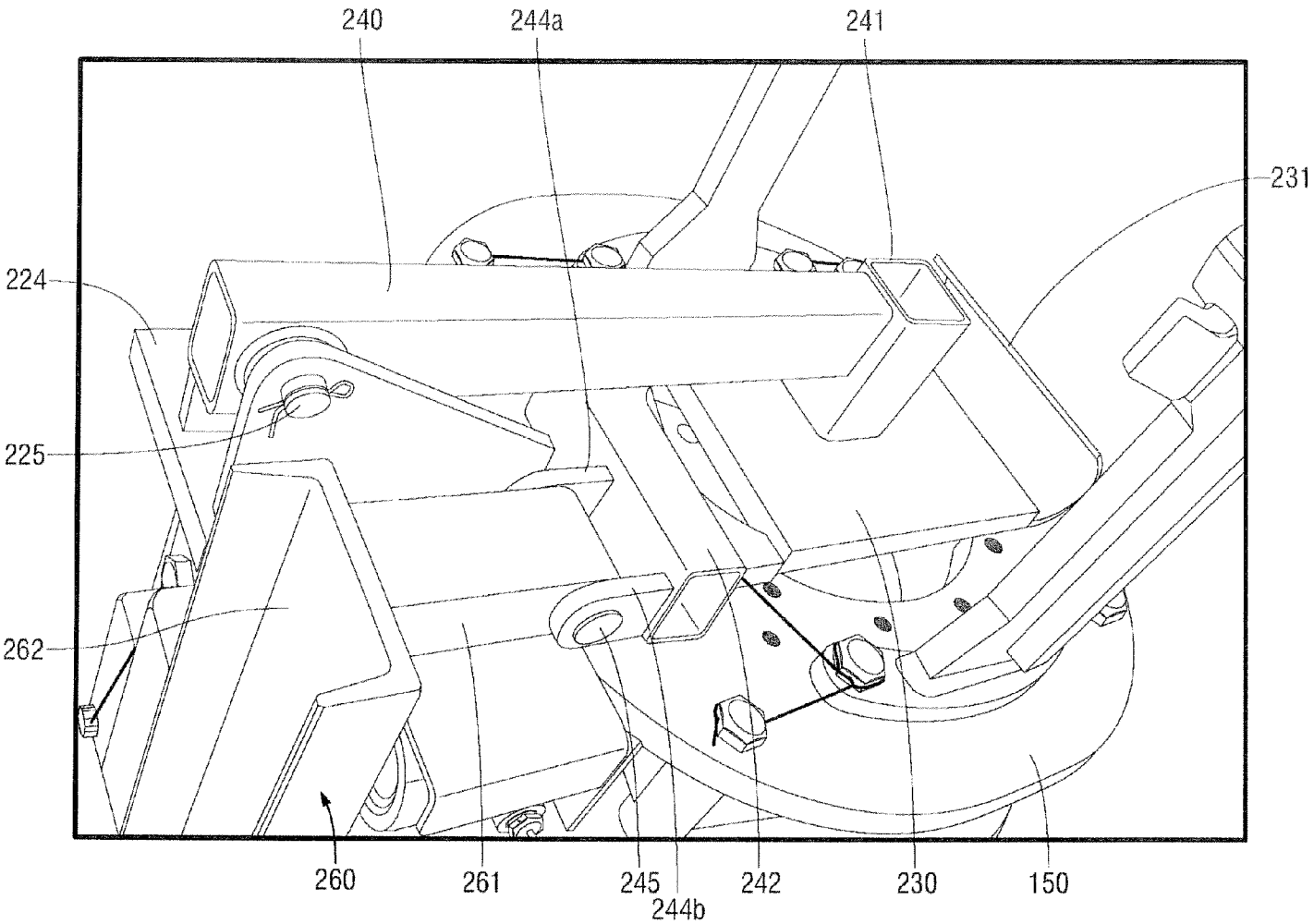
FIG. 10 depicts an isometric back view of a portion of an embodiment of a slip setting apparatus usable within the scope of the present disclosure.

Referring now to FIGS. 9 and 10, said Figures depict an isometric left-hand side view and an isometric right-hand side view, respectively, of another embodiment of an automatic slip setting apparatus (210) that can be usable within the scope of the present disclosure. Specifically, said Figures show an embodiment of the automatic slip setting apparatus (210), which comprises a pivoting arm assembly (220), that is shown connected on top of the upper guard (150) of the elevator assembly (200), which can be similar to the previously described elevator assembly (100), comprising the same or similar components described above, but excluding the latching assembly (70), the latch arm hole (120), and the flag (85). The depicted elevator assembly (200) is only illustrative of the type and model of elevator that is usable as part of the automatic slip setting apparatus (210), as any and all manufactured types and models of elevators can be used as part of the automatic slip setting apparatus (210). FIGS. 9 and 10 depict the elevator assembly (200) of the automatic slip setting apparatus (210) comprising a main body (110) with an upper guard (150) that can be threadably engaged to the top of the main body (110) by a plurality of bolts extending through the upper guard posts (151A-D, of which 151C-D are not shown).

FIGS. 9 and 10 depict the pivoting arm assembly (220) comprising a pivoting arm (240) that can be pivotally connected to a base plate (224) via a pivot pin (225) extending between two vertical plates (222A, 222B), which can be spaced apart in a parallel configuration to form a clevis style connection between the pivoting arm (240) and the base plate (224). In the shown embodiment, the plates (222A, 222B) are spaced apart to allow free rotation of the pivoting arm (240) therebetween. The plates (222A, 222B) are shown fixedly connected to the base plate (224), which in turn is connected to the upper guard (150), thereby maintaining the pivoting arm assembly (220) in the desired position. Specifically, FIG. 9 shows the base plate (224) having a generally rectangular configuration, with an outward portion extending over the edge of the upper guard (150) and an inward portion connected to the upper guard (150) by a set of bolts extending through the base plate (224) and the upper guard (150). Lastly, the base plate (224) comprises a plurality of slits (226A-D, see FIG. 13), which are adapted to accept a plurality of bolts therethrough and to allow the position of base plate (224) to be adjusted along the upper guard (150). As FIG. 9 is only one embodiment of the claimed setting apparatus, it is to be understood that the base plate (224) can be connected to the upper guard (150) by any type and number of connectors, including the bolts described above, and/or by any other methods of connection.

FIGS. 9 and 10 further depict the inward end of the pivoting arm (240), opposite the pivoting end, having a contact plate (230) attached thereto. The contact plate (230) is depicted as a generally rectangular plate oriented along a plane that is parallel with the pivoting arm (240) and connected to the pivoting arm (240) by an extension member (241). The contact plate (230) is further depicted having a rounded surface (231) at the distal edge thereof for allowing the contact plate (230) to slide about the collar ((6) (see FIGS. 6A-7B)) of the joint of pipe ((5) (see FIGS. 6A-7B)), during pipe installation operations, without causing damage to the collar (6). In the depicted embodiment of the automatic slip setting apparatus (210), the round surface (231) comprises an elongated semi-circular channel that can be welded along the distal edge to the contact plate (230) and can extend upwards from the contact plate (230). To further reduce any potential damage to the collar, the bottom surface and the outer surface of the contact plate (230) and the round surface (231) can be coated by a soft material.

Referring still to FIGS. 9 and 10, the pivoting arm assembly (220) can comprise an elongated bracket (242), which is shown extending laterally to the right from about the middle portion of the pivoting arm (240). The elongated bracket (242) is depicted as a rectangular beam having two plates (244A, 244B) extending outwardly and spaced apart in a parallel configuration. The plates (244A, 244B) can have a pivot pin (245) extending therebetween to form a clevis type pivoting connection with a trip arm (260). In the depicted embodiment, the trip arm (260) comprises an L-shaped member having a upper short leg, referred to as a horizontal leg (261), extending laterally and being pivotally connected between the plates (244A, 244B) by the pivot pin (245). The long leg of the trip arm (260), referred to as a vertical leg (262), is shown extending downwardly along the main body (110).

FIG. 9 further depicts a wedge shaped protrusion, referred to as a ramp (285), extending laterally from the cover plate (280) and through the opening (263) in the vertical leg (262). The ramp (285) is shown positioned adjacent to the upper portion of the second window (118B) in the cover plate (280). The cover plate (280) can be bolted to the main body (110) by a plurality of bolts or by any other means. The cover plate (280) can be used for partially enclosing the rear cavity (118, see FIG. 6B) while leaving two areas (e.g., open spaces), referred to as windows (118A, 118B), unobstructed. The first window (118A) exposes the yoke cavity (141), allowing a hand lever (not shown) to be inserted therein to shift the yoke (140). The second window (118B) exposes a portion of the lever (276C), allowing the lever (276C) to extend through the cover plate (280) and to be shifted between upward and downward positions.

During pipe installation operations, the slips (130*a-c*), shown in FIG. 4, may not be properly aligned. Specifically, as only the rear slip (130*b*) is pivotally supported by the trunnions (135*a*, 135*b*), the weight of the left and the right slips (130*c*, 130*a*) may cause the left and the right slips (130*c*, 130*a*) to move or sag downward, with respect to the rear slip (130*b*), and potentially cause improper alignment between the slips (130*a-c*) and the joint of pipe (5). To solve this problem, a threaded bolt may be positioned in the upper guard (150) to extend downward from the bottom surface of the upper guard (150), directly above the outward portion of the rear slip (130*b*). During operations, as the slips (130*a-c*) are in the open position, the head of the bolt (152, also shown in FIG. 4) can contact the outward portion of the top surface of the rear slip (130*b*), pressing it down, to prevent the rotation of the slips (130*a-c*) about the trunnions (135*a*, 135*b*). The distance that the bolt (152) extends below the upper guard (150) can be adjusted by rotating the bolt (152) until desired distance is reached.

Figure 11:
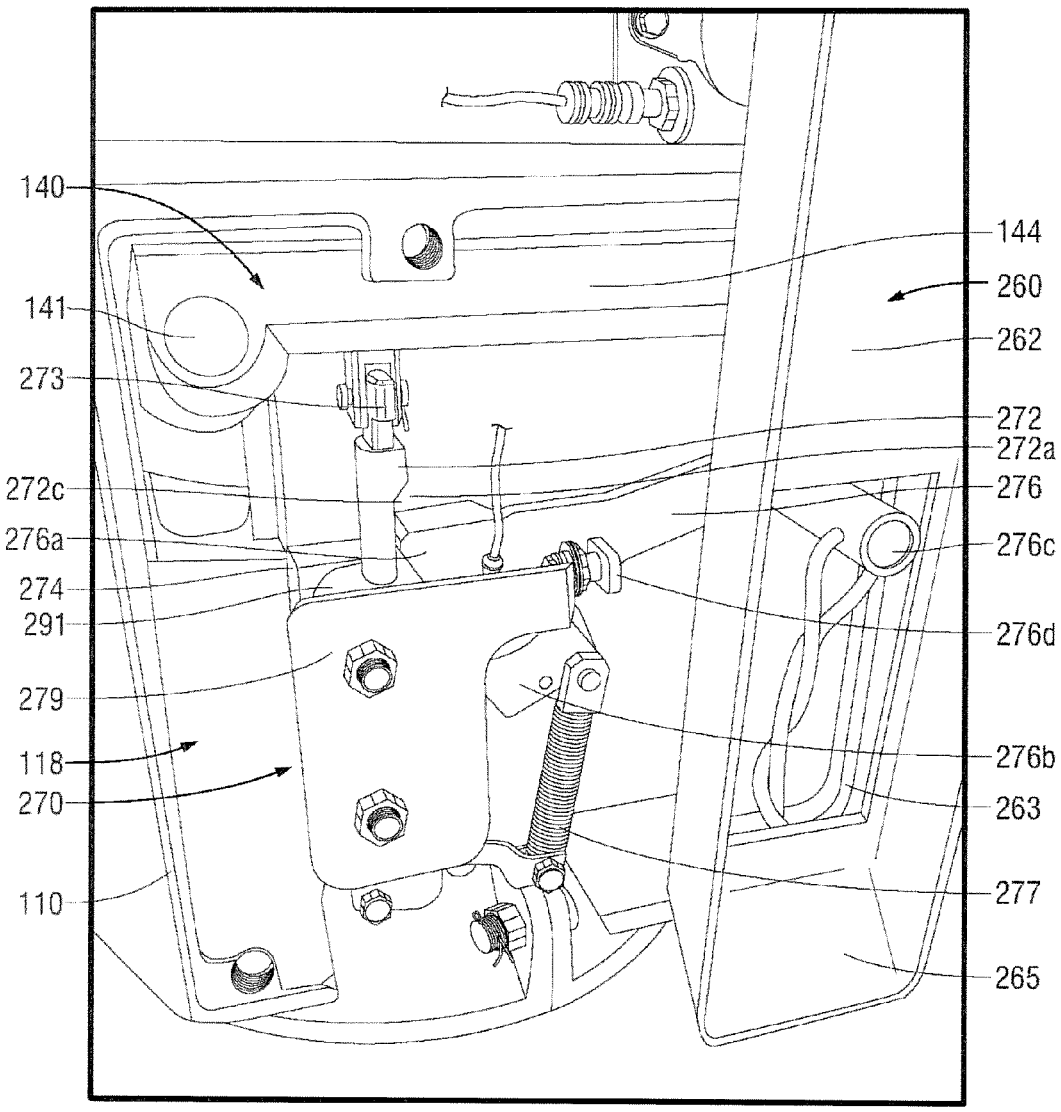
FIG. 11 depicts a close-up view of a portion of an embodiment of a slip setting apparatus usable within the scope of the present disclosure.
Figure 12B:
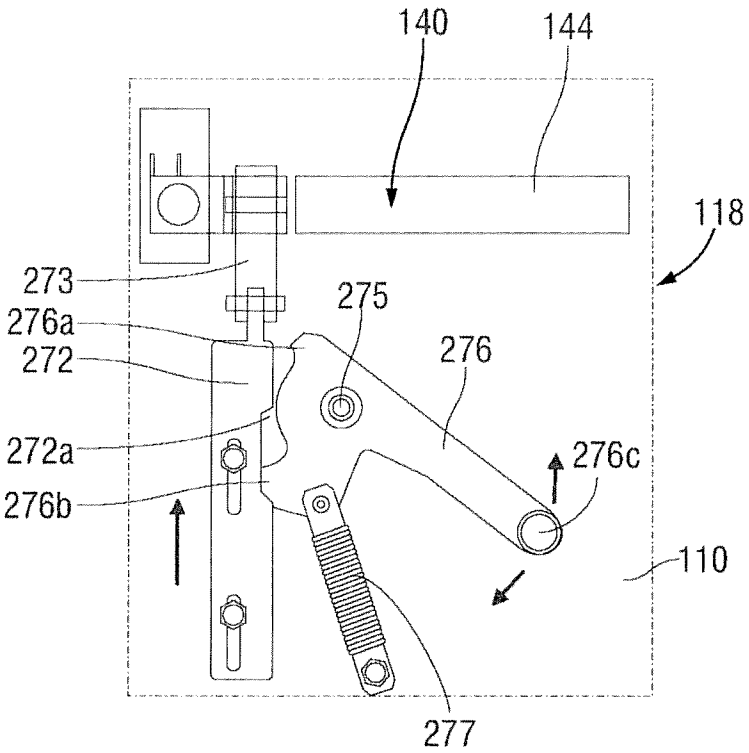
FIG. 12B depicts a symbolic view of a portion of an embodiment of a slip setting apparatus usable within the scope of the present disclosure.
Figure 12A:
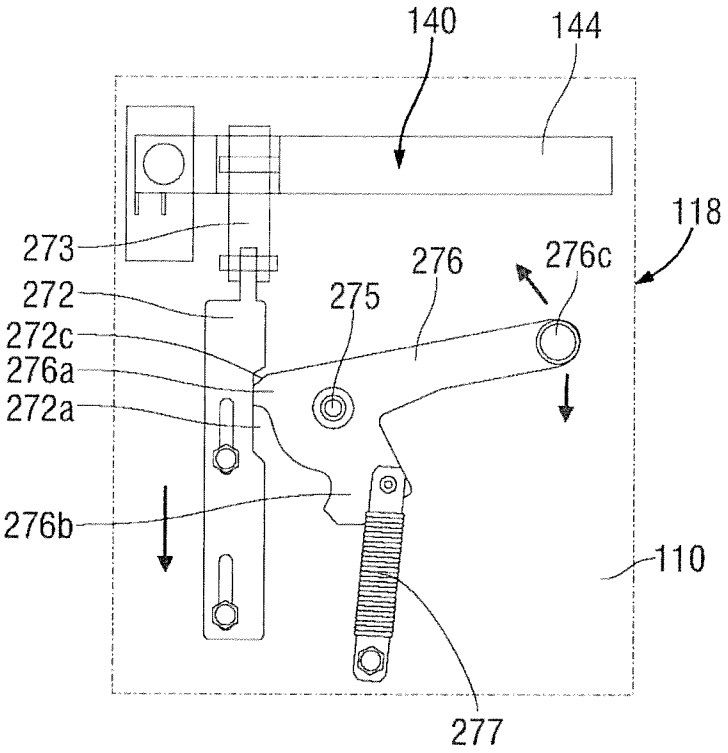
FIG. 12A depicts a symbolic view of a portion of an embodiment of a slip setting apparatus usable within the scope of the present disclosure.
Figure 13:
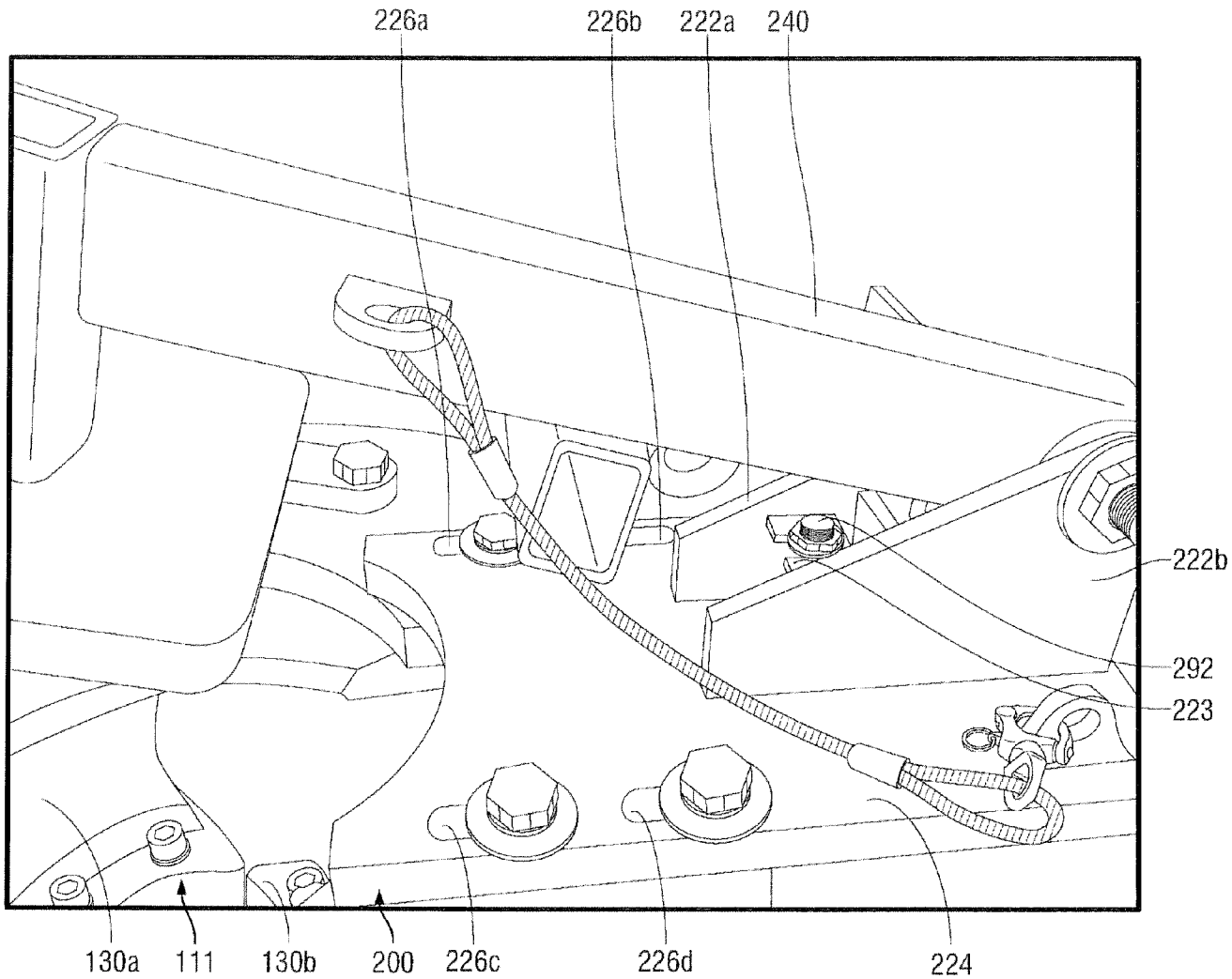
FIG. 13 depicts a close-up view of a portion of an embodiment of a slip setting apparatus usable within the scope of the present disclosure.

Referring now to FIG. 11, the Figure depicts a portion of an embodiment of the automatic slip setting apparatus (210) with the cover plate removed for clarity. This figure depicts the yoke (140) and a yoke locking assembly (270) as part of the elevator assembly (200), which is usable in accordance with the present disclosure. FIG. 11 shows the vertical leg (262), which is depicted as a channel beam having a C-shaped configuration comprising a rectangular opening (263), which can allow a portion of a lever (276C) of a yoke locking assembly (270) to extend therethrough and to move vertically. The yoke locking assembly (270) is shown comprising a shaft (272) that can be slidably positioned within a shaft housing (274), which is bolted to the main body (110) of the elevator assembly. As shown, the shaft (272) can be connected with the central arm (144) of the yoke (140) with a connection link (273). The yoke locking assembly (270) can comprise a rocker (276), which can be usable to lock the shaft (272) in an upward position, as depicted in FIGS. 11 and 12A, and a downward position, as depicted in FIGS. 12B and 13. The rocker (276) is shown pivotally connected to the shaft housing (274) by a pivot pin ((275), not visible behind housing plate (279), but depicted in FIGS. 12A and 12B). The pivot pin (275) can extend through the rocker (276), and shaft housing (274) to connect the rocker (276) to the shaft housing (274). One side of the rocker (276) can comprise a safety lever (276C) that can be usable to rotate the rocker (276) about the pin (275). The safety lever (276C) is shown extending away from the pivot pin (275) and laterally out of the rear cavity (118). The rocker (276) can further comprise an upper and a lower locking lug (276A, 276B), which are located opposite the safety lever (276C) and point away from the pivot pin (275).

As shown, the yoke locking assembly (270) can be connected to the main body (110) by a plurality of bolts extending through the shaft housing (274) and into the (110), and the yoke locking assembly (270) can comprise a spring (e.g., toggle bias spring) (277). The toggle bias spring (277) can be pivotally connected between the rocker (276) and a lower portion of the housing (274), wherein the toggle bias spring (277) can maintain the rocker (276) in a biased upward or downward position, as further explained below.

Referring now to FIGS. 12A and 12B, which symbolically show the general configuration of most elevators that use slips (130*a-c*; see FIG. 4), and a slip operating yoke (140) partially positioned within an elevator cavity (118). FIGS. 12A and 12B further depict the connection link (273) pivotally connected between the central arm (144) of the yoke (140) and the shaft (272). The Figures further depict a rocker (276) pivotally connected to the main body (110) by a pivot pin (275).

Referring now only to FIG. 12A, this Figure shows the yoke locking assembly (270, as shown in FIG. 11) locking the yoke (140) in the upward position, thereby locking the slips in the closed position. The co-operation between the yoke (140) and the slips was previously described in paragraphs [0068]-[0078]. FIG. 12A further shows the central arm (144) being maintained in the upward position by the connecting link (273) and the shaft (272), which is prevented from moving downward by the upper locking lug (276A), which is wedged against the upper portion of the shaft notch (272A, also shown in FIG. 11). As the rocker (276) is physically prevented from rotating further counterclockwise by the shaft (272), the shaft is physically prevented from moving downward. As previously mentioned, the rocker (276) is maintained in an upper position by the toggle bias spring (277), which forces the rocker in the counterclockwise direction to maintain contact between the shaft (272) and the upper locking lug (276A). FIG. 12A further shows the positioning of the lower locking lug (276B), and the safety lever (276C), which is shown extending away from the pivot pin (275).

Referring now to FIG. 12B, this Figure shows the yoke locking assembly (270) locking the yoke (140) in the downward position, thereby locking the slips in the open position. Specifically, to unlock the slips, the rocker (276) can be rotated clockwise by moving the lever (276C) downward. The upper locking lug (276A) can move out of the engagement notch (272A), allowing the shaft (272) to move downward and the slips to be reset to the open position when the pipe string load on the slips is removed. As shown, the engagement notch (272A) is too short for the lower locking lug (276B) to move immediately into the most clockwise position. The toggle bias spring (277) continues to urge the lower locking lug (276B) against the shaft (272) until the shaft (272) moves to the downward position, when the slips are lifted to the open position. Thereafter, the lower locking lug (276B) can move into the engagement notch (272A) to lock the shaft (272) downward, thereby locking the slips in the open position.

Referring again to FIG. 12A, when it is desired for the slips (130*a-c*, see FIGS. 4 and 7A) to close about a joint of pipe ((5), see FIG. 7A), the lever (276C) is moved to the upward position. Simultaneously, the lower locking lug (276B) comes out of the engagement notch (272A), and the shaft (272) can be free to move upward, allowing the central arm (144) of the yoke (140) to move upward and the slips to move into the closed position. When the lever (276) is moved to the upward position, the toggle bias spring (277) can apply a counter-clockwise force on the rocker (276); however, the upper locking lug (276A) cannot enter the notch (272A) until the shaft (272) is in a fully upward position, which confirms the slips fully descended to the closed position.

A potential danger period exists after the lever (276C) is moved upward, but before the slips (130*a-c*) fully descend, close (i.e., set), and lock (i.e., the upper locking lug (276A) enters the engagement notch (272A)) in the closed position. An operator may attempt to lift a joint of pipe (5) without being aware that the slips (130*a-c*) are not fully closed or improperly set. To prevent such a scenario, a safety system can be incorporated as part of the automatic slip setting apparatus (210, as shown in FIG. 9), such as the safety system disclosed in U.S. Pat. No. 6,968,895, which is incorporated herein in its entirety by reference. The automatic slip setting apparatus (210), in accordance with the current disclosure, can include a safety system comprising a plurality of sensors, a communication node, and an indicator box, as described below.

As part of the safety system usable with the automatic slip setting apparatus (210), a proximity switch ((291), shown in FIG. 11) (e.g., an inductive proximity sensor) can be used to indicate to the operator when the slips (130*a-c*) are fully closed and locked. FIG. 11 shows the proximity switch (291) connected to a mounting plate (279), which in turn is connected to the shaft housing (274). The proximity switch (291) can be positioned adjacent to the rocker (276) and oriented to detect the presence of a metal protrusion (276D) extending from the rocker (276). The proximity switch (291) can detect the metal protrusion (276D) and generate an output signal when the metal protrusion (276D) is against the face of the proximity switch (291), which happens when the lever (276C) is in the uppermost position and the upper locking lug (276A) is inserted into the engagement notch (272A).

Furthermore, it is not desirable to close the slips (130*a-c*) about the joint of pipe (5) farther below the collar (6) than is desired. During pipe installation operations, the operator lowers the elevator ((100) in FIG. 6B and (200) in FIG. 9) over the joint of pipe (5) until the slips (130*a-c*) are in proper position in relation to the collar ((6), see FIG. 6B). However, if the operator lowers the elevator (200) too quickly, the slips (130*a-c*) may be positioned farther below the collar (6) than is desired, prior to the slips (130*a-c*) closing. To solve this potential problem, a second proximity switch (292), depicted in FIG. 13, can be strategically positioned to indicate to the operator when the joint of pipe (5) is extending through the elevator (200) cavity (111). Specifically, the proximity switch (292) (e.g., an inductive proximity sensor) is shown in FIG. 13 mounted to a mounting plate (223) extending between parallel plates (222A, 222B). The proximity switch (292) can be oriented in the upward direction to detect the presence of the pivoting arm (240), when the pivoting arm (240) is in its lowermost position, as shown in FIG. 13. When the proximity switch (292) detects the presence of the pivoting arm (240), the proximity switch (292) transmits an output signal to an indicator box ((295), shown in FIG. 9), which visually informs the operator that the joint of pipe (5) is extending through the elevator (200) cavity (111) and that the slips (130*a-c*) are about to close.

Figure 17:
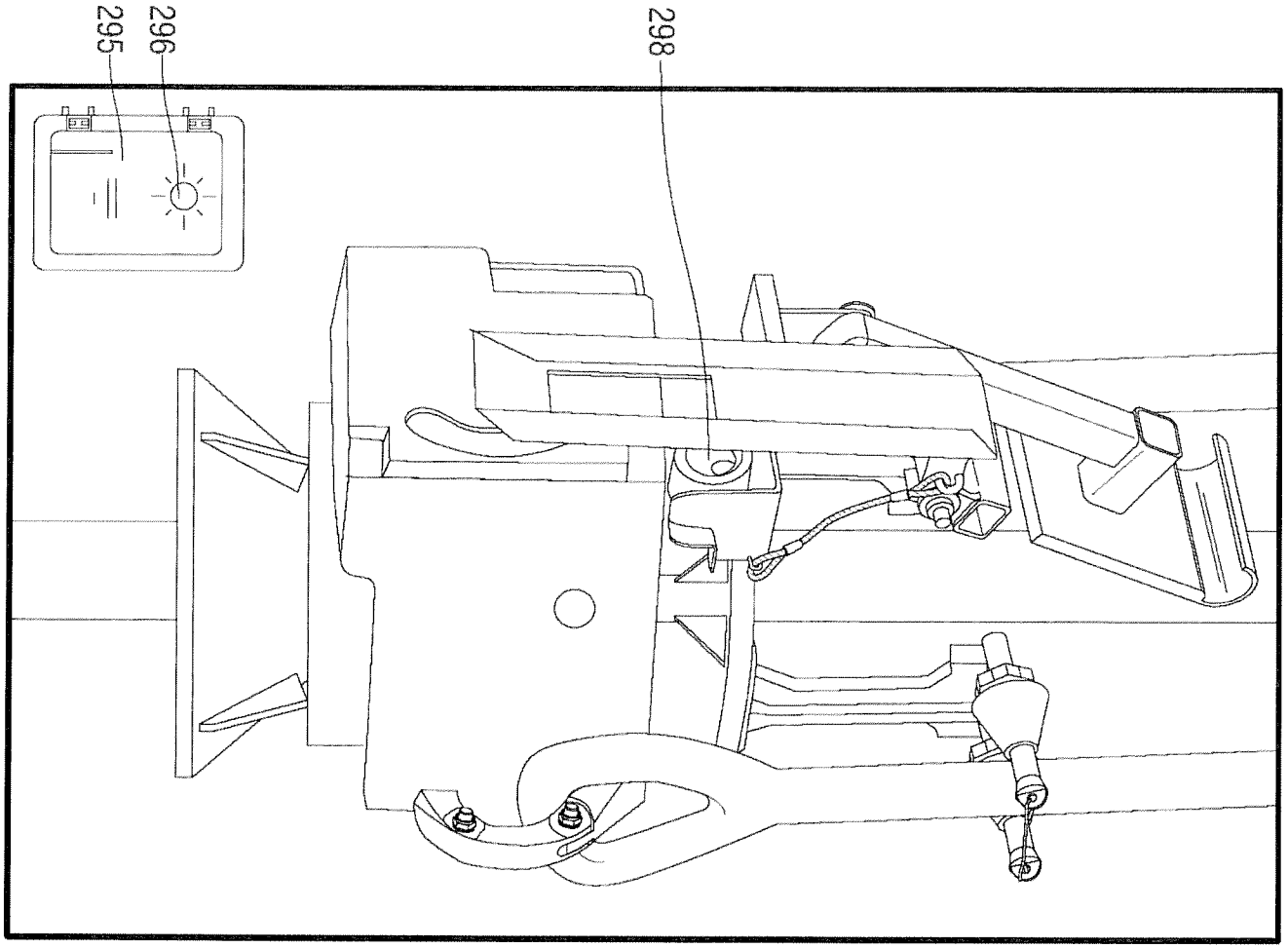
FIG. 17 depicts an embodiment of a spider assembly with an automatic slip setting apparatus usable with a tong system, within the scope of the present disclosure.

Referring again to FIG. 13, the proximity switches (291, depicted in FIGS. 11, and 292, depicted in FIG. 13) can be connected to an indicator box ((295), shown in FIGS. 9 and 17) which can be positioned remotely to the automatic slip setting apparatus (210) and near the operator, to inform the operator whether or not the slips (130*a-c*) are fully engaged about a joint of pipe (5). The indicator box (295), as depicted in FIGS. 9 and 17, comprises an indicator light (296), which can be configured to emit different colors based on a signal input or signal input combinations received from the proximity switches (291, 292). In an embodiment of the automatic slip setting apparatus (210), as depicted in FIGS. 9 and 17, the indicator box (295) is configured to cause the indicator light (296) to emit a light (e.g., a red light) when the proximity switch (291) is not generating an output signal (e.g., signaling the presence of the metal bracket (276D)). In this embodiment, the indicator light (296) remains red until the pivoting arm (240) is lifted away from the proximity switch (292), breaking the output signal transmitted by the proximity switch (292), which results in the indicator light (296) emitting a different color (e.g., turning yellow). In this embodiment, a yellow indicator light (296) instructs the operator to slow the descent of the elevator (200) over the joint of pipe (5). Lastly, when the lever (276C) is moved to its upward position by the trip arm (260) and the upper locking lug (276A) enters the engagement notch (272A), the metal bracket (276D) moves into close proximity to the proximity switch (291) to trigger the proximity switch (291) to transmit a signal to the indicator box (295). The indicator box, in turn, causes the indicator light (296) to emit another color of light (e.g., a green light), informing the operator that the slips are engaging the joint of pipe and are locked into position.

The signals between the proximity switches (291, 292) and the indicator box (295) can be transferred or transmitted by any known means. FIGS. 9 and 17 depict the automatic slip setting apparatus (210) incorporating a wireless node (298) (e.g., a wireless transmitter) that is positioned below the base plate (224), wherein the wireless node (298) can transmit to the indicator box (295) a wireless signal, which indicates the status of each proximity switch (291, 292). The indicator box (295) can be adapted to receive the wireless signal from the wireless node (298) and to change the color of the indicator light (296) according to internal logic circuitry, which can include the use of relay devices or other communication transmission devices, or programming.

As previously stated, the automatic slip setting apparatus (210, as shown in FIG. 9) of the present disclosure can be used to set a plurality of slips (130*a-c*, as shown in FIG. 4) about a joint of pipe (5), thereby, for example, reducing the chances of a dropped tubular string (not shown), which can cause damage to the rig or the wellbore or cause injury to rig personnel. An embodiment of the process for setting the plurality of slips (130*a-c* of FIGS. 4, and 130*a* and 130*b* of FIG. 13) about a joint of pipe (5), using the automatic slip setting apparatus (210), includes several steps, which are described below.

During the initial stages of the pipe installation operations, prior to and as the elevator assembly (200) is being lowered around the joint of pipe (5), the indicator light (296, as shown in FIGS. 9 and 17) is red. As the elevator assembly (200) is lowered further down, the top of the joint of pipe (5) can contact the bottom surface of the contact plate (230), depicted in FIG. 10, and lift the pivoting arm assembly (220). When the pivoting arm (240) is lifted, the output signal from the second proximity switch ((292), shown in FIG. 13) terminates, resulting in a corresponding wireless signal being transmitted by the wireless node ((298), shown in FIGS. 9 and 17) to the indicator box ((295), shown in FIGS. 9 and 17). Simultaneously, the indicator box (295) causes the indicator light ((296), shown in FIGS. 9 and 17) to turn yellow, indicating to the operator that the operator should slow down the rate of descent of the elevator assembly (200).

As the automatic slip setting apparatus (210) continues to descend, the pivoting arm (240) vertically lifts the trip arm (260) until the lower edge of the opening (263) engages the lever (276C) (e.g., rocker lever, safety lever), which extends through the opening (263). As the pivoting arm (240) continues to rotate, the trip arm (260) moves the lever (276C) to the upward position. As the lever (276C) moves to the uppermost position, the metal bracket (276D) is positioned against the face of the proximity switch (291), as shown in FIG. 11, which generates an output signal to the wireless node (298). The wireless node (298), in turn transmits a corresponding wireless signal to the indicator box (295), changing the indicator light (296) to a green color, which indicates that the slips (130*a-c*) are fully engaged about the joint of pipe (5) and are locked in position by the engagement between the rocker (276) and the shaft (272). FIG. 7A depicts the central arm (144) of the yoke (140) in the uppermost position and the slips (130*a-c*; 130(*a*) and 130(*c*) not shown) in the closed position about the joint of pipe (5).

Furthermore, when the trip arm (260) moves in the upward direction, the ramp ((285), as shown in FIG. 9) can move the vertical leg (262) away from the main body (110) as the lower edge of the opening (263) continues to move upward and contacts the diagonal edge of the ramp (285). This allows the vertical leg (262) to be lifted above the lever (276C) without physically interfering with or damaging the lever (276C). Later, when the trip arm (260) moves back down, the outwardly sloping bottom surface (265, shown in FIG. 11) can make contact with the ramp (285) and/or the lever (276C), to move the vertical leg (262) away from the main body (110) and over the ramp (285) and the lever (276C).

During operations, when the elevator slips (130*a-c* of FIGS. 4 and 130*a* and 130*b* of FIG. 13) are closed and locked about the outer surface of the joint of pipe (5), the entire weight of the pipe string (not shown) in the wellbore (not shown) can be suspended from the elevator assembly (200). The elevator assembly (200) can be raised within a derrick (not shown), thereby taking weight off of the lower slips (e.g., spider slips, not shown). Thereafter, such lower slips can be removed. Once the lower slips are removed, the pipe string can be lowered into the wellbore and the lower slips can be reapplied.

In order to prevent damage to the joint of pipe (5), the pipe string (not shown), and/or the automatic slip setting apparatus (210) during operations, the slips (130*a-c* of FIGS. 4 and 130*a* and 130*b* of FIG. 13) can be allowed to partially open, in the event that the joint of pipe (5) is forced in the upward direction relative to the elevator assembly (200). Such relative motion between the joint of pipe (5) and the elevator assembly (200) may be generated when, for example, the joint of pipe (5) hits an impediment while it is being moved or lowered. A gap (272C) (e.g., clearance, space), as best seen in FIGS. 11 and 12A, in the engagement notch (272A), located above the upper locking lug (276A), can allow the shaft (272) to move a small distance downward, which in turn, can allow the slips (130*a-c* of FIGS. 4 and 130*a* and 130*b* of FIG. 13) to move a small distance upward and partially open. As the slips (130*a-c* of FIGS. 4 and 130*a* and 130*b* of FIG. 13) partially open, the joint of pipe (5) is thereby allowed to move upwardly, within and relative to the elevator assembly (200), without disengaging therefrom.

Once the pipe string is lowered into the wellbore, the slips (130*a-c*) can be reset to the open position, as depicted in FIG. 7B. As shown in FIG. 11, the automatic slip setting apparatus (210) can be reset by manually moving the lever (276C) and, then, the yoke central arm (144) to the downward position. As the lever (276C) is moved downward, the metal plate (276D) can be moved away from the proximity switch (291), breaking the output signal to the wireless node (298), which in turn transmits a corresponding signal to the indicator box (295), which changes the indicator light (296) back to yellow. The yoke (140) can be shifted by inserting a hand lever (not shown) into the yoke cavity (141), and the hand lever can be used to force the yoke central arm (144) in a downward direction to lift the slips (130*a-c*). When the lower locking lug (276B) is positioned within the engagement notch (272A), as shown in FIG. 12B, the position of the yoke (140) is locked, thereby locking the slips (130*a-c*) in the open position. Once the slips (130*a-c*) are open, the elevator (200) can be lifted to retract the joint of pipe (5) therefrom. As the joint of pipe (5) exits the elevator cavity (111), the pivoting arm (240) can rotate back to its lowermost (i.e., resting) position, causing an output signal to be generated by the second proximity switch (292), which in turn, causes the indicator light (296) to turn red. The above process can be repeated until the desired length of pipe (e.g., number of joints of pipe) is run into the wellbore.

Referring now generally to FIGS. 14 through 16B and 18 through 19, which depict an embodiment of a spider assembly (400) usable within the scope of the present disclosure. Although the spider assembly (400) can provide a different function from the elevator assemblies (100, 200), depicted in FIGS. 1-13, during drilling, pipe tripping, or other downhole operations, the spider assembly (400) can comprise a similar or the same structure as the previously described elevator assemblies (100, 200). As such, an embodiment of the spider assembly can comprise similar or the same components as an elevator assembly.

Because the spider assembly (400) can comprise similar or the same components that can be used to make up the elevator assemblies (100, 200), it should be understood that these similar or same components can function in a similar or identical manner, regardless of whether the components are used in an elevator assembly (100, 200) or in a spider assembly (400), unless specified otherwise. Therefore, for clarity purposes, the similar or same components of the spider assembly (400), as set forth above, will be identified herein with the same numerals as previously used in describing the elevator assemblies (100, 200). For additional clarity, the function of certain components, which make up the spider assembly (400) and are previously referenced in regards to the elevator assemblies, may not be described in further detail. However, other than when specified, it should be understood that the components making up the spider assembly (400) can function in a similar or the same manner as the similar or identical components used for making up or manufacturing the elevator assemblies (100, 200).

Lastly, the spider assembly (400), as depicted in FIGS. 14 through 19, is only illustrative of one type and model of the spider assembly that can be used within the scope of the present disclosure; and therefore, it should be understood that other types and models of spiders and spider assemblies can be used with a screw clamp and an automatic slip setting apparatus, as described herein.

Figure 14:
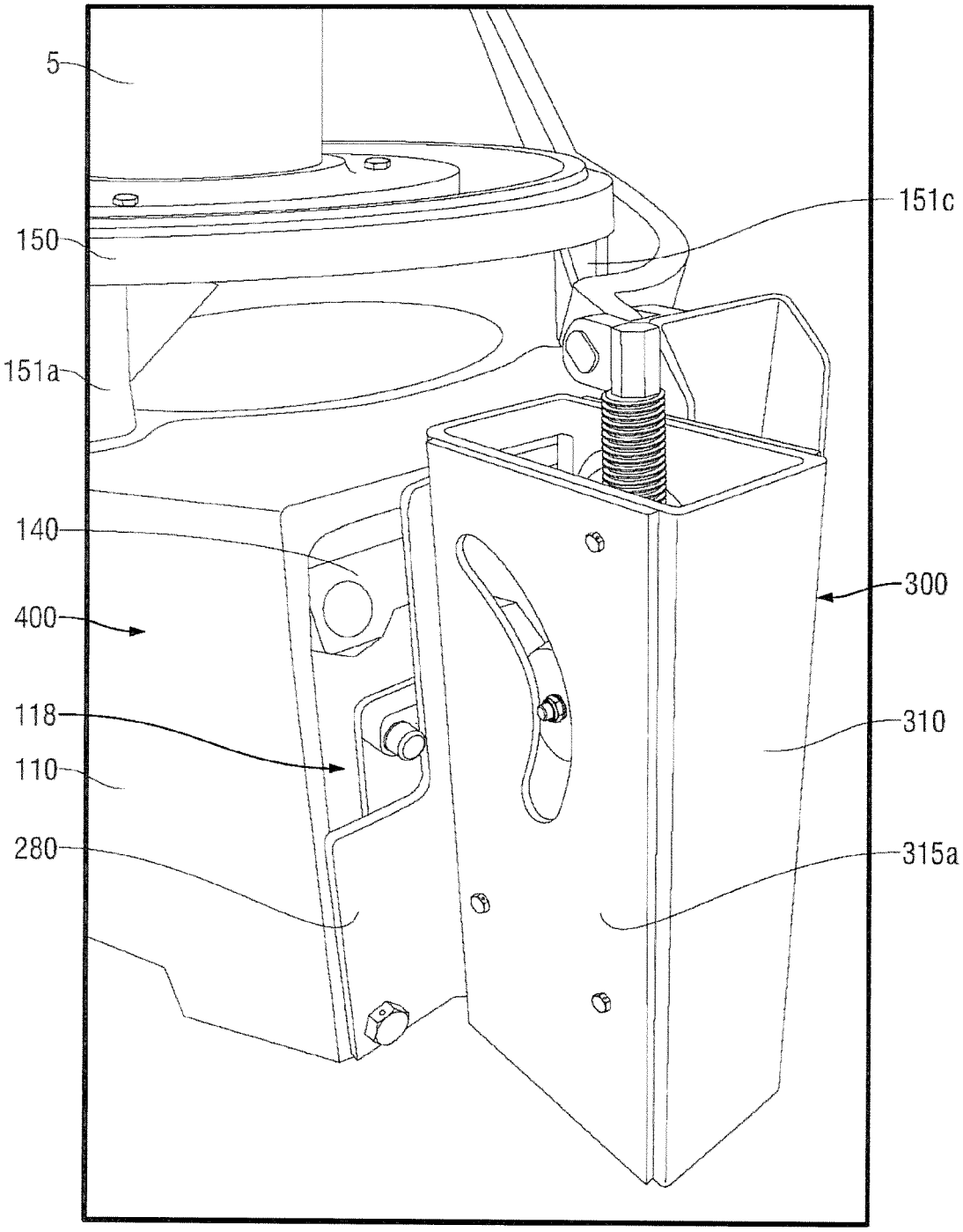
FIG. 14 depicts an isometric rear view of an embodiment of a safety screw clamp apparatus usable within the scope of the present disclosure.

Referring now to FIG. 14, the Figure depicts an isometric left-hand side view of an embodiment of a screw clamp apparatus (300) ("screw clamp") comprising a housing (310) and side cover plates (315A), which can be usable within the scope of the present disclosure. As explained in more detail below, the screw clamp (300) can be used as a jacking or a lifting apparatus that can be attached about the rear cavity (118) of a spider assembly (400) body (110). The screw clamp (300) can be used to force the yoke (140) in an upward direction and to lock the yoke in an upward position, which results in a downward force that can cause the slips (130*a-c*, not pictured in FIG. 14, but present and the slips of the spider are similar, or are the same as, the slips shown FIG. 3A-3B) to move in a downward direction and to lock in a downward position, against a joint of pipe (5). Accordingly, the combination of the spider assembly (400) and the screw clamp (300) can be used as a back-up tong to prevent a joint of pipe (5) from rotating during make up or break out operations.

FIG. 14 further depicts the spider assembly (400) comprising a main body (110) with an upper guard (150) that can be threadably engaged to the top of the main body (110) by a plurality of bolts, which can extend through the upper guard posts (151A-D, of which 151B and 151D are not shown). The screw clamp (300) is shown positioned at the center of the rear cavity (118) and connected to the cover plate (280), which allows the screw clamp (300) to be connected to, or disconnected from, the spider assembly (400) when connecting or removing the cover plate (280).

Figure 15:
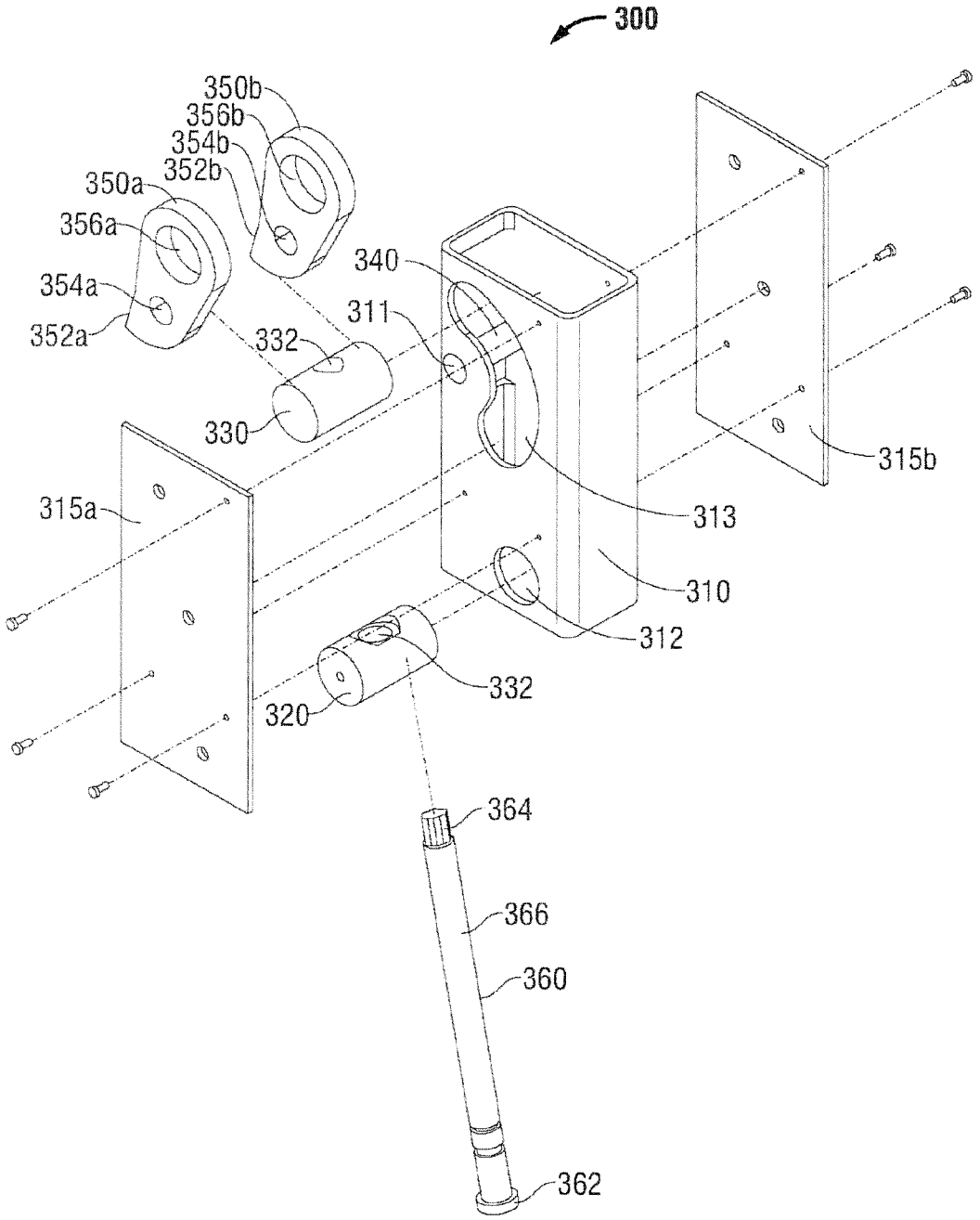
FIG. 15 depicts an exploded view of an embodiment of the safety screw clamp apparatus usable within the scope of the present disclosure.

Referring now to FIG. 15, depicting an exploded view of an embodiment of the screw clamp (300). The Figure shows the screw clamp (300) comprising a rectangular housing (310, also shown in FIG. 14) extending vertically and having an open top end and an open bottom end. The housing (310) is shown having a first hole (311), a second hole (312) and a third hole (313) extending laterally through the side walls of the housing (310), wherein the first hole (311) and the second hole (312) can accommodate and retain, in position, a pivot pin (340) and a retainer pin (320), respectively. The third hole (313) can have an arc shape to accommodate the motion of the cylindrical nut (330) during screw clamp (300) operation. Positioned vertically within the housing (310) is shown a jack screw (360), which has an elongated cylindrical configuration. The bottom end of the jack screw (360) is shown comprising a retainer head (362) with a wider profile, while the top end is shown comprising a hexagonal head (364). The intermediate portion (366) of the jack screw (360), extending between the hexagonal head (364) and the retainer head (362), can be threaded. The retainer pin (320) has a cylindrical configuration for insertion into, and pivoting action within, the second hole (312). The retainer pin further comprises a lateral bore (332) for accommodating and retaining, therein, the bottom end of a jack screw (360), wherein the retainer head (362) can prevent the jack screw (360) from passing through the retainer pin (320). The cylindrical nut (330) has a generally cylindrical configuration for insertion into, and pivoting action within, the outer arm holes (356A, 356B). The cylindrical nut (330) further comprises a threaded lateral bore (332) for receiving and threadably engaging the threaded intermediate portion (366) of the jack screw (360).

Referring still to FIG. 15, the screw clamp (300) is further shown comprising a pair of lever arms (350A, 350B). Each lever arm (350A, 350B) is shown having a lifting surface (352A, 352B), which can be adapted for lifting the central arm ((144), shown in FIGS. 16A and 16B) of the yoke (140) during operations. Each lifting surface (352A, 352B) can be located at the first end of each lever arm (350A, 350B), respectively. Each lever arm (350A, 350B) is shown having an outer arm hole (356A, 356B) at the second end of the lever arm (350A, 350B), wherein the outer arm holes are adapted to receive opposite ends of the cylindrical nut (330). Each lever arm (350A, 350B) is further shown having a central hole (354A, 354B), which can be adapted to receive therein the pivot pin (340). The screw clamp (300) can further comprise side cover plates (315A (also shown in FIG. 14), 315B), which can cover the holes (311, 312, 313) in the housing (310).

In describing the relationship between the yoke (140) and the slips (130*a-c*) of the spider assembly (400), we refer again to FIG. 4, showing an elevator assembly (100) having a similar interior structure to the spider assembly (400). As stated previously, the spider assembly (400) and screw clamp (300) of the present disclosure can be used as a back-up tong for forcing and locking a plurality of slips (130*a-c*) about a joint of pipe (5) to prevent the joint of pipe from rotating during make up or break out operations. Because of the co-operation between the yoke (140) and the slips (130*a-c*), the screw clamp (300) can be used to lift the yoke (140) to force the slips (130*a-c*) downward and against the joint of pipe (5), to prevent the joint of pipe (5) from rotating during make up or break out operations.

Specifically, FIG. 4 shows the yoke (140) pivotally connected to the main body (110) by a pivot pin (119), which can extend through at least two apertures (143*a*, 143*b*) in the swing arm portions (145*a*, 145*b*) of the yoke (140) and through the rear wall of the main body (110), between the central cavity (111) and the rear cavity (118). The yoke (140) can pivot about the pivot pin (119), such that an upward or downward motion of a central arm (144) can rotate the swing arms (145*a*, 145*b*). The second or inward ends of the swing arms (145*a*, 145*b*) are shown containing oval-shaped camming apertures (146*a*, 146*b*), which can receive trunnions (135*a*, 135*b*) extending from the rear slip (130*b*). The camming apertures (146*a*, 146*b*) can enable lifting of the slips (130*a-c*) upon downward movement of the central arm (144) portion of the yoke (140).

Such co-operation between the yoke (140) and the slips (130*a-c*) allows the upward force, applied to the central arm (144) of the yoke (140), to be transferred to the slips (130*a-c*) as a downward force, causing the slips (130*a-c*) to engage the joint of pipe (5). Such downward force is generated independently of, and in addition to, the downward force applied on the slips (130*a-c*) by the weight of the entire pipe string that is being supported by the spider assembly (400).

The method of operation and use of the screw clamp (300) for forcing the slips (130*a-c*) to engage and prevent a joint of pipe (5) from rotating during make up or break out operations includes several steps, which are described below.

Figure 16A:
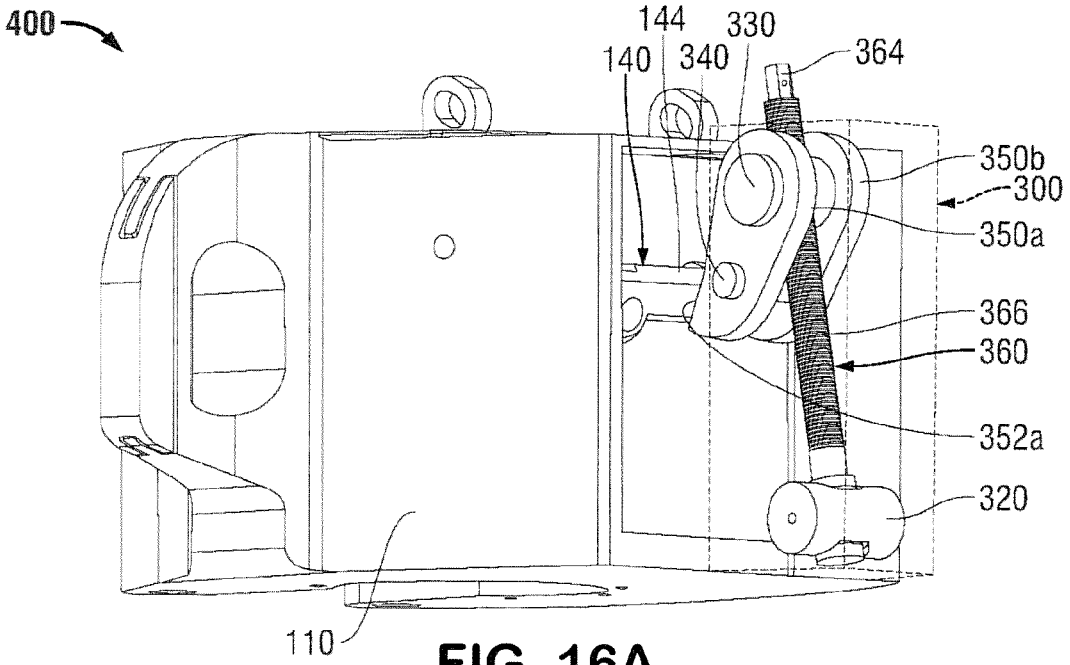
FIG. 16A depicts an isometric rear view of an embodiment of the safety screw clamp apparatus usable within the scope of the present disclosure, shown without the screw clamp apparatus housing.

Prior to make up operations, the spider assembly (400) can allow movement of the pipe string (not shown) through the central cavity (111), as the pipe string is lowered into the wellbore. Referring now to FIG. 16A, which shows the internal components of the screw clamp (300) and excludes the housing (310) for clarity. Specifically, FIG. 16A shows the screw clamp (300) in connection with the main body (110) of the spider assembly (400), and the screw clamp (300) is disengaged from the yoke (140). The cylindrical nut (330, also depicted in FIG. 16B) is shown positioned high along the threaded portion (366) of the jack screw (360), thereby lifting the second end of the lever arms (350A, 350B) to lower the lifting surfaces (352A) and ((352B, shown in FIG. 16B). Such lever arm (350A, 350B) position allows the yoke (140) to freely pivot between the lowered and raised positions, which, in turn, allows the slips (130*a-c*) to be lifted and lowered to disengage and engage the joint of pipe (5).

After the pipe string (not shown) has been lowered into the wellbore (not shown) through the central cavity (111) of the spider assembly (400), the slips (130*a-c*) of the spider assembly (400) can be closed and locked about the outer surface of the uppermost joint of pipe (5), similarly as depicted in FIG. 7A. At this point, the entire weight of the pipe string can be supported by the spider assembly (400), and the screw clamp (300) can engage the yoke (140).

Figure 16B:
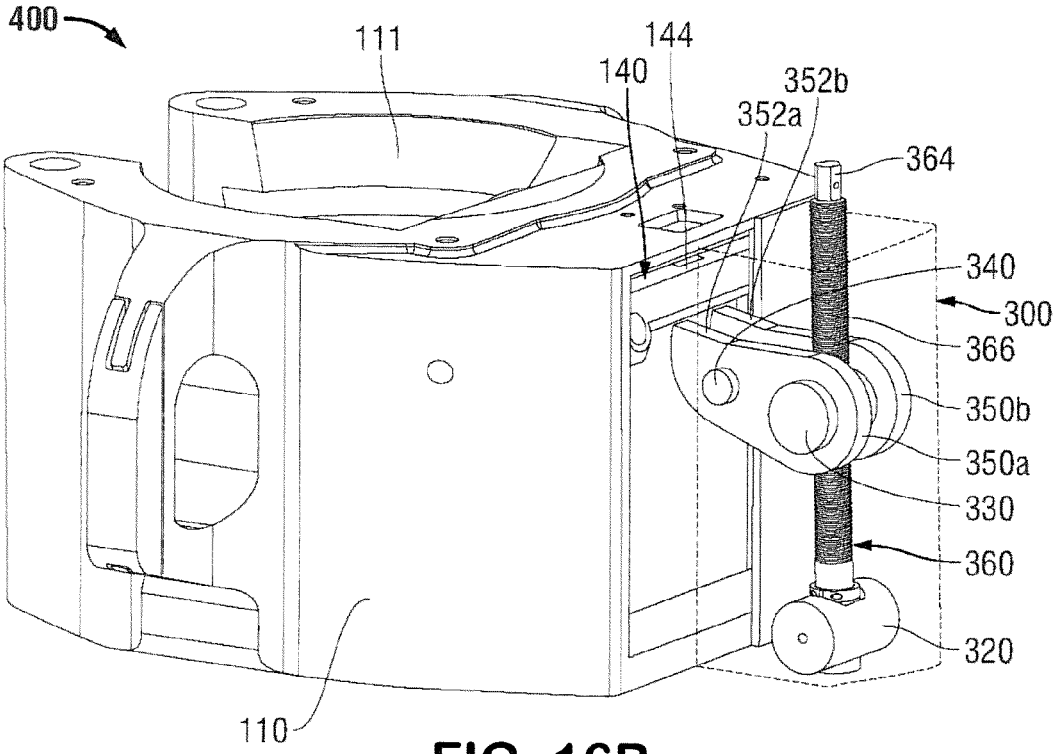
FIG. 16B depicts an isometric rear side view of an embodiment of the safety screw clamp apparatus usable within the scope of the present disclosure, shown without the screw clamp apparatus housing.

Referring now to FIG. 16B, a hexagonal head ((364), also shown in FIG. 16A) can be engaged with an automatic torque wrench or other appropriate wrench (not shown) to rotate the jack screw (360) to translate or move the cylindrical nut (330) in the downward direction along the jack screw (360). As the cylindrical nut (330) moves downward, the lever arms (350A, 350B) can pivot about the pivot pin (340) to move the lifting surfaces (352A, 352B) upward for making contact with the yoke (140). FIG. 16B depicts the cylindrical nut (330) positioned lower along the threaded portion (366) of the jack screw (360) and the lifting surfaces (352A, 352B) of the lever arms (350A, 350B), which can be in contact with the yoke (140). As the jack screw (360) is rotated further, an increasing amount of upward force is applied to the central arm portion (144) of the yoke (140), resulting in an increasing amount of downward force that results in a gripping force being transferred to the slips (130*a-c*, not shown but depicted in FIG. 4). Once the desired gripping force of the slips is reached, the operator can stop applying torque to the jack screw (360). In another embodiment (not shown) of the screw clamp (300), an automated (e.g., electrical, pneumatic, hydraulic, etc.) wrench can be incorporated into, or mounted onto, the screw clamp; and thereafter, the torqueing operations can be initiated automatically by a computerized controller. Alternatively, the torqueing operations can be manually initiated and/or remotely initiated by an operator, who, for example, presses a button or moves a lever to initiate the torqueing operations.

In an embodiment, the spider assembly (400), as shown in FIGS. 16A and 16B, can act like or be used as a backup tong, wherein the slips (130*a-c*) of the spider (400) can be set and used for gripping and holding a joint of pipe (5). In addition, after the slips (130*a-c*) of the spider assembly (400) are set, a screw clamp apparatus (300) can be actuated to provide additional gripping force to the slips (130*a-c*) of the spider assembly (400). In such embodiments, the spider assembly can be used in conjunction with an elevator assembly (100, 200), with an automatic slip setting apparatus (10), for forming a system to enable the threading or unthreading of joints of tubulars, during make up or break out operations, respectively.

For example, after a joint of tubulars is made up using the elevator assembly (100, 200) and spider assembly (400), wherein the elevator assembly (100, 200) lifts and positions an upper tubular for connection to a lower tubular or joint of tubulars held by the spider assembly (400), the jack screw (360), of the screw clamp apparatus (300) located on the spider assembly (400), can be rotated in the opposite direction to lower the lifting surfaces (352A, 352B) of the lever arms (350A, 350B), which can relieve the lifting force applied to the yoke (140). Then, the elevator assembly (100, 200) can lift the joint of tubulars, and the slips (130*a-c*) can be reset to the open position, similarly as depicted in FIG. 7B, allowing the joint of tubulars to be lowered into the wellbore. In an alternative embodiment, the spider assembly (400) and screw clamp apparatus (300) can be used with power tongs or a tong system for the threading or unthreading of the joints of tubulars.

Figure 33:
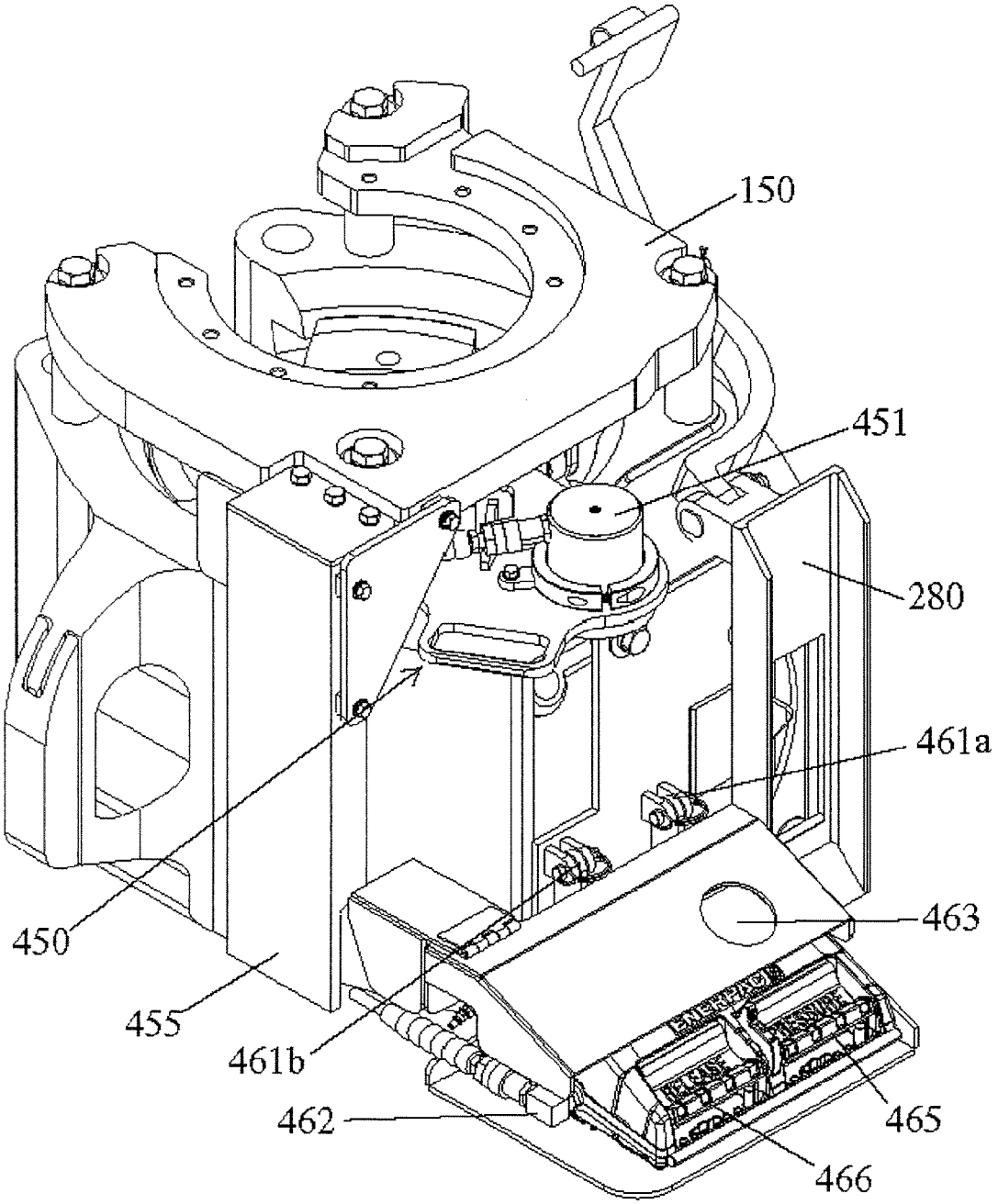
FIG. 33 depicts an isometric view of an embodiment of a spider assembly with a hydraulic safety clamp (e.g., hydraulic cylinder safety clamp), usable within the scope of the present disclosure.
Figure 34B:
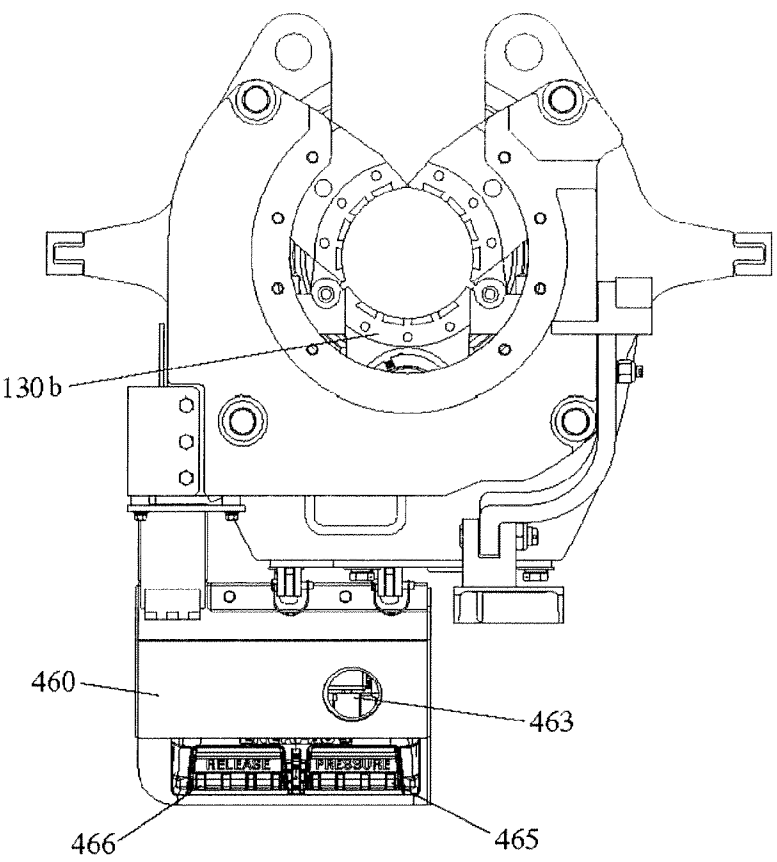
FIG. 34B depicts an isometric view of an embodiment of the hydraulic safety clamp, usable within the scope of the present invention, showing the hydraulic safety clamp in an engaged position.
Figure 34A:
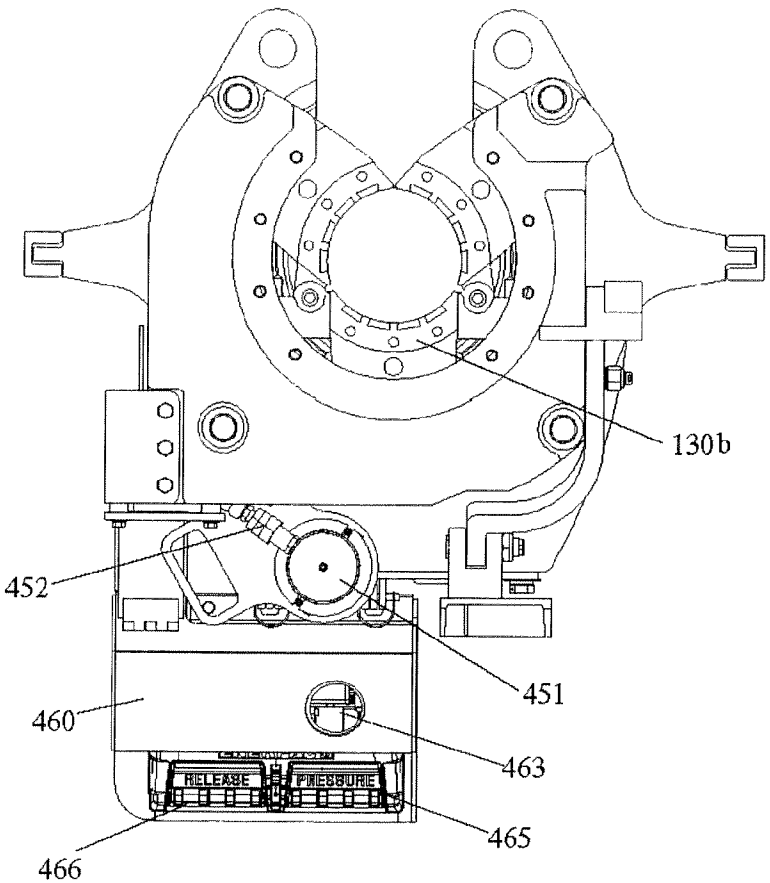
FIG. 34A depicts an isometric view of an embodiment of the hydraulic safety clamp, usable within the scope of the present invention, showing the hydraulic safety clamp in a disengaged position.
Figure 35:
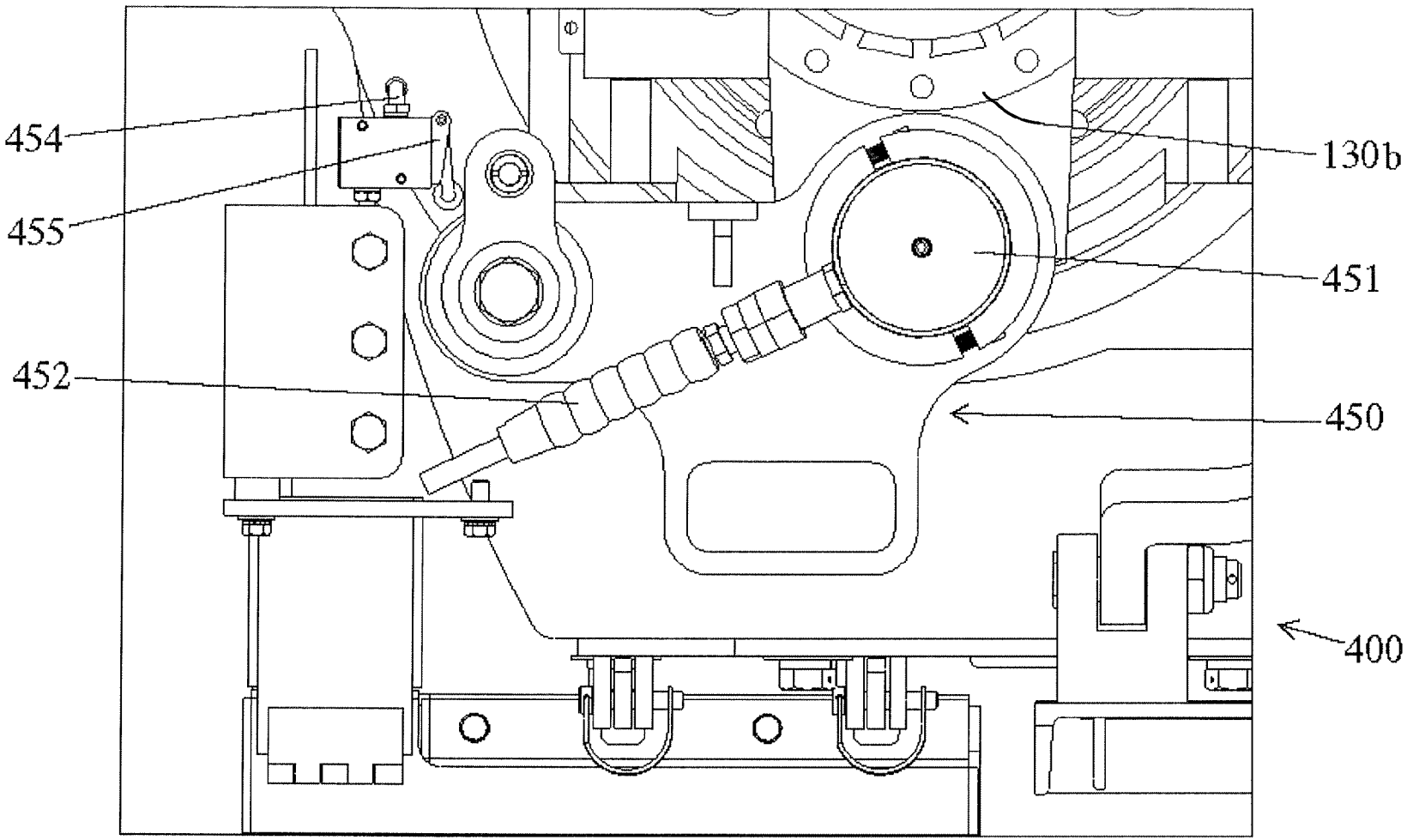
FIG. 35 depicts an isometric view of an embodiment of the hydraulic safety clamp, usable within the scope of the present invention, showing the hydraulic safety clamp in an engaged position, without the upper guard.

Another embodiment of the spider assembly (400), having utility as a backup tong, is depicted in FIGS. 33-35. As depicted in these Figures, the spider assembly (400) can include replacing the safety screw clamp apparatus with a hydraulic safety clamp (450) apparatus, which can exert force onto the middle slip (130*b*) of the spider assembly (400), thereby increasing the gripping force of the spider assembly (400) and effectively locking the slips (130*a-c*) into a closed position.

Referring now to FIG. 33, the hydraulic safety clamp (450) is depicted in a pivotable relationship with an upper guard post (151B) of an upper guard (150). Alternatively, the hydraulic safety clamp (450) can be positioned in line with the middle slip (130*b*) by use of linear movement, rather than pivotable movement about the upper guard (150). For example, a set of rails (not shown) can be attached to the underside of the top guard (150) for enabling the hydraulic safety clamp (450) to slide or move in and out with linear motion, for positioning the hydraulic safety clamp (450) in line with the middle slip (130*b*). As depicted, the hydraulic cylinder safety clamp (450) can be actuated by a foot pedal pump (460), which can be located rearward of, and attached to, a cover plate (280) via two pad eyes (461A, 461B). The foot pedal pump (460), as shown, can be pneumatic-over-hydraulic and can comprise a connection to a regulated air supply (462) as well as a pressure gauge (463) used to determine the clamping force exerted by the hydraulic cylinder safety clamp (450). Alternatively, the foot pedal pump (460) pressure can be set by a regulator (not shown). The foot pedal pump (460) can comprise a pressure pedal (465) and can include a release pedal (466). The fluid connections between the foot pedal (460) and the hydraulic cylinder safety clamp (450) can be protected by a hose guard (453), which can run downward and/or along the side of the spider assembly (400).

Referring now to FIGS. 34A and 34B, the hydraulic cylinder clamp (450) is depicted in a disengaged position in FIG. 34A and an engaged position in FIG. 34B. When the foot pedal pump (460, depicted in FIG. 33) is activated, a spring plunger (452) can rotate the hydraulic cylinder safety clamp (450) until it reaches the top of the middle slip (130*b*), at which point the cylinder body (451) can begin to move upwards until it makes contact with the underside of the upper guard (150). Once contact is made, the hydraulic cylinder clamp can exert pressure downwards onto the middle slip (130*b*) of the spider assembly (400). When a pre-determined load is reached on the middle slip (130*b*), the pressure pedal (465) of the foot pedal pump (460) can be released. Once the spider assembly (400) is prepared to transfer the tubular string weight, the release pedal (466) can be pressed and the spring plunger (452) of the hydraulic cylinder clamp (450) can retract.

Referring now to FIG. 35, the hydraulic cylinder clamp (450) is shown in further detail in the engaged position, but with the upper guard (150) not depicted for clarity. In order to prevent the hydraulic cylinder safety clamp (450) from being actuated when in the disengaged position, an interlock valve (454) is configured to allow air to flow through a connection (462, depicted in FIG. 33) to the foot pedal pump (460, as depicted in FIG. 33), and only when the hydraulic cylinder safety clamp (450) is fully inserted into the body of the spider assembly (400) and pressing the valve plunger (455) on the front face of interlock valve (454). Unless the valve plunger (455) is actuated, the interlock valve (454) will not open and will not permit air to flow through the connection (462) to the foot pedal pump (460).

Figure 18:
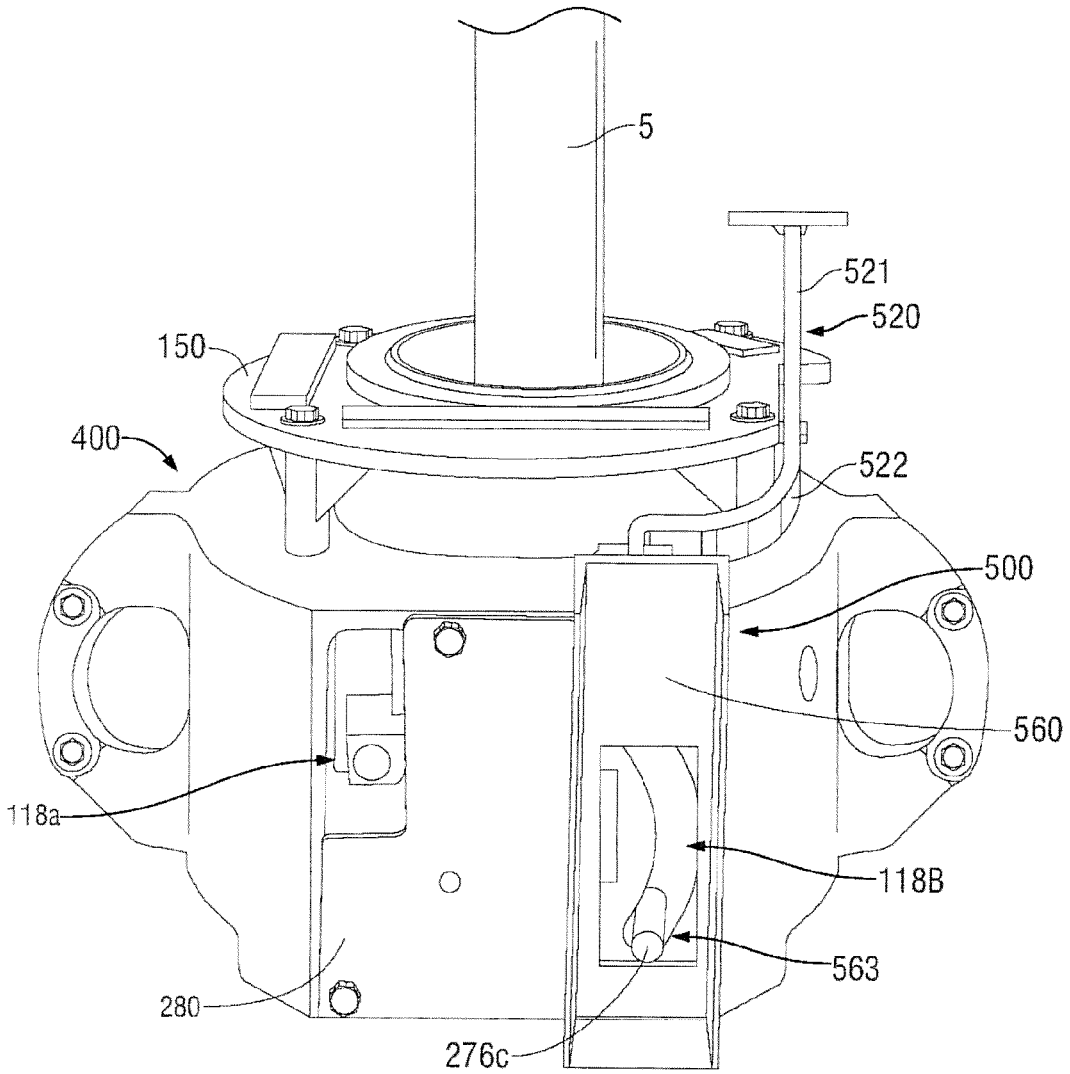
FIG. 18 depicts an elevated back view of a spider assembly with an automatic slip setting apparatus usable within the scope of the present disclosure.

Referring now to FIG. 18, the Figure depicts an elevated back view of the spider assembly (400) with an automatic slip setting apparatus (500) usable within the scope of the present disclosure. The spider assembly (400), depicted in FIG. 18, can be structurally and functionally similar to the spider assembly (400) described above and can comprise the same or similar components as described above.

The automatic slip setting apparatus (500) of the present disclosure can be used to automatically set a plurality of slips (130*a-c*, not shown but depicted in FIG. 4) of the spider assembly (400) about a joint of pipe (5) as the pipe string is lowered into the wellbore through the central cavity (111, shown in FIG. 16B) of the spider assembly (400). Using the automatic slip setting apparatus (500) can, for example, speed the pipe tripping operations by automating the slip setting process. Also, the automatic slip setting apparatus (500) can set the slips of the spider assembly at the proper position each time the pipe string is lowered, thus reducing or eliminating improper slip engagement caused by human error.

FIGS. 18 and 20-23 show an embodiment of a spider assembly (400) with an automatic slip setting apparatus (500) comprising an arm (520) pivotally connected to one side of the upper guard (150) of the spider assembly (400), with a pivot pin (525) extending through the arm (520). The arm (520) is depicted as a generally rectangular bar having a first portion (521) oriented at an obtuse angle with respect to the second portion (522), wherein the obtuse angle is formed along a vertical plane, and wherein the transition between the first and second portions (521, 522) is located adjacent to the pivot pin (525). As shown, the end of the first portion (521) of the arm (520) comprises a contact member (530, shown in FIGS. 20 and 23), depicted as a cross bar. The second portion (522) of the arm (520) is shown curving toward the center of the spider assembly (400), wherein the curve is formed along a horizontal plane. The end of the second portion (522) is pivotally connected with a trip arm (560) by a clevis type pivot connection (528).

Figure 20:
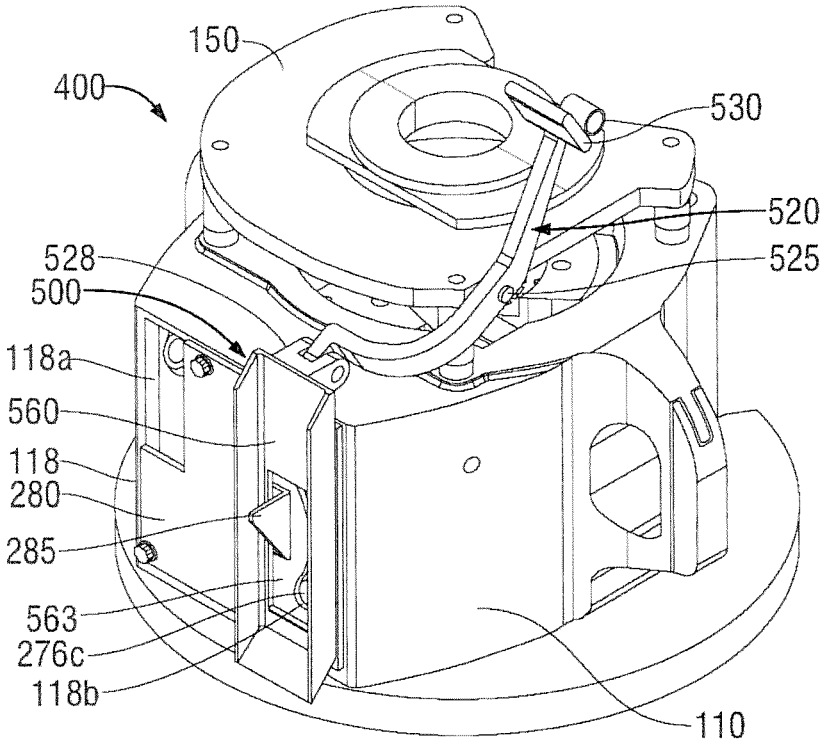
FIG. 20 depicts an isometric view of a spider assembly with an automatic slip setting apparatus usable within the scope of the present disclosure, showing the arm in the upward position.
Figure 21:
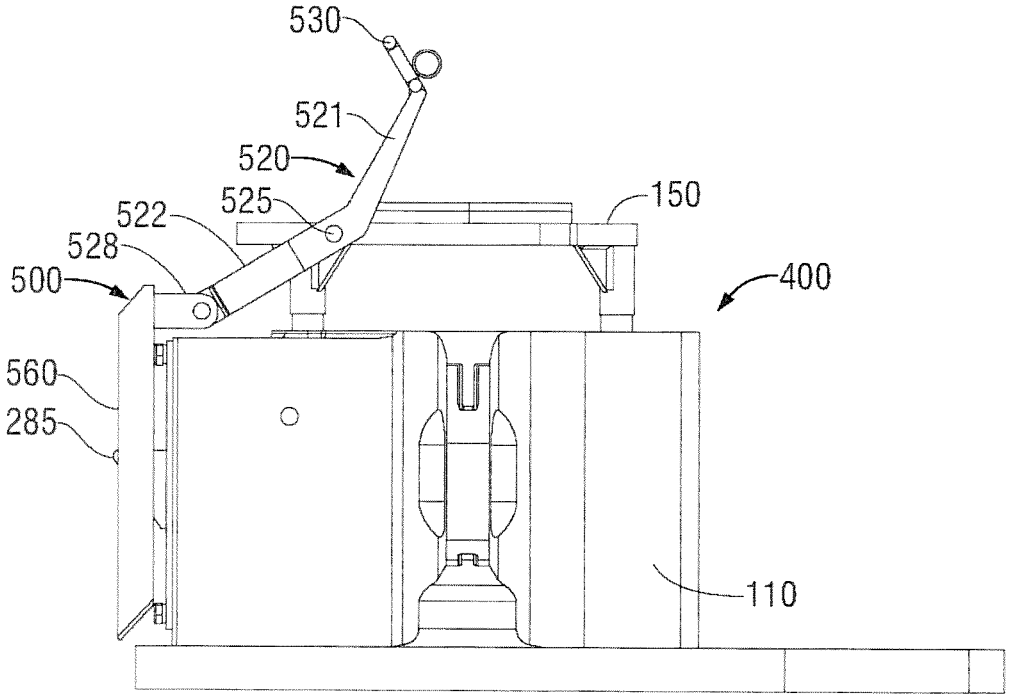
FIG. 21 depicts a side view of a spider assembly with an automatic slip setting apparatus usable within the scope of the present disclosure, showing the arm in the upward position.
Figure 22:
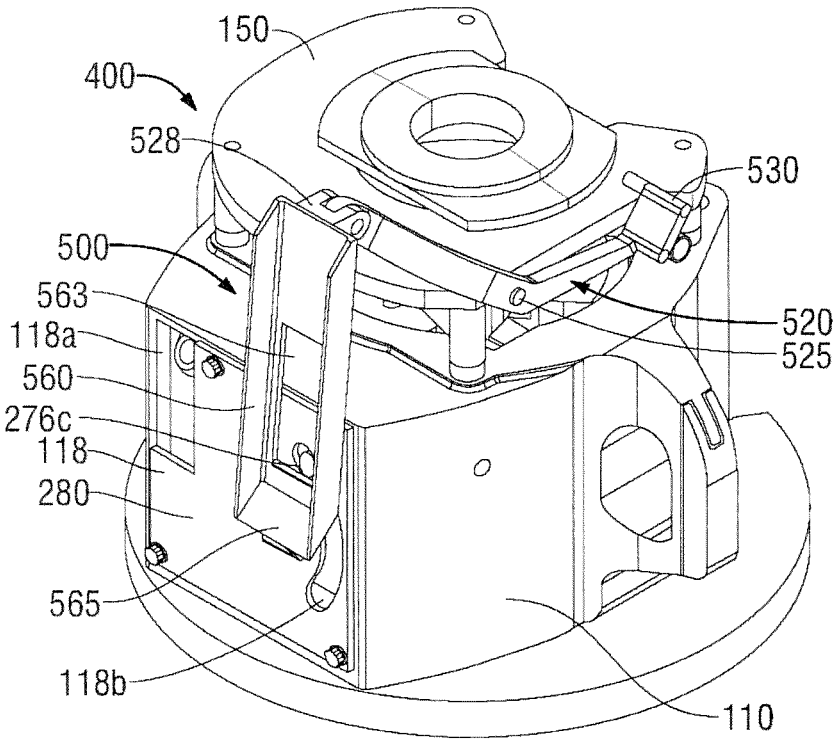
FIG. 22 depicts an isometric view of a spider assembly with an automatic slip setting apparatus usable within the scope of the present disclosure, showing the arm in the downward position.
Figure 23:
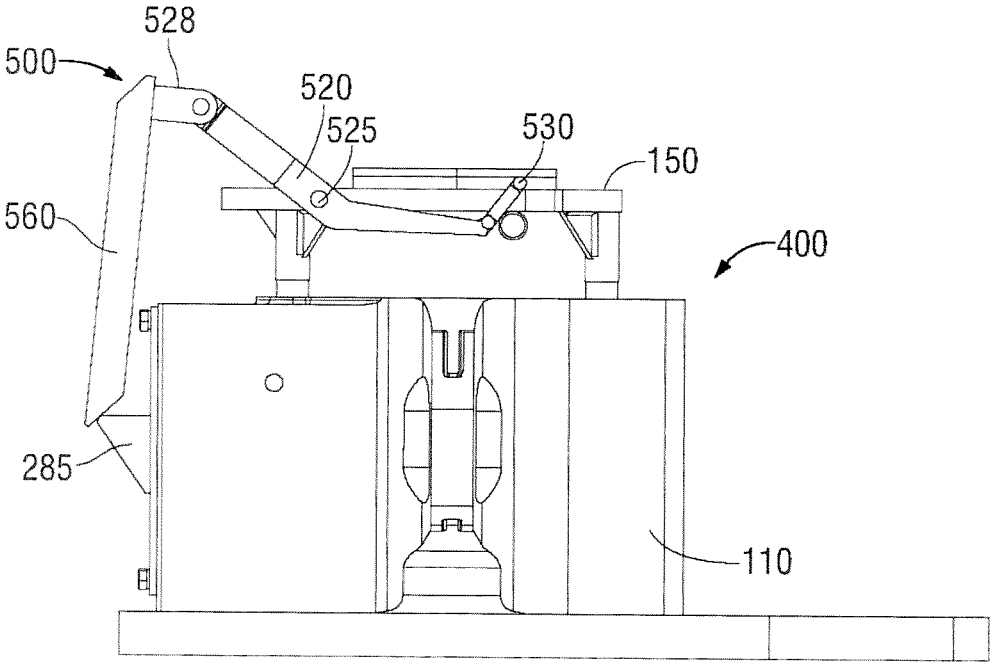
FIG. 23 depicts a side view of a spider assembly with an automatic slip setting apparatus usable within the scope of the present disclosure, showing the arm in the downward position.

FIGS. 20-23 further show the trip arm (560) as a channel beam having a C-shaped configuration, which extends downward along the rear cavity (118) of the main body (110). The Figures show the trip arm (560) comprising a rectangular opening (563), which allows a portion of a lever (276C) of a yoke locking assembly (270, see FIG. 11) to extend therethrough and to move vertically therein. FIGS. 18, 20 and 22 further show a cover plate (280) usable for partially enclosing the rear cavity (118) while leaving two areas (e.g., open spaces), referred to as windows (118A, 118B), unobstructed. FIGS. 20, 21 and 23 also show a wedge-shaped protrusion, referred to as a ramp (285), extending laterally from the cover plate (280) and through the opening (563, also shown in FIG. 18) in the trip arm (560). In the reset or un-actuated position of the automatic slip setting apparatus (500), as shown in FIGS. 20 and 21, the first portion (521) of the arm (520) can extend diagonally upwards and is in position for contact by an elevator.

Figure 19:
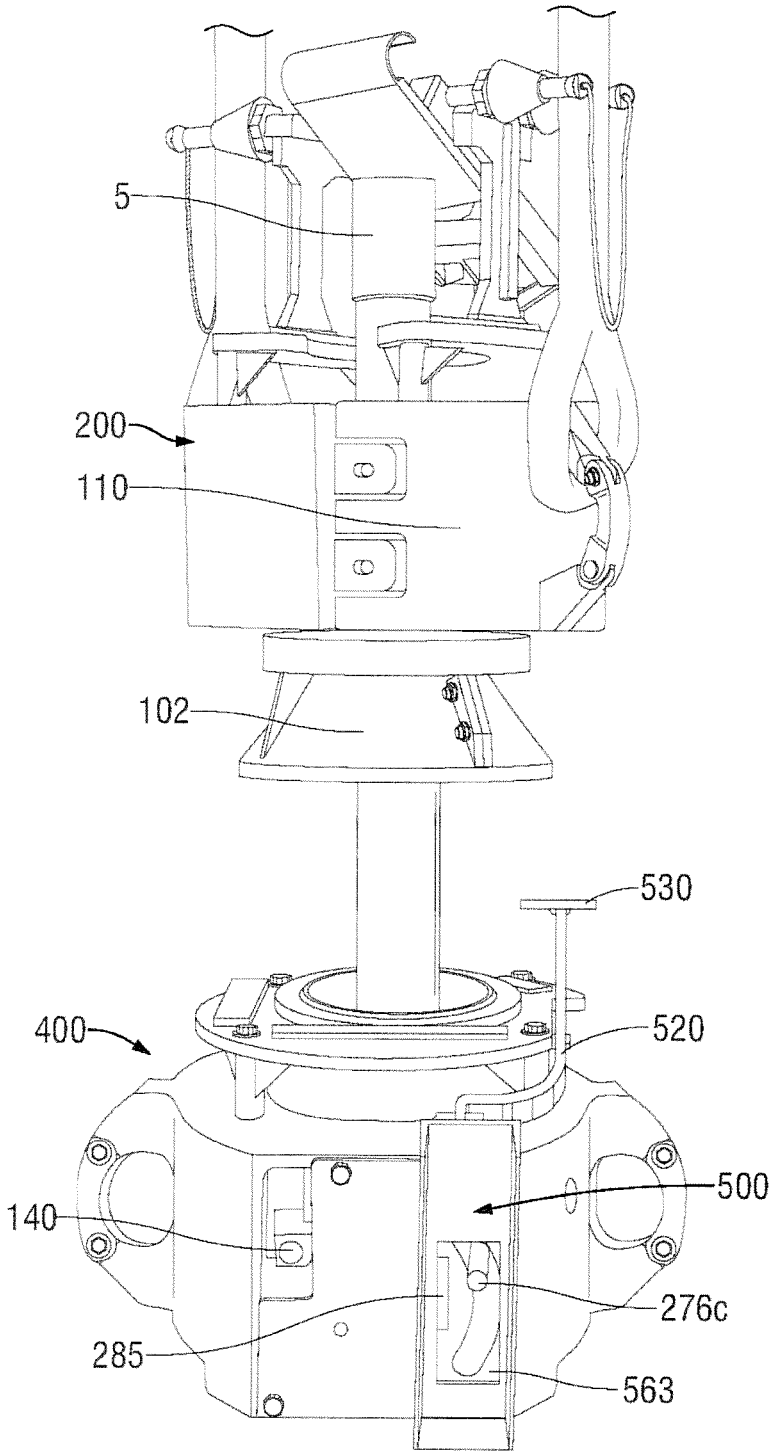
FIG. 19 depicts an elevated back view of an embodiment of an elevator assembly and a spider assembly with an automatic slip setting apparatus usable within the scope of the present disclosure.

Referring also to FIG. 19, the Figure shows a system comprising an elevator assembly (200) and a spider assembly (400). The elevator assembly (200) is shown lowering a joint of pipe (5) or a pipe string into the wellbore (not shown) through the spider assembly (400). As the elevator assembly (200) is lowered, the bell guard (102), connected to the bottom of the main housing (110), can make contact with the contact member (530) of the pivoting arm (520). As the elevator assembly (200) continues to be lowered against the contact member (530), the arm (520) pivots about the pivot pin (525, shown in FIGS. 20-23) to raise the second portion (522, shown in FIGS. 18 and 21) of the arm (520) and the trip arm (560, shown in FIGS. 20-23).

As the trip arm (560) continues to move upward, the lower edge of the opening (563) can engage the rocker lever (276C), which can extend through the opening (563). As the arm (520) continues to pivot, the trip arm (560) can move the lever (276C) to the upward position to unlock the yoke (140), which allows the slips (130*a-c*, shown in FIG. 4) to descend and engage the joint of pipe (5). If the trip arm (560) moves farther in the upward direction, the ramp (285) can move the trip arm (560) away from the main body (110) when the lower edge of the opening (563) contacts the ramp (285). Therefore, the ramp (285) can allow the trip arm (560) to be lifted above the lever (276C) without physically interfering with or damaging the lever (276C). Later, when the trip arm (560) moves downward, the outwardly sloping bottom surface (565, shown in FIG. 22) can make contact with the ramp (285) and/or the lever (276C) to move the trip arm (560) away from the main body (110) and over the lever (276C).

Once the spider assembly slips (130*a-c*) are closed and locked about the outer surface of the joint of pipe (5), the entire weight of the pipe string (not shown) in the wellbore can be supported by the spider assembly (400). Thereafter, the slips (130*a-c*) of the elevator assembly (200) can unlocked and disengaged, and the elevator assembly (200) can be disengaged from the joint of pipe (5) and moved to another location in preparation for a subsequent joint of pipe and lowering of the pipe string.

Once the subsequent joint of pipe is made up with the pipe string that is supported by the spider assembly (400), the elevator assembly (200) can engage the subsequent joint of pipe and partially lift the pipe string, allowing the spider slips (130*a-c*) to be reset to the open position, as similarly depicted in FIG. 7B. The automatic slip setting apparatus (500) can be reset by manually moving the lever (276C) and, then, the yoke (140) to the downward position. The yoke (140) can be shifted downward by inserting a hand lever (not shown) into the yoke cavity (141), and the hand lever can be used to force the yoke (140) in a downward direction to lift the slips (130*a-c*). Once the spider slips (130*a-c*) are open, the elevator (200) can be lowered to move the pipe string further down the wellbore. The above process can be repeated until the desired length of pipe (e.g., number of joints of pipe) is run into the wellbore.

Referring now to FIGS. 24A, 24B, 25 and 26, the Figures depict a top guide assembly (600) ("top guide") that can be usable with an embodiment of a spider assembly (400), within the scope of the present disclosure. The embodiment of the spider assembly (400), depicted in FIGS. 24A, 24B, 25 and 26, can be structurally and functionally similar to the spider assembly (400) described above and can comprise the same or similar components as described above.

The top guide (600) depicted in FIGS. 24A, 24B, 25 and 26 can be used to center an elevator assembly (200) above the spider assembly (400) during the lowering of a pipe string (4). More specifically, the top guide can be used to concentrically align the central cavity (111) of the elevator assembly (100, 200) with the central cavity (111) of the spider assembly (400) as the pipe string (4) is lowered into the wellbore (not shown) through the central cavity (111) of the spider assembly (400). Using the top guide (600), to align the elevator assembly (200) and the spider assembly (400), can, for example, prevent or reduce improper engagement of the spider assembly slips (130*a-c*, see FIG. 4) about the upper joint of pipe (5) as the pipe string (4) is being lowered into the wellbore.

Furthermore, the top guide (600) can be used when, for example, centralizers (not shown) are being implemented and a portion of a guide plate (170, depicted in FIG. 26) is displaced. Specifically, for a centralizer to pass through the guide plate (170) of a spider assembly (400), a portion of the guide plate (170) may be displaced or moved to allow the centralizer to pass through the guide plate (170). After such displacement, the joint of pipe (5) retained by the elevator assembly (200), may have additional space to sway from a point of alignment with the spider assembly (400). If the elevator assembly (200) and the spider assembly (400) are not properly aligned when the bell guide (102) triggers the automatic slip setting apparatus (500, see FIG. 28), the slips (130*a-c*) of the spider assembly (400) may not properly set about the joint of pipe (5). Often times, if the slips (130*a-c*) are not properly set, personnel were required to manually push the elevator (200) into alignment with the spider (400) to achieve proper slip positioning or to release the slips (130*a-c*) and attempt to reset the slips about the joint of pipe (5).

Figure 24A:
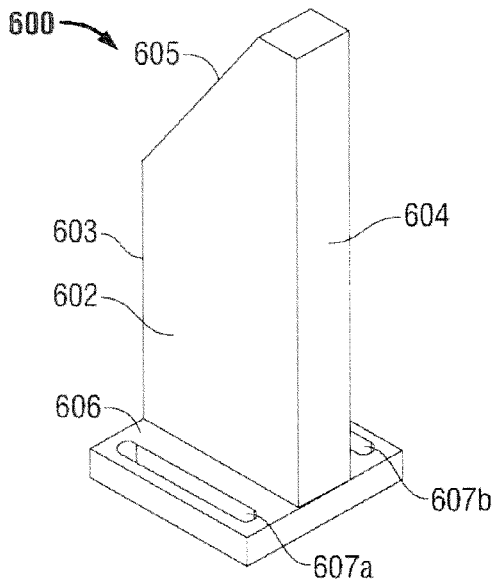
FIG. 24A depicts a rear isometric view of an embodiment of a top guide usable within the scope of the present disclosure.
Figure 24B:
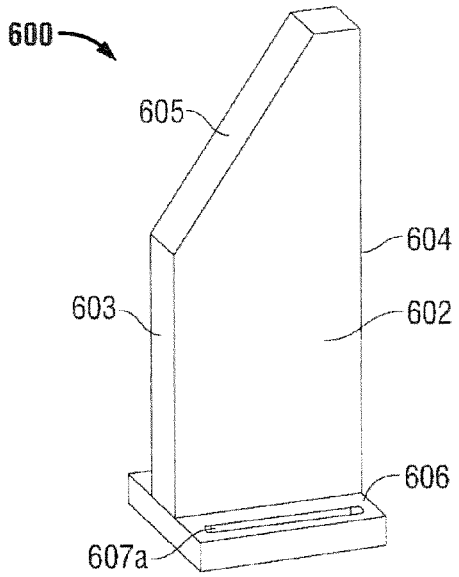
FIG. 24B depicts a front isometric view of an embodiment of a top guide usable within the scope of the present disclosure.
Figure 25:
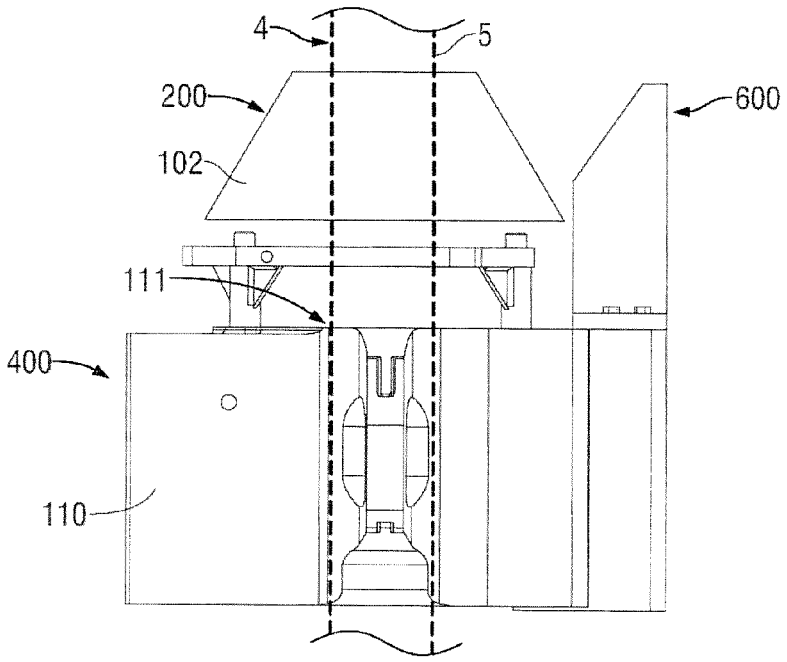
FIG. 25 depicts a side view of an embodiment of a spider assembly and a top guide usable within the scope of the present disclosure.
Figure 26:
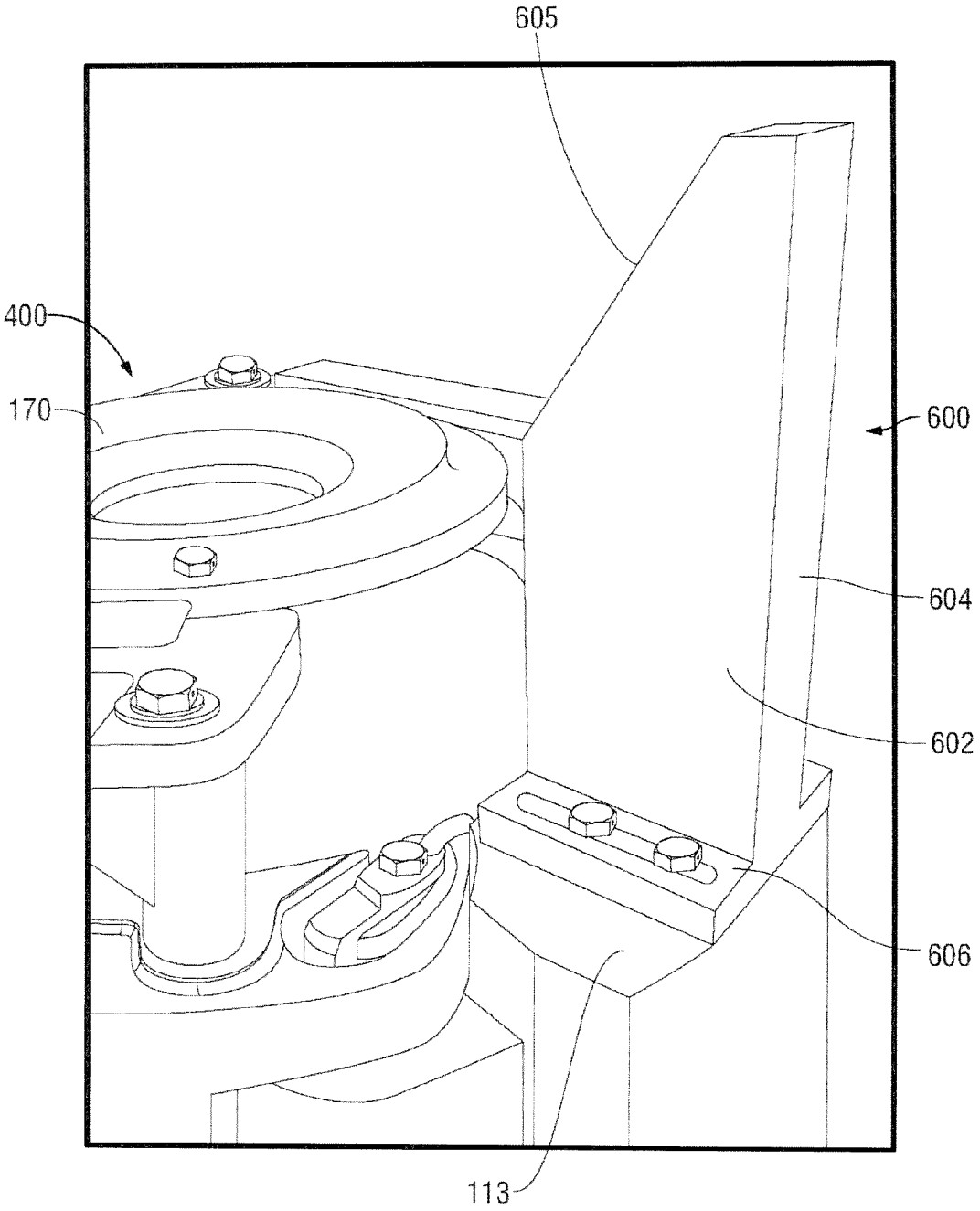
FIG. 26 depicts an isometric view of an embodiment of a spider assembly and a top guide usable within the scope of the present disclosure.

Referring now to FIGS. 24A, 24B, and 26, the Figures depict isometric front and rear views of the top guide (600) and to FIG. 25, depicting a side view of a spider assembly (400) with the top guide (600) connected thereon. Specifically, the Figures depict the top guide (600) comprising a vertical plate (602) with a diagonal edge (605) sloping downwardly in the direction of the joint of pipe (5) and/or the central cavity (111). The diagonal edge (605) is further shown extending diagonally with respect to the inward and the outward edges (603, 604) of the vertical plate (602). The vertical plate (602) is shown in connection with a base plate (606), which can have a generally square or rectangular configuration. The base plate (606) can comprise a plurality of elongated holes or slits (607A, 607B), which can be adapted to accept a plurality of bolts therethrough and to allow adjustable connection between the top guide (600) and the spider (400). As depicted in FIG. 26, the top guide (600) can be connected to the spider door (113). As FIGS. 24A, 24B, 25 and 26 depict one embodiment of the top guide (600), it should be understood that the base plate (606) can be connected to the spider door (113) by any type and number of connectors, welding, and/or by any other means known in the art.

Referring now to FIG. 25, during operations, as the elevator assembly (200) descends toward the spider assembly (400) and lowers the pipe string (4) into the wellbore, the guide (102) of the elevator assembly (200), which typically comprises a bell shape; however, those skilled in the art could utilize other shapes with regard to the guide for the elevator assembly (bell guide), can contact the diagonal edge (605) of the top guide (600) to push and/or direct the elevator assembly (200) into alignment with the spider assembly (400). Specifically, as the elevator assembly (200) descends toward the spider assembly (400), the bell guide (102) can slide along the diagonal edge (605) of the top guide (600) to move the elevator assembly (200) into alignment with the spider assembly (400). The top guide (600) may be used in combination with the automatic slip setting apparatus (500, see FIGS. 22 and 23), whereby the top guide (600) can move the elevator assembly (200) into alignment with the spider assembly (400) prior to the bell guide (102) engaging the automatic slip setting apparatus (500) to set the slips (130*a-c*) about the joint of pipe (5). The top guide (600) can ensure that proper alignment between the central cavity (111, see FIG. 4) of the elevator assembly (200) and the central cavity (111) of the spider assembly (400) is maintained as the slips (130*a-c*) of the spider assembly (400) are set, enabling the slips (130*a-c*) of the spider assembly (400) to fully and properly set without any intervention by personnel.

Figure 27:
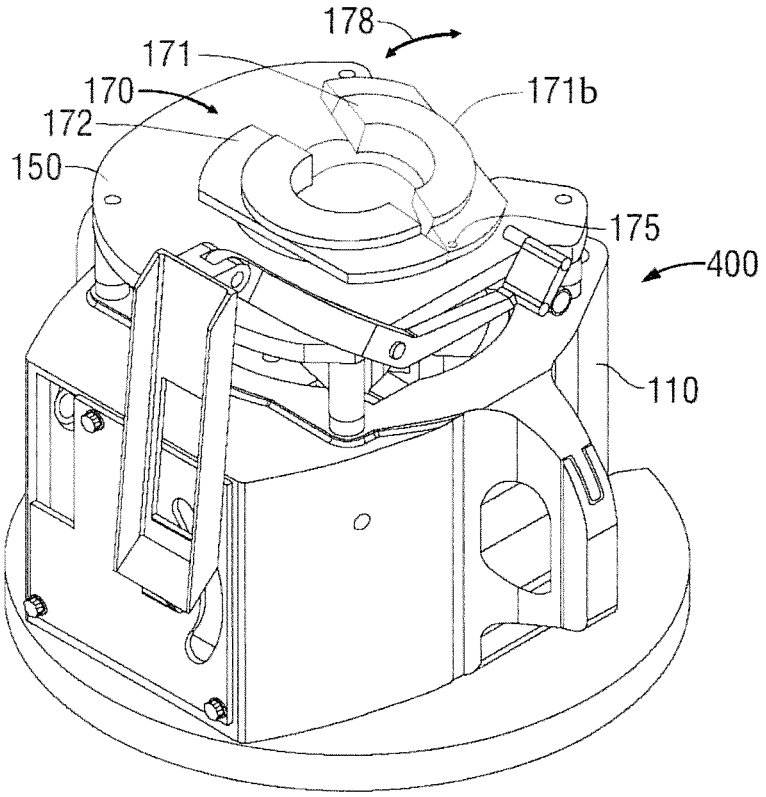
FIG. 27 depicts an isometric view of an embodiment of a spider assembly with an automatic slip setting apparatus usable within the scope of the present disclosure, including a guide plate.
Figure 28:
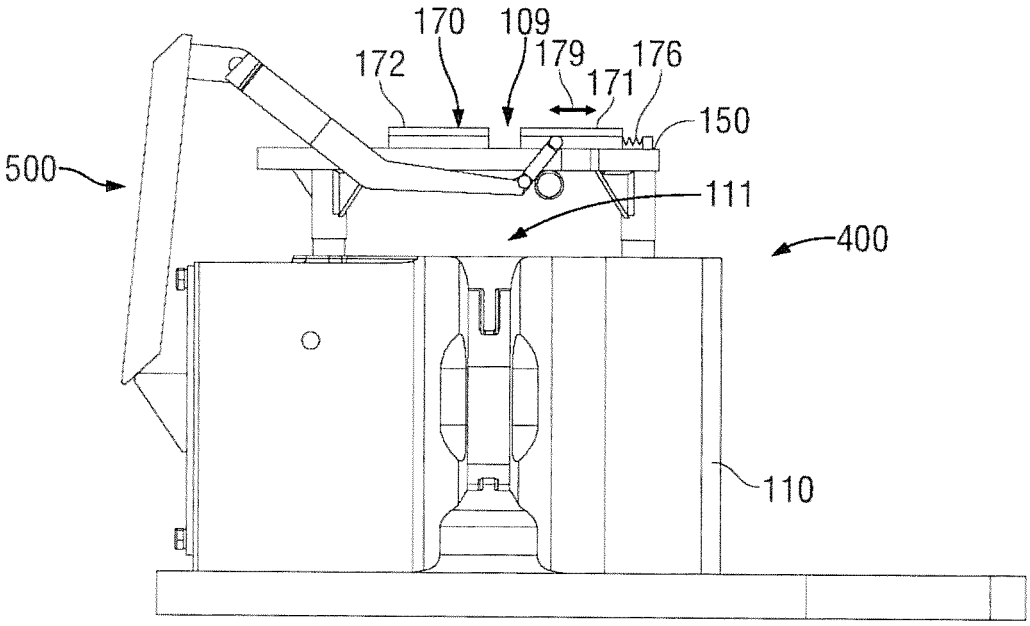
FIG. 28 depicts a side view of an embodiment of a spider assembly with an automatic slip setting apparatus usable within the scope of the present disclosure, including a guide plate.

As stated previously, if a centralizer or any other item is positioned along the outer diameter of a joint of pipe (5), a joint of casing, or any other tubular, a portion of the guide plate (170, as shown in FIG. 26) may be displaced or moved away from the other portion(s) of the guide plate (170) to allow the centralizer or other item to pass through the central cavity (109, shown in FIGS. 27 and 28) of the guide plate (170) of a spider assembly (400). Referring now to FIGS. 27 and 28, the Figures depict an isometric and a side view of an embodiment of a spider assembly (400) usable within the scope of the present disclosure. FIGS. 27 and 28 depict a spider assembly (400) comprising an upper guard (150) connected to a body (110) of the spider assembly (400), as previously described. FIG. 27 depicts the guide plate (170) positioned over the central cavity (109) of the upper guard (150) to adapt the size of the central cavity (109) to accommodate and guide the movement of the joint of pipe (5), the joint of casing, or any other tubular being passed through the spider assembly (400). The guide plate (170) can be retained in connection with the upper guard by bolts, brackets, retainer pins (not shown), or by any other means known in the art.

In the embodiment of the spider assembly (400) depicted in FIGS. 27 and 28, the guide plate (170) can comprise a first guide plate portion (171) and a second guide plate portion (172), wherein the first guide plate portion (171) and the second guide plate portion (172) are separable from each other. The first guide plate portion (171) can comprise a pivot pin (175) extending through one end of the first guide plate portion (171) to allow the first guide plate portion (171) to pivot away from the second guide plate portion (172), for increasing the size of the central cavity (109) (e.g., the space between the first and second guide plate portions (171, 172)). FIG. 27 further depicts the first guide plate portion (171) in a pivoted position (171B). The first guide plate portion (171) can comprise a torsion spring (176, depicted in FIG. 28) for biasing the first guide plate portion (171) toward the second guide plate portion (172). As the centralizer passes through the central cavity (109), the centralizer can contact and push the inner edges of the first and second guide plate portions (171, 172), overcome the biasing force of the spring, pivot the first guide plate portion (171) away from the second guide plate portion (172), and pass through the central cavity (109). Once the centralizer passes through the expanded central cavity (109), the spring can retract the first guide plate portion (171) against the second guide plate portion (172) to maintain the joint of pipe (5) properly aligned within the central cavity (111) of the spider assembly (400). In another embodiment (not shown) of the spider assembly (400), the first guide plate portion (171) may be actuated by a hydraulic, pneumatic, or electrical actuator (not shown), which can be used to pivot the first guide plate portion (171) away from and/or toward (178) the second guide plate portion (172), as the centralizer passes through the central cavity (109). The pivoting means may include a combination of the actuator and the torsion spring to pivot the first guide plate portion (171) away from and toward (178) the second guide plate portion (172).

In another embodiment of the spider assembly (400), as depicted in FIG. 28, the first guide plate portion (171) may translate away from the second guide plate portion (172) as the centralizer passes through the central cavity (109), pushing the first guide plate portion (171) away from the second guide plate portion (172). Once the centralizer passes through the expanded central cavity (109), a spring (176) can translate the first guide plate portion (171) to its original or retracted position against the second guide plate portion (172) to maintain the joint of pipe (5) in proper alignment within the central cavity (111) of the spider assembly (400). In another embodiment (not shown) of the spider assembly (400), the first guide plate portion (171) may be actuated by a hydraulic, pneumatic, or electrical actuator (not shown) to translate the first guide plate portion (171) away from and/or toward (179) the second guide plate portion (172) as the centralizer passes through the central cavity (109). The translating apparatus may include a combination of the actuator and the spring (176) to translate the first guide plate portion (171) away from or toward (179) the second guide plate portion (172).

It should be understood that the embodiments described above are not exhaustive, and other embodiments within the scope of this disclosure may involve a spider assembly (400), in which the second guide plate portion (172), or both the first guide plate portion (171) and the second guide plate portion (172), can pivot and/or translate away from each other as the centralizer passes through the central cavity (109). The first guide plate portion (171) and/or the second guide plate portion (172) can be actuated by a hydraulic, pneumatic, or electrical actuator (not shown) to translate and/or pivot the first guide plate portion (171) and/or the second guide plate portion (172) away from or toward each other as the centralizer passes through the central cavity (109) as described above.

Figure 29:
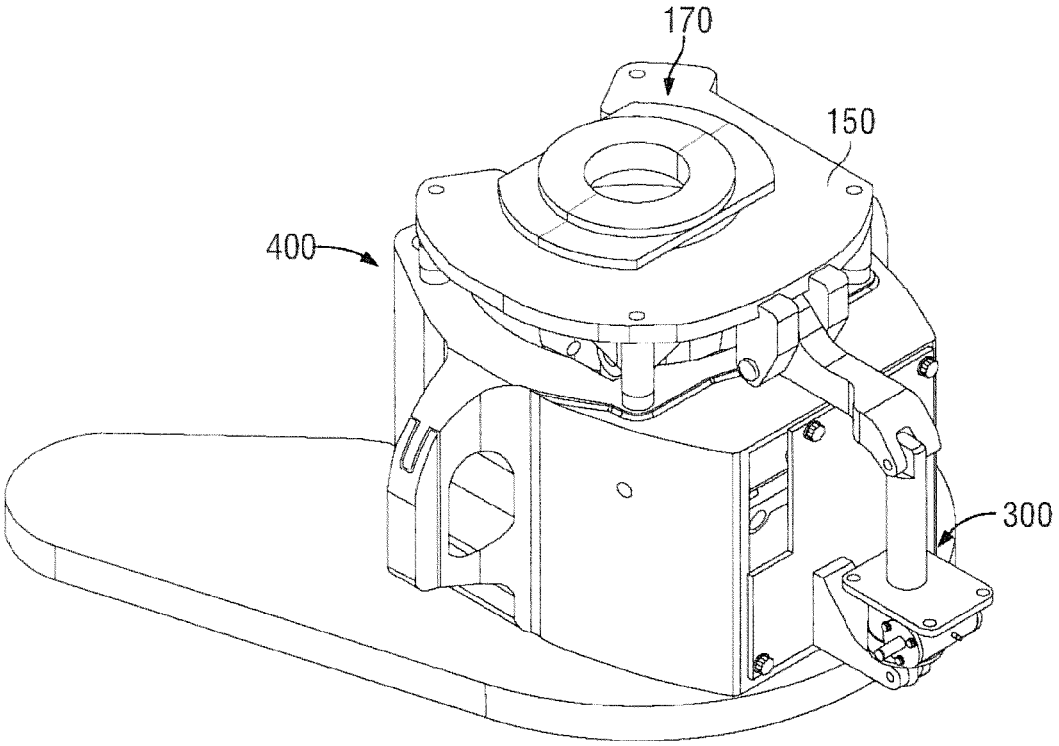
FIG. 29 depicts an isometric view of an alternate embodiment of a safety clamp apparatus usable within the scope of the present disclosure, showing the safety clamp in the retracted position.
Figure 30:
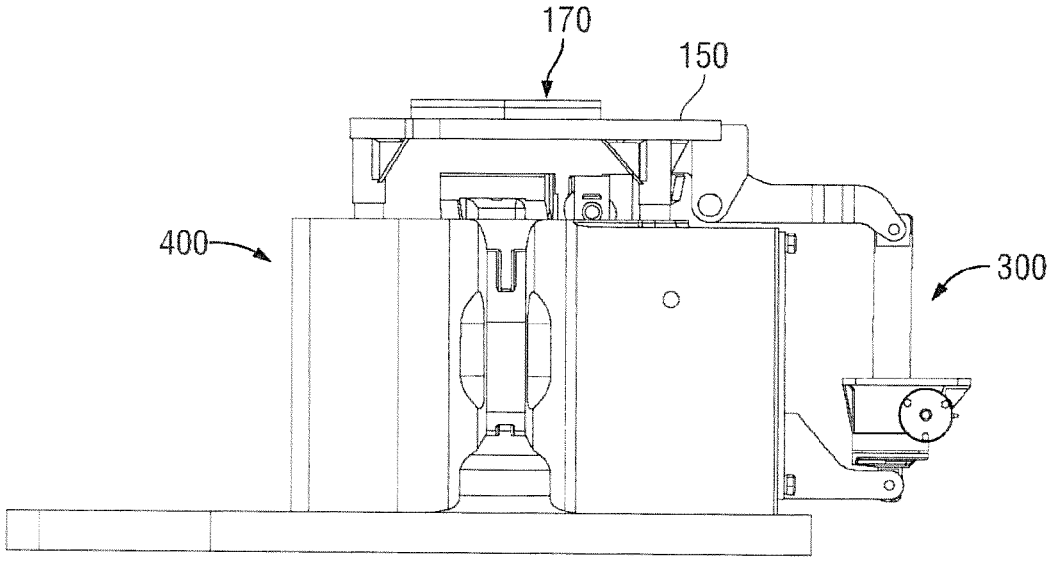
FIG. 30 depicts a side view of an alternate embodiment of a safety clamp apparatus usable within the scope of the present disclosure, showing the safety clamp in the retracted position.

FIGS. 29 and 30 depict an isometric view of an alternate embodiment of a safety screw clamp apparatus (300), usable with a spider assembly (400) that comprises an upper guard (150), connected to a body of the spider assembly (400), and a guide plate (170) positioned over the upper guard (150) to accommodate and guide the movement of a joint of pipe, a joint of casing, or any other tubular being passed through the spider assembly (400). FIGS. 29 and 30 depict the safety screw clamp apparatus (300) in the retracted position.

Figure 31:
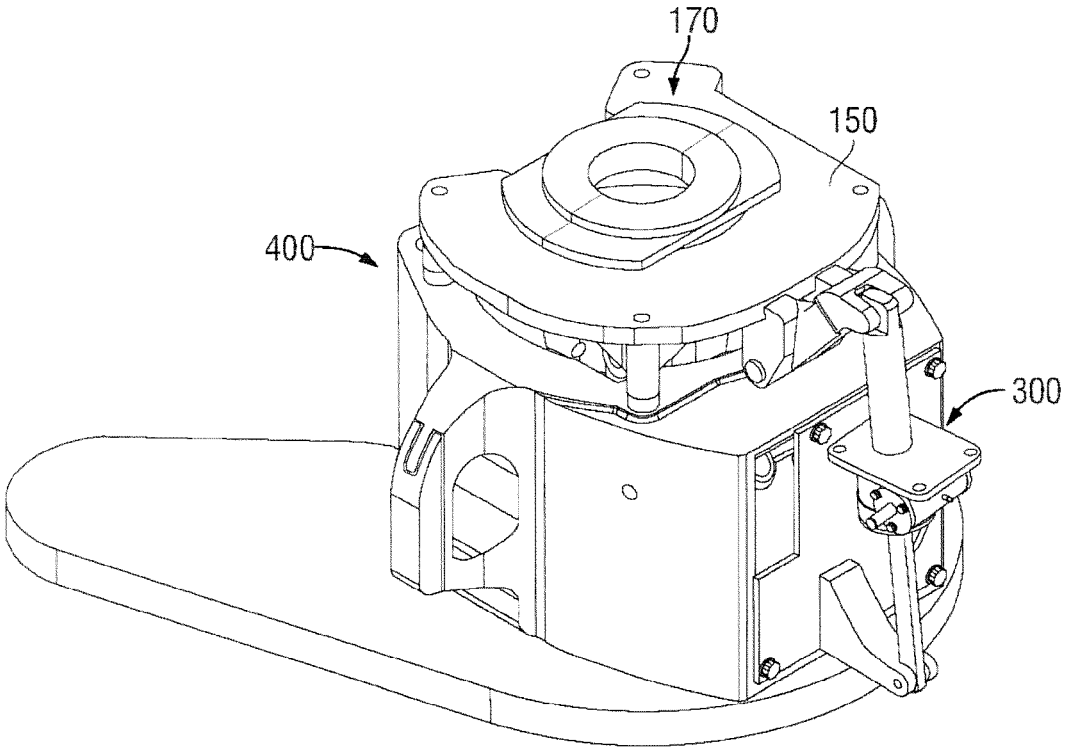
FIG. 31 depicts an isometric view of an alternate embodiment of a safety clamp apparatus usable within the scope of the present disclosure, showing the safety clamp in the extended position.
Figure 32:
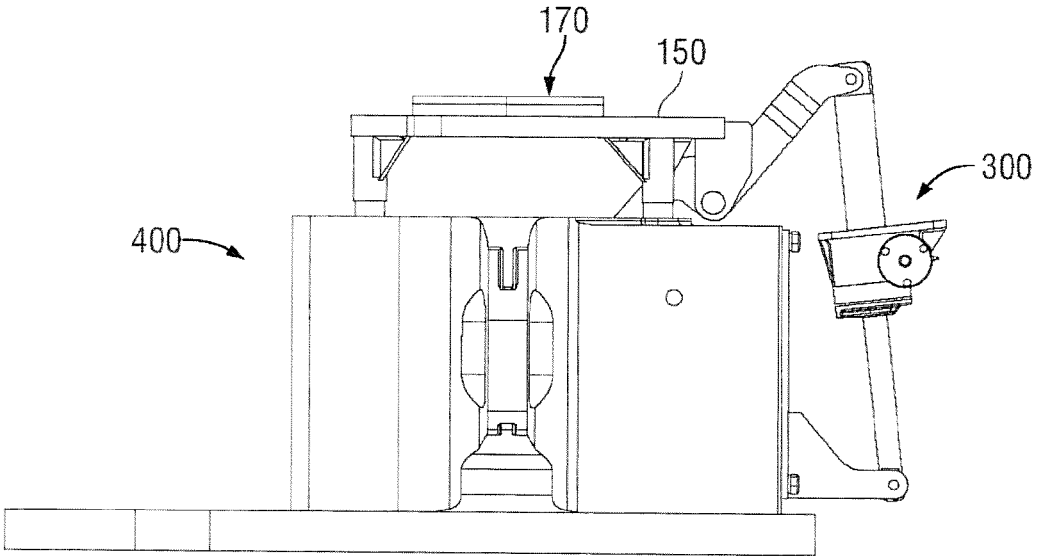
FIG. 32 depicts a side view of an alternate embodiment of a safety clamp apparatus usable within the scope of the present disclosure, showing the safety clamp in the extended position.

FIGS. 31 and 32 depict an isometric view of an alternate embodiment of a safety screw clamp apparatus (300), usable with a spider assembly (400) within the scope of the present disclosure, in which the screw clamp apparatus (300) is shown in the extended position. The spider assembly (400) of FIGS. 31 and 32 further includes an upper guard (150), connected to a body of the spider assembly (400), and a guide plate (170), which comprises a first guide plate portion and a second guide plate portion usable to accommodate and guide the movement of a joint of pipe, a joint of casing, or any other tubular being passed through the spider assembly (400).

Referring now to FIGS. 1-32 in general, it should be understood that while the embodiments of the automatic slip setting apparatuses (10, 210, 500) and the safety screw clamp (300) depict bolts and/or welds usable to integrate and/or connect various subassemblies, components, and/or elements, it should be understood that other embodiments of the automatic slip setting apparatuses (10, 210, 500) and the safety screw clamp (300) are not limited to such means for connecting and integrating, and that other means for such connecting and/or integrating of the subassemblies, components, and/or elements, as known in the art, are usable.

Specifically, although the depicted embodiments of the automatic slip setting apparatuses (10, 210, 500) and the screw clamp (300) are shown having components that are configured for attachment by a temporary means, such as by the use of a plurality of bolts, it should be understood that in another embodiment (not shown), the components can be permanently attached to each other to form assemblies by any means known in the art, including various welding techniques. Furthermore, while the depicted embodiments of the automatic slip setting apparatuses (10, 210, 500) and the screw clamp (300) are shown having components that can be welded together, it should be understood that in another embodiment (not shown), the components can be integrated to form assemblies by other means known in the art, including the use of bolts. Also, in other embodiments of the automatic slip setting apparatuses (10, 210, 500) and the screw clamp (300), corresponding components may contain threaded surfaces that are usable to threadably connect such components together.

In yet other embodiments of the automatic slip setting apparatuses (10, 210, 500) and the screw clamp (300), individual components or assemblies thereof, may be integrally formed by manufacturing or machining the components from a single piece of material. In still other embodiments of the automatic slip setting apparatuses (10, 210, 500) and the screw clamp (300), individual components or assemblies thereof, may be integrated or held together with clamps, latches, pins, or by any other means known in the art.

While various embodiments of the present invention have been described with emphasis, it should be understood that within the scope of the appended claims, the present invention might be practiced other than as specifically described herein.

What is claimed is:

1. A system for setting a plurality of slips about a tubular member, wherein the system comprises:

a spider assembly for gripping the tubular member, wherein the spider assembly comprises:

a spider body having an opening extending therethrough;

a first plurality of slips;

a yoke connected with the first plurality of slips, wherein the yoke is movable between an open slip position and a closed slip position; and a locking assembly connected to the yoke;

an elevator assembly comprising a second plurality of slips for raising or lowering the tubular member out of or into the spider assembly; and a lever arm assembly pivotally connected to the spider assembly and comprising an upper portion and a lower portion, wherein the upper portion of the lever arm assembly extends above the spider assembly and is movable from a raised position to a lowered position when contacted from above by the elevator assembly, wherein the lower portion of the lever arm assembly contacts a lever arm of the locking assembly, thereby releasing the yoke, wherein the yoke moves upward into the closed slip position and the first plurality of slips closes about the tubular member when the upper portion moves from the raised position to the lowered position, and wherein the lower portion of the lever arm assembly disengages from the yoke after the plurality of slips close about the tubular member.

2. The system of claim 1, wherein the elevator assembly further comprises an elevator body comprising an opening extending therethrough, and wherein the locking assembly maintains the second plurality of slips in an open position or a closed position.

3. The system of claim 2, wherein the spider assembly further comprises a vertical guide plate attached to the spider body, wherein the vertical guide plate comprises at least one sloped surface, and wherein the vertical guide plate aligns the opening of the spider body away from the vertical guide plate and towards the opening of the elevator body.

4. The system of claim 3, wherein the elevator assembly further comprises a bell guide apparatus connected to the elevator body, wherein the bell guide apparatus engages the at least one sloped surface of the vertical guide plate during the lowering of the tubular member.

5. The system of claim 1, wherein the spider assembly further comprises a horizontal guide plate, wherein the horizontal guide plate is positioned over the opening of the spider body, and wherein the horizontal guide plate comprises a bore for receiving a tubular therethrough.

6. The system of claim 5, wherein the horizontal guide plate comprises at least two portions, and wherein at least one of the at least two portions is horizontally pivotable for altering the size of the bore.

7. A slip setting system for closing slips of a spider assembly about a tubular member, wherein the system comprises:

the spider assembly for gripping the tubular member, wherein the spider assembly comprises:

a spider body having an opening extending therethrough;

a plurality of slips; and a locking mechanism for maintaining the plurality of slips in an open position or a closed position; and an arm assembly pivotally connected to the spider assembly, wherein the arm assembly comprises an upper portion and a lower portion, wherein the upper portion is movable between a raised position and a lowered position, wherein the upper portion moves from the raised position to the lowered position when contacted by an object moving toward the spider assembly, wherein the lower portion lifts a lever arm of the locking mechanism and the plurality of slips close about the tubular member when the upper portion moves from the raised position to the lowered position, and wherein the lower portion of the arm assembly disengages from the locking mechanism after the plurality of slips close about the tubular member.

8. The system of claim 7, wherein the upper portion of the arm assembly extends above the spider assembly, and wherein the upper portion pivots downwardly when contacted by the object.

9. The system of claim 7, wherein the upper portion of the assembly comprises an upper arm pivotally connected to the spider assembly, and wherein the lower portion comprises a lower arm pivotally connected to the upper arm.

10. The system of claim 9, wherein the upper arm of the arm assembly is pivotally connected to the spider assembly at an intermediate point along the upper arm, and wherein the upper arm moves the lower arm in an upward direction as the upper arm moves from the raised position to the lowered position.

11. The system of claim 9, wherein the lower portion of the arm assembly comprises a flexible member, wherein one portion of the flexible member is connected to the upper arm and another portion of the flexible member is connectable to the locking mechanism.

12. The system of claim 7, wherein the object comprises an elevator assembly, a pipe handling device, a bell guide, any other object connected with the pipe handling device, or combinations thereof.

13. The system of claim 7, wherein the spider assembly further comprises:

a guard disposed above the plurality of slips; and a hydraulic clamp positionable between the guard and at least one of the plurality of slips, wherein the hydraulic clamp extends against the guard and the at least one of the plurality of slips, while the plurality of slips are in the closed position.

14. The system of claim 13, further comprising a foot pump in communication with the hydraulic clamp, wherein the foot pump converts pneumatic energy to hydraulic energy to control the extension of the hydraulic clamp.

15. The system of claim 14, further comprising an interlock valve connecting the foot pump and the hydraulic clamp, wherein the interlock valve prevents communication from the foot pump to the hydraulic clamp unless the hydraulic clamp is positioned between the guard and the at least one of the plurality of slips.

16. A method for setting a plurality of slips in a spider assembly, the method comprising the steps of:

lowering an object toward a spider assembly, wherein the spider assembly comprises a locking mechanism for maintaining the plurality of slips in an open position or a closed position and an arm assembly connected to the spider assembly, wherein the arm assembly comprises an upper portion and a lower portion, and wherein the upper portion extends above the spider assembly;

contacting the upper portion of the arm assembly with the object to move the upper portion of the arm assembly downward;

actuating a lever arm of the locking mechanism with a lower portion of the arm assembly to unlock the plurality of slips, wherein the plurality of slips move to a closed position about a joint of pipe; and disengaging the lower portion of the arm assembly from the lever arm of the locking mechanism after the slips close about the joint of pipe.

17. The method of claim 16, wherein the step of contacting the upper portion of the arm assembly with the object to move the upper portion of the arm assembly downward further causes the lower portion of the arm assembly to move upward.

18. The method of claim 16, wherein the step of actuating the locking mechanism with the lower portion of the arm assembly to unlock the plurality of slips further comprises lifting a lever arm of the locking mechanism with the lower portion of the arm assembly to unlock the plurality of slips, thereby causing the plurality of slips to move to the closed position about the joint of pipe.

19. The method of claim 16, wherein the object comprises an elevator assembly, a pipe handling device, a bell guide, any other object connected with the pipe handling device, or combinations thereof.

* * * * *